US005524998A

United States Patent [19]

Schwartz

[11] Patent Number: 5,524,998

[45] Date of Patent: Jun. 11, 1996

[54] LEAF STRUCTURE WITH A HINGED REPOSITIONAL BINDING

[75] Inventor: David C. Schwartz, Southboro, Mass.

[73] Assignee: Productive Environments, Inc., Framingham, Mass.

[21] Appl. No.: 193,381

[22] Filed: Feb. 8, 1994

Related U.S. Application Data

[63] Continuation-in-part of Ser. No. 19,645, Feb. 18, 1993, abandoned, which is a continuation-in-part of Ser. No. 963,907, Oct. 20, 1992, abandoned.

[51] Int. Cl.[6] ..... B42F 3/00

[52] U.S. Cl. ..... 402/79; 281/21.1; 281/38

[58] Field of Search ..... 402/79, 80 K; 281/2, 15.1, 21.1, 38, 41, 42

[56] References Cited

U.S. PATENT DOCUMENTS

| | | | |
|---|---|---|---|
| 4,990,018 | 2/1991 | Best et al. | 402/79 |
| 5,299,879 | 4/1994 | Burrow | 402/79 |

*Primary Examiner*—Willmon Fridie, Jr.

[57] ABSTRACT

This invention relates to leaf structures where the leaf structure is used for the capture, representation, organization, access, presentation, communication, and delivery of information, and to such leafs further comprising a leaf body portion serving as a media strip and a leaf binding strip, where the leaf binding strip offers a novel binding structure capable of providing alternative ways of being attached to other objects, where said binding structure provides a hinged binding with repositional adhesive as a part thereof allowing for the pivotal and semi-permanent attachment of the leaf structure to other objects, where said semi-permanent attachment allows said leaf structure to be directly attached and subsequently reattached by way of the self possessed repositional adhesive, to a host, particularly a host book, it's bindings, it's surfaces, and or its covers, where said semi-permanent repositional adhesive means may be deactivated, by pivotally folding said binding strip into a position coincident with the leaf body, thereby allowing for the separate manipulation of the leaf free of any adhesive constraints, as any leaf might be handled, bound, shuffled, or otherwise attached to a another structural binding, such as a ring binding, clip, or the like. These leafs and their bindings relate therefore to the non-sequential (non-linear) binding of leafs a host binding, first by permitting attachment by physical repositioning through use of their self possessed repositional adhesive to a host surface, while being able to be turned as a page of their host binding whether, sewn, stitched, ring or the like, by way of their unique hinged attachment means, and second, with repositional adhesive deactivated, through loose binding such as "shuffling" or by attachment to a structure such as a ring, a clip, or the like. The adhesive binding offers various ways of providing activation and deactivation, and in combination with a host leaf, various ways of being attached to multiple bindings. The invention provides for the binding of the hinged leaves one to another, therefore offering a new kind of book binding where the binding of the leaves forms a mini-book with a spine comprising hinged binding strips, one adhesive strip hingedely attached to the other, thereby allowing for the turning of each leaf as a page and for the selective separation and non-linear reconstruction of the book of leaves without need for another form of binding structure to keep the leaves together.

42 Claims, 33 Drawing Sheets

Abcde
10
10a
10b
10c
10d
10e
10f
10g
100
100a
101
101a
102
102a
102b
103
103a
104
105
106a
106b
200
200a
200b 103b
200a
100a
101b
11
103a
101a
102a
10

NOTES:
FILL IN
110a
110b
110c
110d
110e
10n
10t
10h
10f
10k
10w
10v
10i
10L
10r
10s
11

20
20b
20a
101
10f
101
10f 25c
25
25d
11
101
10f
10f
101
11

30c
30
30a
101
10f
10f
101

15
101b
205
312
101

36K
36g
36j
36L
36m
36n
10f
101
36i
36i1
36i2
36i3
36i4
36g
36j
36i

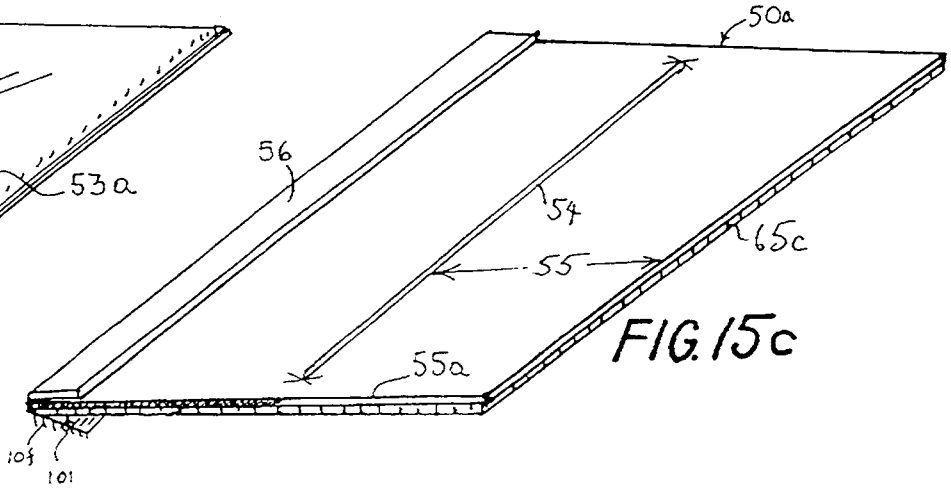
FIG. 15c
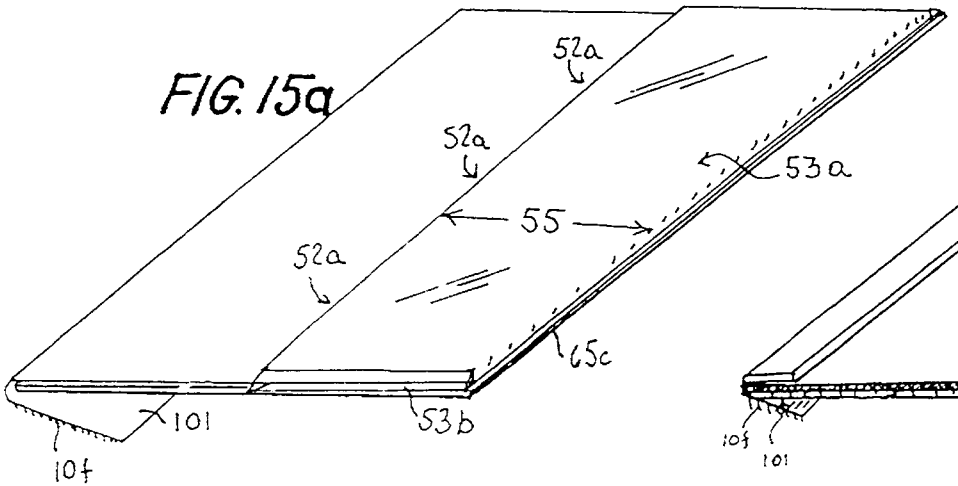
FIG. 15a
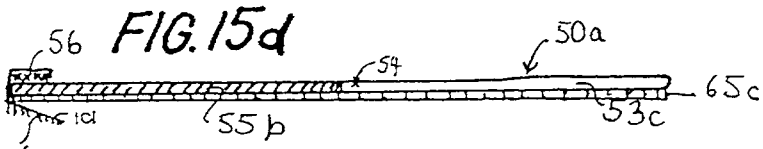
FIG. 15d
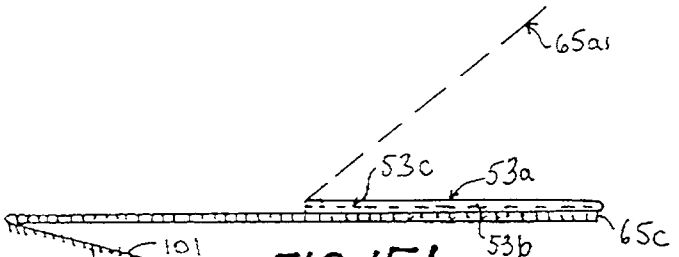
FIG. 15b
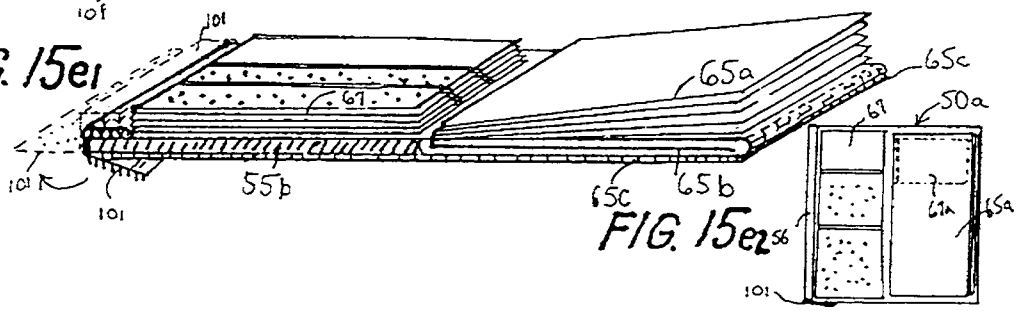
FIG. 15e1
FIG. 15e2

81
80
83
400
401
101

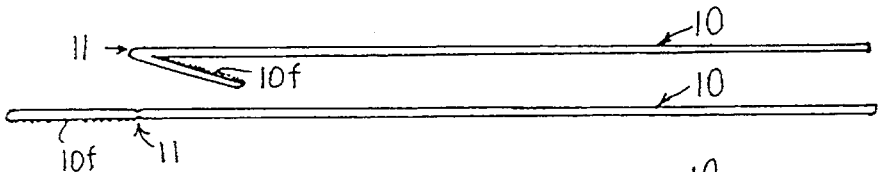
FIG. 21a
FIG. 21b
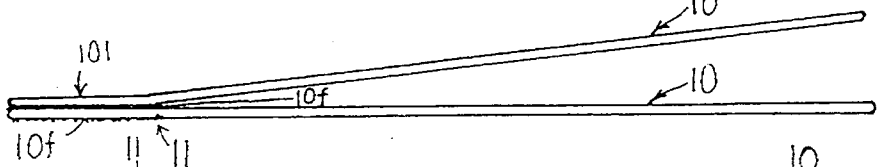
FIG. 21c
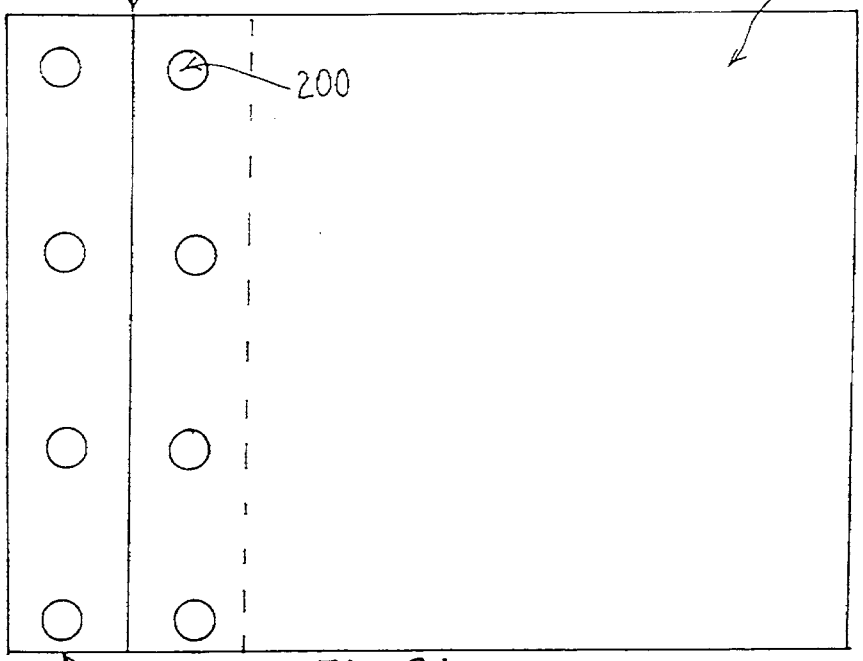
FIG. 21d
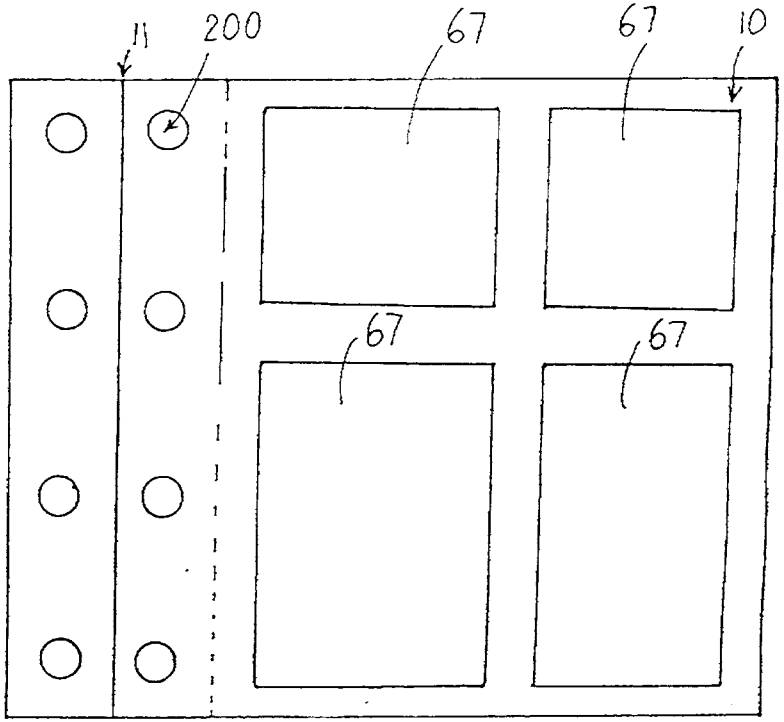
FIG. 21e 10s
lp
lk
lk
O
O
101a
11c1

101a
lk
lk
lk
lk
lk
11c1
10f
10f
11c1
101b 100c
10g
lk
lj 100d
100e 100f
ln
lk
200

100g
100h
lp
lk
200

100i
100j
ln
lp
200
200
11c1

LEAF STRUCTURE WITH A HINGED REPOSITIONAL BINDING

CROSS REFERENCE TO RELATED APPLICATION

This application is a continuation-in-part of commonly assigned U.S. patent application Ser. No. 08/019,645 filed Feb. 18, 1993, now abandoned, which is a continuation in part of abandoned commonly assigned U.S. patent application Ser. No. 07/963,907 filed Oct. 20, 1992.

BACKGROUND OF THE INVENTION

This invention relates to binding means for leaf structures where the leaf structure is used for the capture, representation, organization, access, presentation, communication, and delivery of information, and to such leafs further comprising a top window surface having perimeter features including a plurality of edges, where at least one edge offers novel binding means capable of providing alternate ways of being attached to other objects, where said binding means relates to a hinged binding that offers means for semi-permanent attachment to other objects, where said semi-permanent attachment allows said leaf structure to be directly attached and subsequently reattached, by way of a self possessed repositional(capable of being attached, removed and reattached many times) adhesive, to a host, particularly a host book, it's bindings, it's surfaces, i.e. its pages, and or its covers, where said semi-permanent repositional adhesive means may be deactivated, thereby allowing for the separate binding of the leaf as any leaf might be manipulated, shuffled, or otherwise attached to a structural binding, such as a ring binding, clip, or the like. These leafs and their bindings relate, therefore, to the non-sequential (non-linear) pivotal binding of leafs to alternative host binding structures. First, pivotal attachment is offered by way of the hinged adhesive binding structure, and enables the page to be turned as a page of it's host binding whether, sewn, stitched, ring or the like, said non-linear behavior being enabled by physical repositioning through use of a self possessed repositional adhesive allowing attachment to a host surface. Second, with repositional adhesive deactivated, non-linear repositioning is enabled through attachment to a structure such as a ring, by way of an integral cut pattern, or to a clip, pocket, or loosely coupled via rubberband or like "unbound book" binding means.

The invention particularly relates to the provision of such semi-permanently attachable pages which possess repositional adhesive as one of the multiple binding means and offer the property hereinafter referred to as "repositional window paging", the ability for the page to maintain its top or "window surface(face)" and perimeter orientation in various bound positions by removal and replacement using the semi-permanent attachment means offered. The new aspect here is the novel way of allowing for the activation and deactivation of the repositional adhesive along a pivotally folded hinged strip.

The invention relates to leafs of various types according to the invention possessing writing, forms such as calendar formats, adhesive strips, adhesive mounting surfaces, and basic mounting surfaces, including leaf sets comprised of pluralities of surfaces, leafs which themselves are folded in a pattern forming a plurality of surfaces, pockets of various styles, leafs as indexes with one or more indexing edges, leafs with writing surfaces such as notepads, and leafs with means for attaching posted repositional notes which serve as a delivery system for attachment and subsequent manipulation of arrays of stacks of repositional notes of varying sizes. The leafs may have their structural features such as their fold hints and hole patterns, cut therein, prefolded, or otherwise printed in such a fashion that their unique structural formation and behavior is enabled.

The invention relates to a particular form of repositional leaf body which has a plurality of repositional note stacks and an adjoining leaf array. The invention relates to the mechanical implementation of this object.

This general feature of repositional window paging, when added to or implemented as any one of a number of these different surface types improves visual access and dynamic manual access to the surfaces as part of a book system. These mounting surfaces may therefore be offered as easily repositional pages for a host book to enhance the overall notetaking process.

The invention further relates to leaves with surfaces offering semi-permanent retaining means which enable easy removal and reinsertion, permitting rapid reordering for non-linear access, while retaining their semi-permanent binding during the page turning operation, to such mounting surfaces which provide "repositional window paging", which may be semi-permanently attached to the surfaces of a host using a self-possessed repositional adhesive, and subsequently attached to say a ring, clip, or other binding structure, when their repositional adhesive is deactivated.

The invention also relates to the construction of mini-books, "booklets" where each leaf is turnable as a page and is semi-permanently retained in the booklet.

The invention therefore relates to book systems formed by combining covers, rings, and windowing surfaces according to this invention that offer compact, reconfigurable, highly visual means for handling heterogenous, mixed media forms of information. In particular to book systems comprised of mounting surfaces according to this invention, with repositional notes mounted thereon which are retained for referential access and whose value ages according to time and content merit, where the leaf bodies and the notes mounted thereon provide high referential integrity and the construction of contexts of groups of notes comprised of notes where each note represents an item of information. Further, where the groupings of notes are capable of being reconstructed dynamically and where their leaf carrying member may be subsequently reintegrated in a hosts with alternate binding structures.

These repositional windowing surfaces, implemented with removable holes and cut patterns according to this invention, may be implemented with the hole pattern formed as an attachable tape strip, or, alternatively with an adhesive strip of any (and appropriate) length ("short" strips have a length that is shorter than the overall page length) or width ("narrow strips" have a width that is sized so as not to interfere with a leaf hole pattern by way of being narrower than the distance from the hinged edge to the point of the hole closest to that hinged edge), or they may be implemented directly as part of a surface, i.e. a page, in standard length (page length) and standard width (typically a 0.6 in tape band of repositional adhesive) or in short and narrow form, with a recording section formed in a suitable way to the end application.

With the primary application of this binding as a new form of repositional note, i.e. for example Postit™ (brand name of 3M Company), the existence of repositional notes in and of themselves must be considered. Currently, the traditional repositional note in standard form has it's adhesive on the opposing side, when considered with respect to the side used as the writing surface. In this form of repositional note, the note is written on directly as an opaque surface receptive to writing, i.e. paper. The adhesive is active when the note is unattached to a host object, and the adhesive operates as it's sole binding means for attaching to a host surface. First, when such a note is placed in a book, the note typically covers the surface on which it is placed. Although this is not always the case, as with notes made with a clear plastic material as a part thereof, the dominant note formfactors as standard format notes in "macrosizes" of 1.5"×2" and up have this property. Adhesive strength being set for removability, any effort to "look below" the note, by lifting up the opposing edge of the note, to see below, results in a turning torque orthogonal to the adhesive binding and thereby results in the undesirable separation of the note from its host surface and the progressive curling back of the note. Curling back occurs when the larger extent of the unadhesively attached section is lifted off its host surface and creates other problems in appearance, readability, and unwanted dislodging by other interfering objects. Additionally, standard form uses only one side of a repositional note for representation purposes, i.e. the note cannot be turned in place so that both sides may be used (exposing the other side dislodges the note). Therefore existing repositional notes do not lend themselves to be turned, but rather are for the static posting to a surface, only one side used for representation, and moved only by purposeful separation.

Further, existing repositional notes are primarily writing surfaces and act as substitutes for paper in the notetaking process. If one were to mount a written repositional note on top of a second repositional note as a host surface, (accepting the current and typical pattern of adhesive for these notes which has the adhesive along a single edge with a tape band of approximately 0.6 inches), for the purpose of using the second or host note to move one or more written notes placed on top of it as a group, a number of other problems would arise. First, paper surfaces are not ideally suited for receiving repositional notes. The placement of repositional adhesive on granular surfaces yields fewer movements per adhesive application than would placement on a smooth (coated) surface. Even if stronger or wider adhesive is used, some form of smooth surface is preferable for the host note. In other words, if the host (second) note is to be used as a moving means, and not for writing, its surface would be better constructed as a smooth surface for receiving notes as a primary function. Second, if the note is structured as a standard format note, i.e. with adhesive along one edge and on the opposing side of the mounting or writing side, and formed from thin paper as is the standard case, then when the host note is lifted, all the notes mounted there on can dislodge in an adhock manner from the curling effect of lifting the standard format host note.

In addition, once such a note is used, it's secondary location is limited to a surface in which the adhesive may be applied again. This will result in the note being attached to other pages by it's self-contained adhesive which other pages, themselves, may be bound in any number of ways to a host. The note itself may not be used in a second, non-adhesive binding manner. For example, if one wanted to "shuffle" such a set of standard format notes, this would be impossible since the active adhesive would attach to the first object it came in contact with. It might be possible to reorder the notes by breaking and relinking their adhesives, one to the other. This, however would be a very time consuming operation and would not provide the full eye hand effect of resistance free shuffling.

Typically notes are written on, then discarded. Here, notes which are written on are reused in an overall referential structure that is multidimensional as opposed to sequential, and the consumption of or utilization of notes is increased not by throwing away but instead by a process of intelligent collecting. Even notes which are no longer needed in an active sense may be intelligently "garbage collected" by category and used as a list of referencable and completed items, thereby forming an item based note "microworld".

Typically leafs used for attachment to a structural binding, i.e. a ring or a clip, possess any number of forms and related functions, i.e. pockets, acetate, folds of various kinds and have a standard cut pattern for attachment to a compatible target host binding. However, these surfaces may not be attached to any other surface at random but require a compatible host binding of like structure for reattachment. Surfaces according to this invention possess their own adhesive, in the preferred embodiment, a repositional adhesive, for attachment to a second surface.

Typically, to form a multi-leaf structure, a binding means must be employed. There are numerous binding means available, but often these are structural bindings that are "thickened" by the binding structure itself, like a ring, wire, clip, or stapled folded structure that have a minimum height defined by the height of the binding itself. The binding thickness is not directly equivalent to the thickness of the sum of the leafs bound, but sets the maximum number of leafs which can be received. The ability to place/insert a preset number of leafs as a "turnable" leaf set module, within another leafed structure where the leaf set thickness of the insertable module is no greater than the sum of the thickness of one or more of the number of leafs themselves has been unavailable. Providing such multi-leaf structures, in particular multi-leaf sets, with their own direct binding means through a selectively "activatable" adhesive is new. Providing an adhesive which may be attached to a multiple leaf structure thereby enabling it to function as a semi-permanently attachable leaf set is new.

So, the invention further relates to the construction of mini-books, "booklets" where each leaf is turnable as a page and is semi-permanently retained in the booklet, and where the leaves are formed with the leaf structures according to the invention where each of the leaves has a hinged repositionable binding, cascaded, one attached to the other in a pad format with an optional deactivation base leaf or strip. The formats of the leafs may include any of the leaf styles in prefolded combination.

Therefore, windowing pages that preserve the face and perimeter orientation of the top surface or "window", which may be constructed as writing surfaces, or multi-function surfaces, and which may be semi-permanently attached to a heterogenous set of bindings, binder surfaces, i.e. the cover or other surfaces of the host object, (i.e. the blank book or notebook) using a "deactivatable" repositional adhesive have been unavailable. Further, such heterogenous binding repositional notes acting as "repositional window pages" which themselves act as mounting surfaces for, in particular, other repositional notes, and which provide a quality means for the posting of groups of notes mounted thereon have been unavailable. Such repositional windowing pages as described, delivered in a semi-permanent attached fashion, there by offering non-sequential positioning across heterogenous bindings, have been unavailable to notebook users.

Additionally, leafs with short and narrow binding tabs which offer repositional adhesive on a portion thereof, may be folded over to deactivate, and which leave all perimeter edges "free" but for the perimeter section along which the binding tab is located, have been unavailable.

SUMMARY OF THE INVENTION

The invention therefore relates to pages as writing surfaces, mounting surfaces, or the like, with a novel, hinged, edge binding that can be directly attached to a host, in particular a host book, by way of a self-possessed repositional adhesive, and which can alternatively have their repositional adhesive deactivated by attachment of a portion of itself to another part of itself, and thereby be bound by other conventional external binding means such as rings, clips, and the like, or be shuffled in a resistance free manner..

The invention further relates to ways of grouping an array of single leafs according to the invention as writing or mounting surfaces through use of the adhesive, pivotal binding edge, into mini-books and to oval holes which allow for standard use when part of a mini-book fold set. So, the invention further relates to the construction of mini-books, "booklets" where each leaf is turnable as a page and is semi-permanently retained in the booklet, and where the leaves are formed with the leaf structures according to the invention where each of the leaves has a hinged repositionable binding, cascaded, one attached to the other in a pad format with an optional deactivation base leaf or strip. The formats of the leafs may include any of the leaf styles in prefolded combination, such as leafs with prefolded short and narrow tabs with a portion of the tab having repositionable adhesive on it where the tab is integrally formed as a part of the removable leaf. The short tab preferrably has a curved radius joining a corner of the note to the tab. The curved radius can be at one or both tab ends. The tab is folded back and cascaded where the curved radius enables single leaf release from the pad assembly. The base leaf preferably has a band of repositionable adhesive from top end to bottom end to receive the full binding edge of a base leaf and thereby retain the pad assembly while single or multiple leafs are removed by the user. The radius curve leaves a note corner free so the consumer can, if necessary, peel the note to be released up while holding the corner of the note below to keep the pad stable on release of the top note or group of notes, or a flap edge of a host pocket (say in vinyl or other flexible material) can hold the top corner stable. This is optional and is not necessary for pad use.

The invention also relates to various forms of mounting surfaces, as surface constructions, which may be used with the edge binding according to the invention, which mounting surfaces may include clear plastic surfaces for posting repositional notes thereon, writing surfaces, indexes, adhesively coated surfaces, and the like.

The invention further relates to semi-permanent/non-adhesive retaining means which may be implemented via cut patterns of various types, for attaching to other bindings such as rings and wire bindings, and to strips formed from said semi-permanent cut patterns in combination with a parallel strip of adhesive, as a tape. These tapes, formed from a variety of materials such as spun fibre (e.g. Tyvec™ Dupont/spun olefin) or mylar or like "many foldable material", allow the construction of leafs employing the multipurpose bindings according to the invention, which enable the easy insertion and removal of leafs so constructed, while retaining their semi-permanent binding during the page turning operation independent of the outward and inward force placed on the page, orthogonally to the host binding for the page.

The invention relates to ways of packaging the repositional window pages as stacks of repositional notes as well as ways of distributing the repositional strips as arrays of tabs, tape rolls, or like and similar distribution format.

The invention relates to systems used in information handling where highly visual access to said information is desirable and where the continuous recategorization and or updating of that information is needed. Books typically thought to be used purely for delivery of information as reference guides are being increasingly put to use as "active" information tools for known categories of information. This invention relates to applications demanding interactive reuse of manually and visually accessible information.

The application of the "repositional WindowPage® (a registered ™ of PEI) Insert" as a book mark (i.e a "SmartBookMark(™) a trademark of PEI"), in simple or multifolded construction, which can be used to retain information as it is moved through the book would be one such application. This would be particularly advantageous for use in school books and the like, where it would be desirable to retain notes in context of a sewn bound book and then store them for reference in a ring bound book or the pocket of an organizer. This would suggest certain standard sizes such as 5"×8" or 8½"×11". Another application would be for a "patch page" for a glue bound book such as a magazine or the like. In this case, the window surface would be printed with a message of some form and the leaf could be placed in the magazine as an add or other information source. Removal and reattachment to another surface would be enabled by the construction according to this invention. The preferred way of constructing the adhesive on the hinged binding strip makes this page an ideal add in page for a wire bound book as well, where the hinged strip can be placed on a page, along the seam of the wire, and can turn as an add-in "floating" page of the wire bound book. This construction provides an extremely flat binding for notetaking surfaces, allowing for the construction of a "black board notetaking system" as detailed in the inventors U.S. Pat. No. 5,048,869. In the black board application, the form factor of particular relevance is the surface as a mounting surface for other notes. Various mounting surface constructions would extend the application further, as with mounted repositional indexes, or removable strips which themselves might be writable, which exposed and adhesive, preferable respositional, to which one might attach other objects such as business cards and the like. The introduction of printed forms using this structure would employ the top window page directly as a writing surface. A calendar application would be an example. Whether printed or not, this configuration is a new form factor for repositional notes. The use of a stronger adhesive, even a seemingly permanent adhesive, would be particularly useful for certain multi-function constructions where a pocket and an inserted module are employed. The book mark can be made the width of a margin, whether in single or multifolded format, and can work along side the text as opposed to hingedly overlaying the text.

Therefore an object of this invention is to provide for surfaces which posses a novel binding means along at least one edge where said binding means comprises a repositional adhesive attached to a hinged binding in such a fashion that the note thereby formed may be written on both surfaces, i.e. the top window and the bottom window surface, as well as being turned as a page of a book to which it is attached, without being dislodged in an adhoc fashion.

The repositional adhesive binding tab section may be short, i.e. shorter than the length of the edge of the page to which it is attached, and when this is the case, all the perimeter features, as in the case of a rectangular page the four corners, would be free for "touching" almost like a loose or floating page. This would give the look and feel of a free sheet or a sheet in a ring.

Further it is an object of this invention to provide such a hinged binding edge in which the adhesive may be deactivated by folding or by attachment of a second deactivation strip and which when deactivated possess a second binding means such as a pattern of holes for attachment to a second and different binding structure, such as a ringed binding.

Further, it is an object of this invention to provide for a variety of surface types possessing this type of binding including pockets, adhesive based mounting surfaces, mounting surfaces with index tabs, laminated or otherwise smooth treated mounting surfaces, clear acetate, mixed clear and opaque material, lifetime foldable material such as tyvec (non tear spun fibre), and writing material such as paper for providing a means to allow repositioning of mixed media representational forms in otherwise non-compatible host bindings.

It is a further object of this invention to provide for a way to attach arrays of notes to the mounting portion of such a leaf where either single layers of posted notes or multiple layers as a note source are deployable without the arrays of notes being dislodged on the movement of the leaf.

It is a further object of this invention to offer various ways of packaging the notes themselves as note stacks, or to pack the tape in strips, or rolls, and to package the strips in arrays on sheets for direct peeling by the consumer.

It is a further object of this invention to offer a way to "flat bind" a set of leafs which together possess the property of repositional attachment and subsequent adhesive deactivation and which may alternatively be pivotally attached to a second structure for use, for example, in enhancing the process of notetaking or in enabling the distribution of printed materials.

It is a further object of this invention to offer the flat binding multi-leaf structure as an object of invention as well as a means for allowing attachable formfactors which themselves may alternatively be pivotally attached to a second structure.

In accordance with the invention, what is provided, and as shown by a preferred embodiment in FIGS. 1 and 2, is a page with a top and bottom window face and perimeter features including at least two opposing edges that is hinged near one edge by a fold along an axis parallel to said edge, thereby dividing said page into two parts, a binding strip and a leaf body, where the binding strip is a pivotally creased hinge strip of approximate page margin width (or less), and where the leaf body is (in this instance) constructed as a writing surface. The leaf binding strip has placed upon it a layer of repositional adhesive. The repositional adhesive is placed on the top face, face up, on the leaf binding strip, i.e., on the same face as the adjoining writing surface (top face). The binding edge can be pivotally folded to place the adhesive in contact with the top writing surface, thereby deactivating the adhesive, or can be pivotally folded below and serve as a means for enabling the hinged attachment of the page to a second host surface. In the preferred embodiment, said adhesive is placed in such a fashion so as to be partially removed from the outer edge of said strip, thereby forming a lifting edge, free of adhesive, which enables the lifting of the strip from either attached position, a first position in which the strip is folded over with the adhesive surface bonded to the writing surface, or a second position in which the page is "hingedly" attached to a second surface. The fold axis allows the page to be turned naturally, as a page of the host book itself, when placed in a compact host binding such as a stitched, sewn, or wire bound book binding, the strip with adhesive, providing a binding edge which is subsequently removable and reattachable, and that enables preservation of the orientation of the top window surface of the mounting surface in a plurality of locations when reattached along said same binding edge, with respect to the book to which it is attached. The adhesive means for attaching the surface to the book may be a permanent adhesive, but is preferably a semi-permanent repositional adhesive. The strip with repositional adhesive, when folded in such a way as to place the adhesive in contact with the top face of the page deactivates the adhesive since the adhesive is now completely covered and allows for other forms of binding of the page, such as by way of the punched hole binding shown. FIG. 2 shows the alternate deactivation of the repositional adhesive and the placement of the page in a ring binder, where opening or closing of a ring mechanism is required for removal and repositioning of the page.

Other applications of this form factor would include a sheet with a narrow adhesive strip. The narrow strip would not overlap the holes and would be suitable for narrow binding margins of host books. A "leaf body" as a mounting surface could have adhesive applied on it and removable strips which themselves might be writable and or adhesive could be peeled off exposing the underlying adhesive. The underlying adhesive would then provide a surface for attaching other objects such as business cards. Alternatively, the strips could have adhesive on a portion of them and be formed as peelable indexes mounted on a nonadhesive mounting surface. Also, one might print a calendar or other format as a form on one or both sides. All the markings as hints can be printed (on one or both sides) or alternatively cut, or in the case of the folds, also prefolded. The cut can be any kind of perforation which enhances folding and may have a functional objective as well, as shown in the wire bound case later.

The delivery of a stack of repositional notes fashioned as detailed above, might be implemented as a pad with two sets of parallel drilled holes, with a fold hint on each sheet of the pad. The adhesive and writing or mounting surface would be face up. The holes can be oval to support interleaved folding when minibooking so as not to "loose the hole" when grouping a stack and folding the last adhesive over to deactivate the lot. The markings, if printed, can be printed on either or both sides. Printing on the back can enhance consumer folding in certain cases.

A description of variations to be claimed include a version of the preferred embodiment without the punched hole pattern. Note that the peeling edge of the adhesive strip may be printed on both sides to identify the location and orientation of the adhesive. This variation might be constructed with the adhesive placed flush to the hinged binding edge.

The single leaf variation is basically formed with two panels where one panel is the writing surface and the second pivotally attached panel is an adhesive strip. The adhesive strip may be of any length and width suitable to the application. A shorter strip would allow four free corners of the host leaf and allow it to have the look and feel of a "loose page". A narrow strip would support narrow margins of host books and would also be able to be folded into "deactive" position without interfering with a hole pattern if one exists on the first writing panel. The hinge for pivotally folding the adhesive panel can be cut for easy folding, like in the wirebound sample, or can be prefolded, or marked for folding. A short strip of sufficient width might overlay a portion or just one hole of a leaf with a hole. The writing panel can be die cut to a variety of shapes. This would be very useful for the book mark application and would be a way to create a variety of appealing shapes for children, such as a face, the perimeter features of a state, an animal or the like. This can be coupled with printed features of the die cut object such as eyes etc. The leaf body may be stiffened and the removable strip left flexible. This might be a likely form factor for a Tyvec leaf but would work with any flexible material and would have the added advantage of enabling a quick and perfect fold along the preferred hinge axis. The stiff edge would provide a folding edge and therefore, premarking or hinting could be eliminated. Any depletion of removable/repo-adhesive can be replenished by the consumer. It would even be possible to have the consumer place the initial band of adhesive on the repositional binding strip, although this is generally less desirable.

It is possible to stiffen only the edge possessing the alternative binding structure (i.e. the edge with the holes). This edge may have a hole which intersects the leaf perimeter. The stiffener might be a tyvec or a mylar material applied to the surface of the leaf.

Alternatively two opposing edges may be provided with the folded strip binding means as may be two orthogonal edges. This would allow for subsequent repositioning with hinged attachment allowing for different page turning behavior in subsequent placements. The cut pattern can be a tooth form suitable for attachment to a wirebound book binding which structure would be employed, for instance, when the repositional adhesive was deactivated.

The page surface can take on different structure and still be formed as a single leaf from a single sheet of material. In one variation, the surface is a multi-folded sheet where the subsequent folds are layered one on top of the next, as in an accordion fold, allowing for the subsequent extension and compaction of the surface depending on viewing needs. Such a surface might be printed with a calendar or telephone page format or a like form of written solicitation or otherwise with any form of information representation. This variation can have the folds adhesively coupled to form "stiffened" leaves which may also be laminated for the purpose of marking or mounting. This can all be folded out of a single sheet of paper, mylar, or tyvec like material.

Alternatively, the surface might be formed as an index page with at least one indexing edge, or a pocket in any one of various styles.

For the case of the pocket in which the pocket is formed with an insertion section along the edge comprising the hinged fold axis, it would be possible to insert a pad card or note card having a stacked array of repositional notes thereon, where the note or pad card would have a cover which itself could be folded back and under the media bearing section of the card to form a tongue for insertion into the pocketed, adhesively attachable page. The note or pad card might also comprise a second tongue on its media surface which could be inserted into a slit on the pocket to keep the media card, when mounted, from flapping out of position. The card could itself have the adhesive applied directly to it, for direct mounting to a host surface. For the pocketed version, a partial pocket which might be formed by folding over the outer edge and laminating the free edges would house a leaf which might be half the page width, with the other half of the leaf body mounting surface left "unobstructed" for stacking a set of repositional notes. This structure can be formed in a number of ways including using tabs at the free edges which are adhesively attached to the opposing side of the leaf body to form the pocket. The edges could also be heat sealed or welded depending on the material used. The pocket lip can optionally be extended to form one or more leafs for mounting things on, such as postit notes. The repositional notes would be of equal width to the leaf set and would be noted and posted to the leaf array. The leaf might be folded so as to provide a protective barrier for this note stack so it would not be easily dislodged. The leaf might alternatively be folded over a plastic profile with such a barrier and thereby create the barrier and pocket. The representation of this structure would be useful for the purpose of note capture and preliminary representation. The specific structure could have note pads of varying heights and in a preferred embodiment would be at least two colors to support notes separated for personal and business record keeping. The object itself, in its formal representation as a column of notes of varying height, where the notes would be in at least one, but preferable two colors, and accompanied by a columnar leaf array.

The adhesive can be machine applied. However, an alternate embodiment would deliver the page with fold markings or "prefold" indications which could have markings for the directive application of adhesive, and would suggest a means for applying adhesive, which adhesive may be pressed on by the consumer at will by means of a dispenser of some kind.

In another variation, the adhesive would be deactivated by a strip applied over the hinged strip, which deactivation strip might also have an adhesive for subsequent, independent placement.

The page surface might be an opaque surface for writing upon and the hinged strip might be constructed from a clear section of material so as to not affect the viewing of written material when placed on a printed host surface. The page surface might be constructed from a smooth material susceptible to receiving other standard adhesively formed repositional notes. This can be a surface that is chemically treated or one which is laminated. The hinged strip might have a stiffener such as a mylar or other laminate placed on the non-adhesive edge to improve the feel of the surface upon removal or attachment, to prevent curling, and to ease the process of removal and subsequent replacement.

The construction of one or more surfaces with a common binding edge, in the form of a sequential page set can be accomplished using the single leaf construction, either by cascading the pages one on top of the other with the hinged strip folded back to have the adhesive edge face down, allowing each adhesive strip to mount on the top surface of the next host surface. Alternatively, the cascading can be by insertion of the folded axes one into the next like a cocoon.

If the adhesive is placed along the pivotal hinged binding on the surface opposing the writing surface, then the notes can be cascaded with the adhesive binding strip in a planar extended position, and the hinged axes will line up to allow turning of multiple notes, while at the same time enabling the attachment of the set of notes along the adhesive strip.

The single leaf, semi-permanently attachable page can be formed by attaching a strip of tape to form the binding edge. The tape can have adjacent strips or sections of adhesive running in parallel, one for permanently attaching to the primary surface to form the semi-permanently attachable page itself, and the other for forming the secondary attachment. The page might otherwise have an adhesive edge to which a section of a strip of non-adhesive coated (or adhesive coated) tape is attached, the overlapping section of the tape adhering to the page adhesive, and the non-overlapping section of tape having adhesive for secondary attachments. Alternatively, the edge of this page so formed, may be multi-punched for subsequent attachment to another, heterogenous binding.

Other types of page surfaces may be employed when constructing a page from a surface with a tape binding edge. In one case a plastic surface which may be clear or partially clear and partially opaque, or any other form of smooth surface might be employed.

It would be possible to take a strip of adhesive tape and divide it into two parallel sections, one for overlapping multiple pages to form a page array bound along a common edge, with the other section of tape for a secondary attachment. These leafs may be paper or some other material. If they are formed as a clear thin plastic (i.e. 0.005") for receiving repositional notes, then this form factor can be called "overlapping windows", in which the clear plastic acts as "glass" to allow the viewing of multiple layers of notes. Preferably, the non-overlapping section of tape would have repositional adhesive and the edge would be multi-punched for subsequent binding to another binding structure. The tape edge for binding the surfaces into a multi-leaf set could be attached in cascade from the top or in cascade from the bottom, leaving a free edge of tape in which the adhesive can be on either the top or bottom surface. Thus, multi-leaf versions may be formed by using a tape strip comprised of two adhesives side by side in which the leafs are offset, one from the next along a common edge, and mounted on the first,and preferably permanent adhesive, thereby allowing each to be pivotally turned with respect to the other. The tape strip with the second and preferably removable adhesive would be free to be attached to a host or forded over into a deactivated posture.

This tape can be formed as a strip with or without holes punched therein. In one variation a tape with prepunched holes has two layers of adhesive, one repositional placed on the outer edge, and one of a standard form, place on an opposing inner edge and separated by a strip of width greater than or equal to the adhesive strip formed on the outer edge is constructed. The prepunched holes are formed in the strips of repositional adhesive and the adjoining non-adhesive section. In this way, the tape may be applied to any page and the prepunched holes and repositional adhesive attached for subsequent bindings.

Also the tape may be a peelable multi-strip construction with opposing peelable edges, adjoining adjacent opposing adhesive strips of a first color, and opposing and adjacent strips of a second color, possibly separated by a cut, pre-folded, or printed fold hint. The adhesive would be on the other side and would be preferable repositional. The hole pattern would be cut in parallel and opposing sections in the two inner strips. A mylar or tyvec or the like strip can be formed with two adhesives, one a repositional adhesive on a short strip, and the other a permanent adhesive on a long strip. The adhesive on the strips would likely be put on by a machine at construction time and might be applied at different times. The Long strip might be attached to adhesive on a host sheet of paper and might not have the adhesive directly on it at any time. Similarly, a short and narrow repositional strip can be coupled to a non adhesive holed strip which is coupled to a strip with a permanent (or tacky/repositonal) adhesive.

The tape strips can be made as mini-hinges in various forms of narrow or wide sections of various lengths. Short lengths would be pivotally attached to a host page typically along the center at the binding edge. One can pre-mark the hinge in the various ways detailed. Two colors can be used to enable the consumer to place the strip along a page edge such that the hinge is free to move and the permanent adhesive is marked to attach to the page side, leaving the colored repositional adhesive free for deactivation or attachment to a host. Short strips would be less than the page height and when applied to their page would leave four corners free.

The smart book mark tab tape strips can be delivered as a set on a mounting sheet.

In another packaging variation for the tape, any one of the tapes can be delivered in a rolled form.

BRIEF DESCRIPTION OF THE DRAWINGS

The above and other objects and advantages of the invention will be apparent from consideration of the following detailed description, taken to conjunction with the accompanying drawings, in which like reference characters refer to like parts throughout and in which:

FIGS. 2*d,e*, and *f* show the side view which highlights the coated sections. The larger coated sections would be an ideal mounting section for repositional notes. The coating on the binding strip serves to strengthen that section in its pivotal attachment and removal.

FIG. 2*k* shows a leaf with a narrow adhesive margin, where the adhesive may be applied on either side and which folds over, and deactivates without interfering with the hole pattern of the leaf.

Figures 3, 3A:
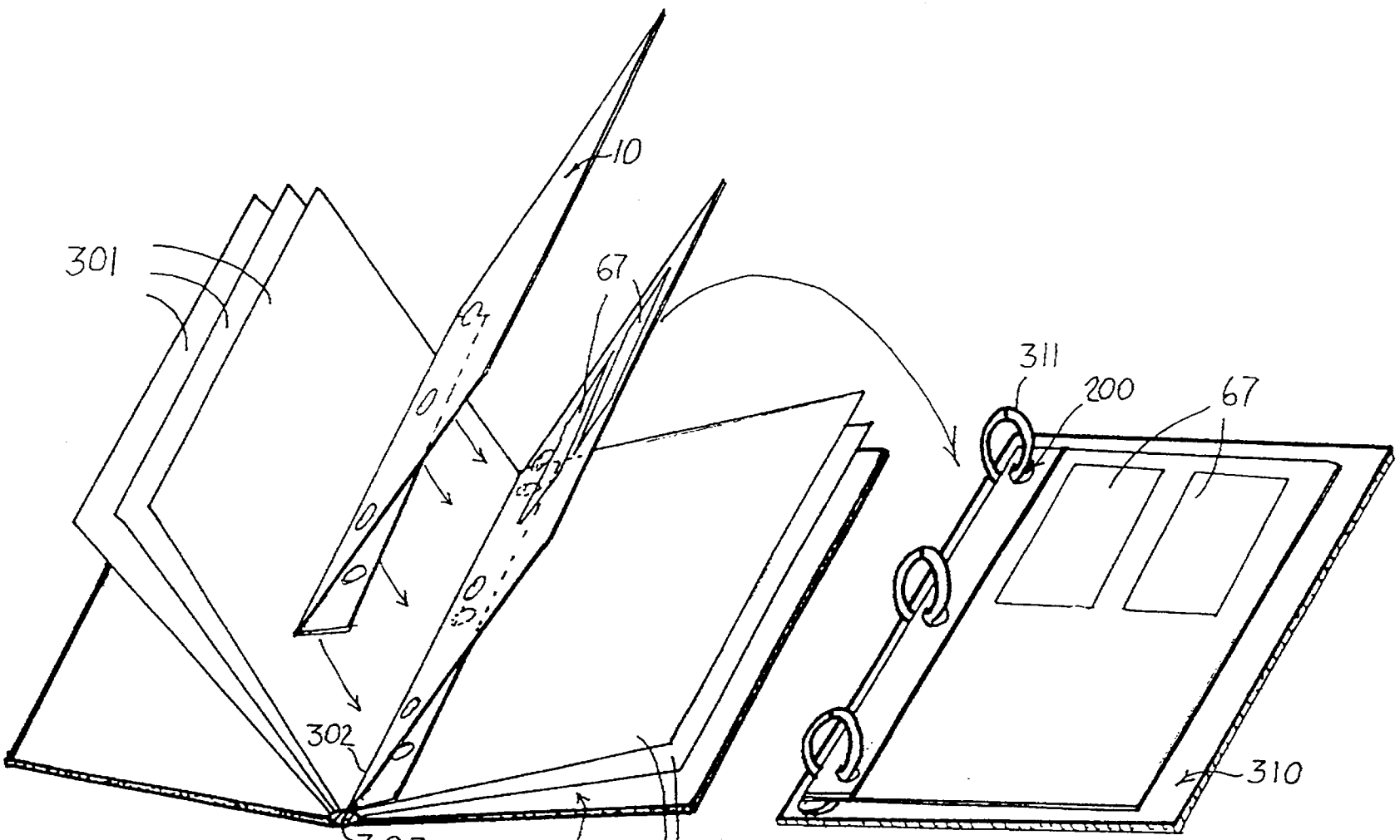
FIG. 3 shows a perspective view of a host book 300 with pages 301 having a typical surface 10 according to the invention being placed into the host book at it's binding 302 by applying strip 101 to said book binding between two pages.

FIG. 3*a* shows the repositional page 10 of FIG. 3 now placed in a heterogenous, ring structured binding 311, through hole 200.

Figures 20, 20A, 20B, 20C, 20D:
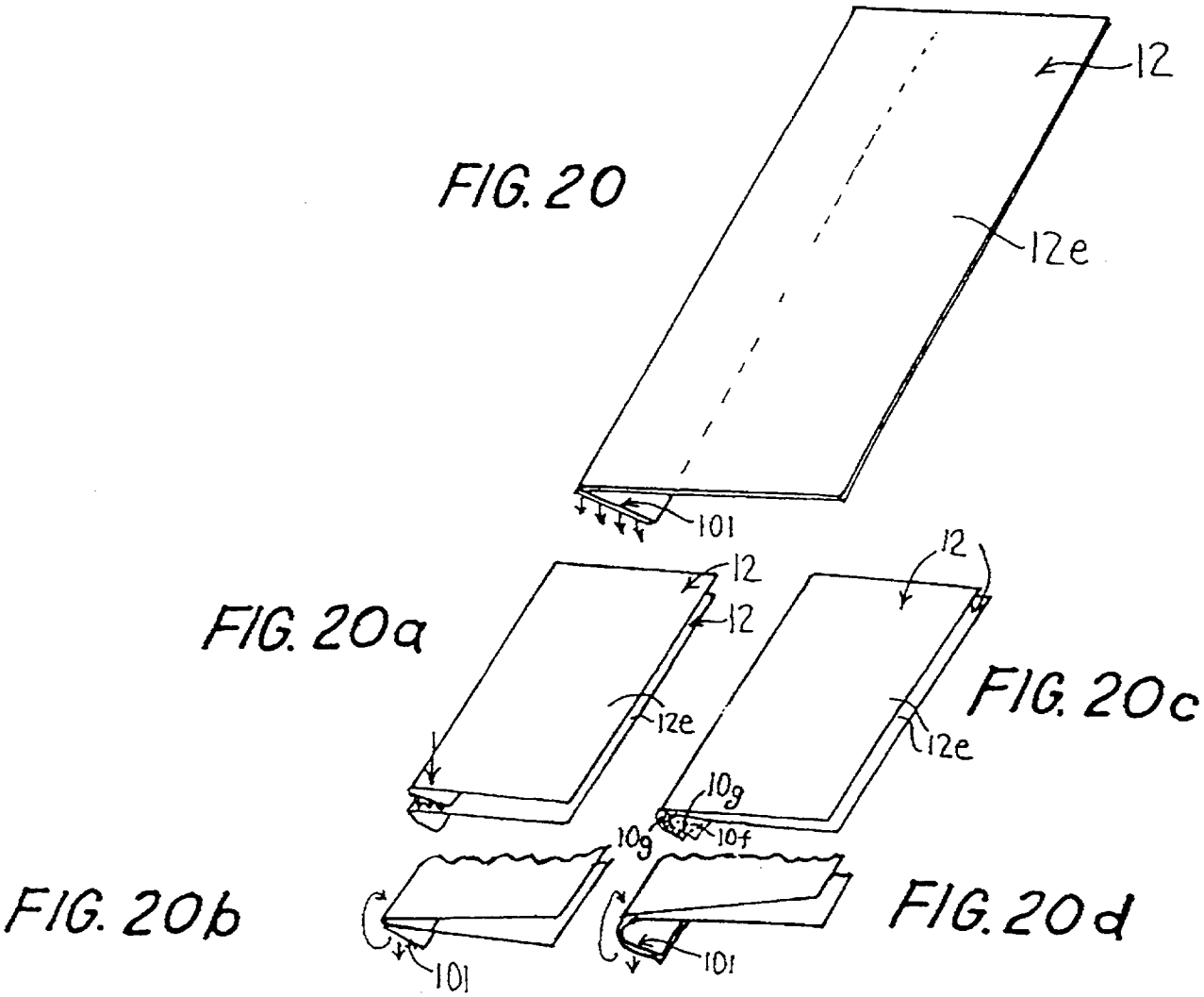

FIG. 3*a*' shows a "pad grouping" as would be constructed by putting a stack of repositionable leaves 10, mini-book folded as shown in FIG. 20*b* stacked on a base leaf 301 as shown in FIG. 3, here shown in stand alone pad form.

Figure 3B:
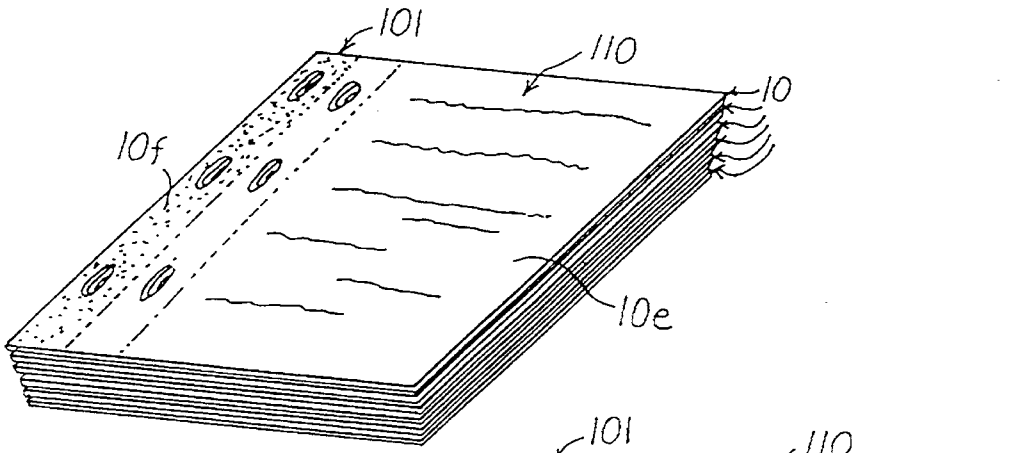
Figure 3B:
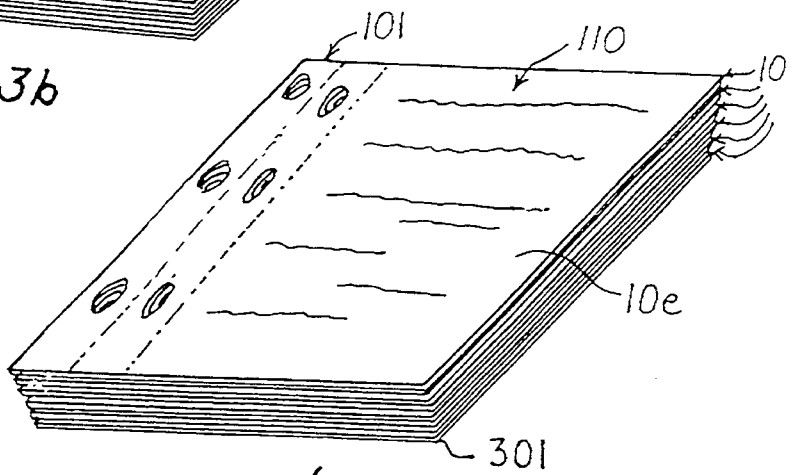
Figure 3A:
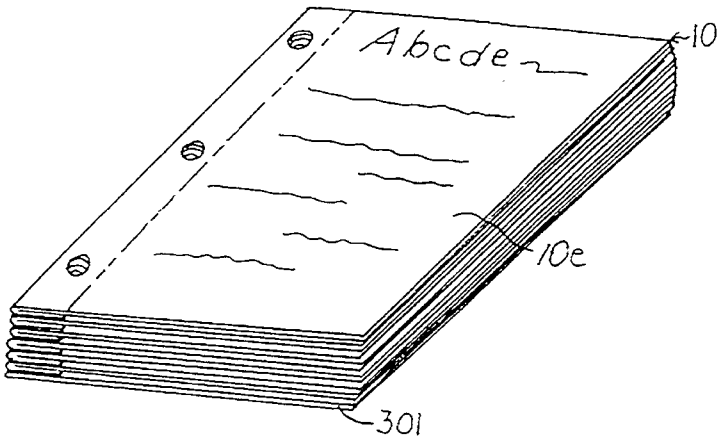

FIG. 3*b* shows a way to distribute these windowing note pages by forming a pad. Note the adhesive surface and the writing surface are both face up.

FIG. 3*b*' shows a way to distribute these windowing note pages by forming a pad. Note the adhesive surface is face down and a base leaf is employed like leaf 301 is used in a book, to deactivate the adhesive of the bottom note.

Figure 3D:
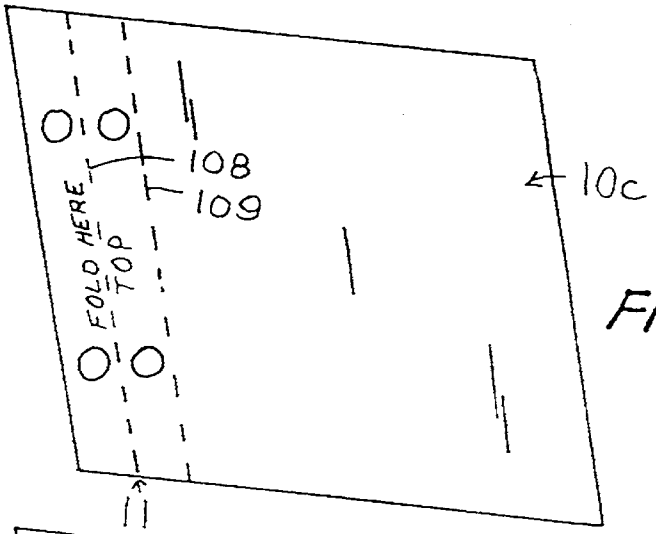
Figure 3E:
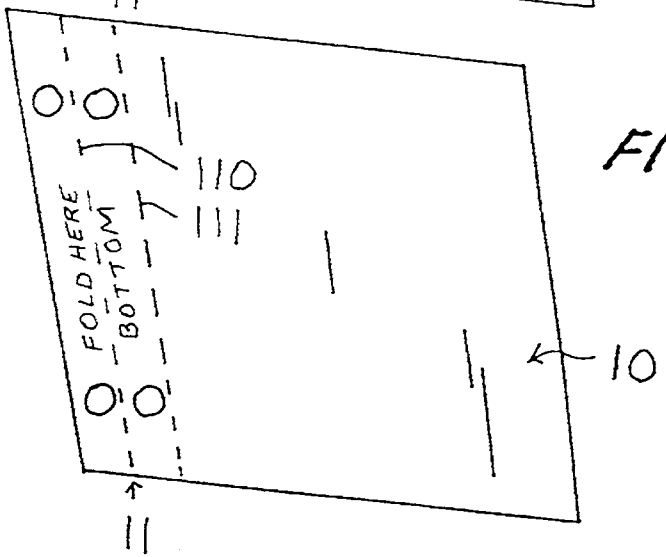
Figure 3C:
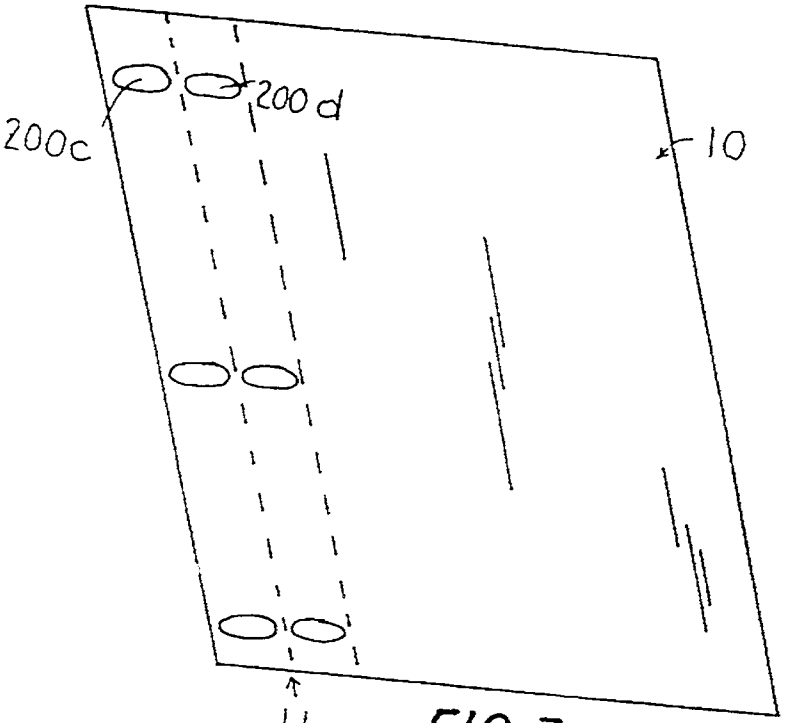

FIG. 3*c* shows a leaf where the dual hole pattern is comprised of oval holes which are horizontally disposed and which serve the purpose of preserving a substantial hole when overlapped in a multilayered minibook. FIGS. 3*d* and 3*e* show a leaf top and bottom surface where the print pattern is represented on bot sides to assist in the folding operation and in denoting the margins.

Figures 3F, 3G, 3H, 3I, 3J:
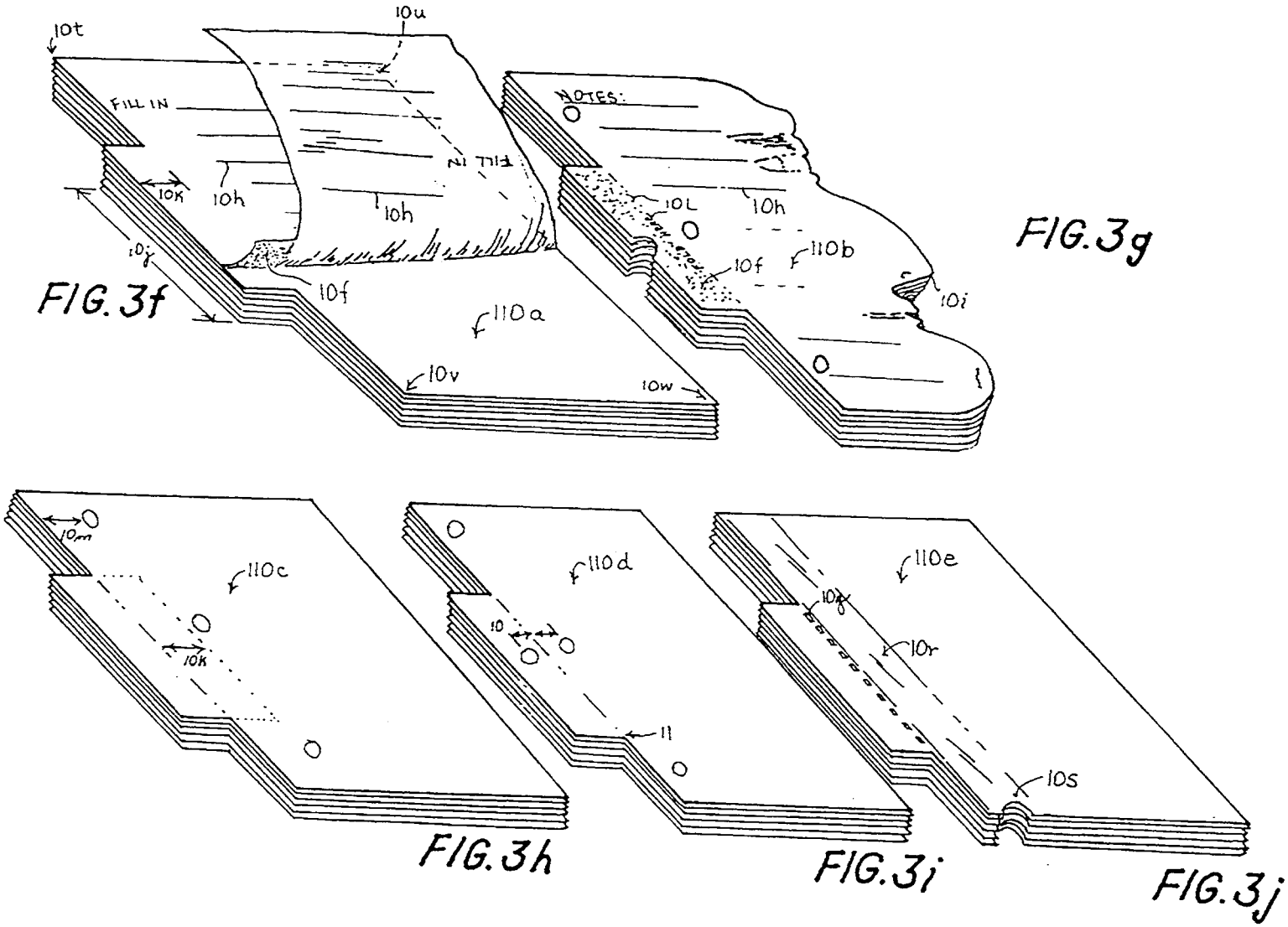

FIG. 3*f* shows a leaf stack with a short adhesive strip where the leaf is preprinted as a form on both sides. The adhesive is on the opposing side to the top or front writing surface. FIG. 3*g* shows a diecut leaf to form a pattern of a face where the adhesive strip is banded with the adhesive on the top surface, adjacent to the top writing surface. FIG. 3*h* shows a leaf with a short and narrow adhesive strip that is centrally disposed near the center hole of the leaf and noninterfering with the central leaf hole. FIG. 3*i* shows a similar leaf to FIG. 3*h* where the adhesive band is wider and possesses an overlapping hole to mirror the center hole of the host leaf. FIG. 3*j* shows a similar leaf to FIG. 3*f* where the adhesive band is on a strip separated by a simple perforation (as previously shown in FIG. 10).

Figure 3Q:
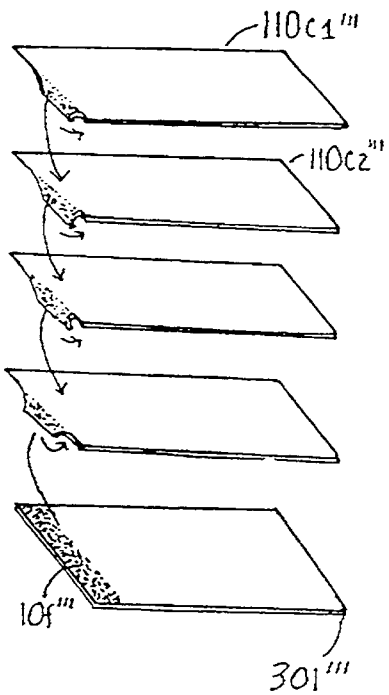
Figure 3M:
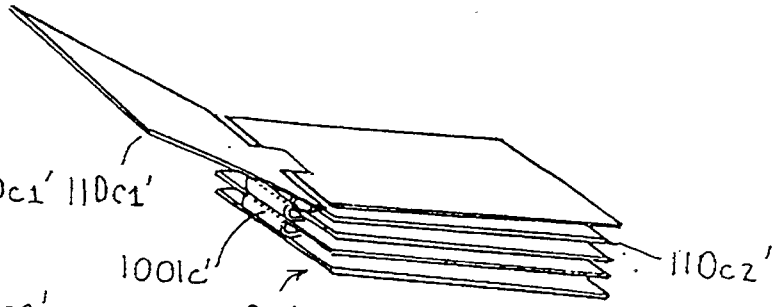
Figure 3N:
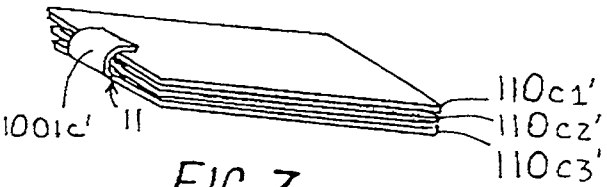
Figure 3O:
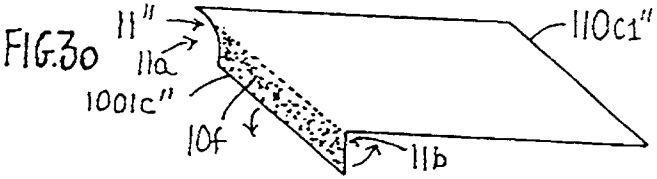
Figure 3P:
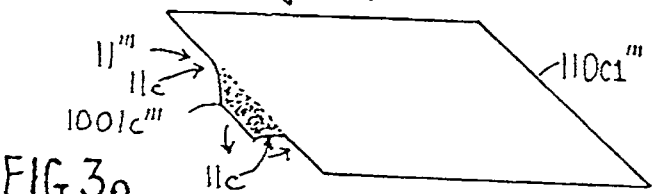
Figure 3K:
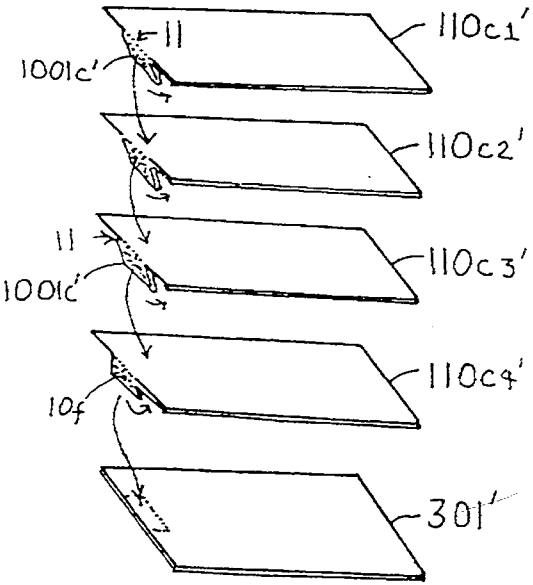

FIG. 3*k* shows how a repositional leaf with a prefolded short tab strip can be cascaded or stacked one atop the other to form a mini-book or mini-book pad stack. The leafs are separated in perspective view.

Figure 3L:
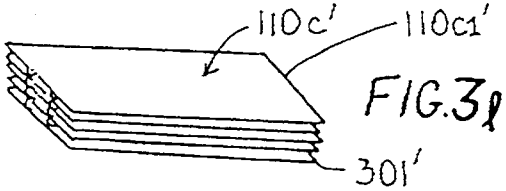

FIG. 3*l* shows a perspective view of the leafs of FIG. 3*k*, where the leafs are stacked in the form of a mini-book.

FIG. 3*m* shows a perspective of FIG. 3*l* where the top leaf is open and it's tab is shown as the hinged means for attaching the top leaf to the next leaf on the stack.

FIG. 3*n* shows a group of 3 leaves from the stack of FIG. 3*m* where the tab of the bottom leaf is folded up and over to deactivate and form a stand alone mini-booklet.

FIG. 3*o* shows a preferred embodiment of a leaf with a curved radius short tab where the curved radius is at only one end of the short tab. Three leaf corners are free. The squared bottom tab corner lends to increased stability of the pad for certain applications. the tab is shown folded for attachment to a host surface or to another leaf in a pad or mini-booklet/mini-book.

FIG. 3*p* shows a preferred embodiment of a leaf with two curved radius short tab ends, where each of all four corners of each leaf are free.

FIG. 3*q* shows the leaf of FIG. 3*p* assembled into a pad form in exploded perspective where the base leaf has a band of adhesive for receiving the last leaf of the pad.

Figures 1, 1A, 1B, 2, 2A, 2B, 2C:
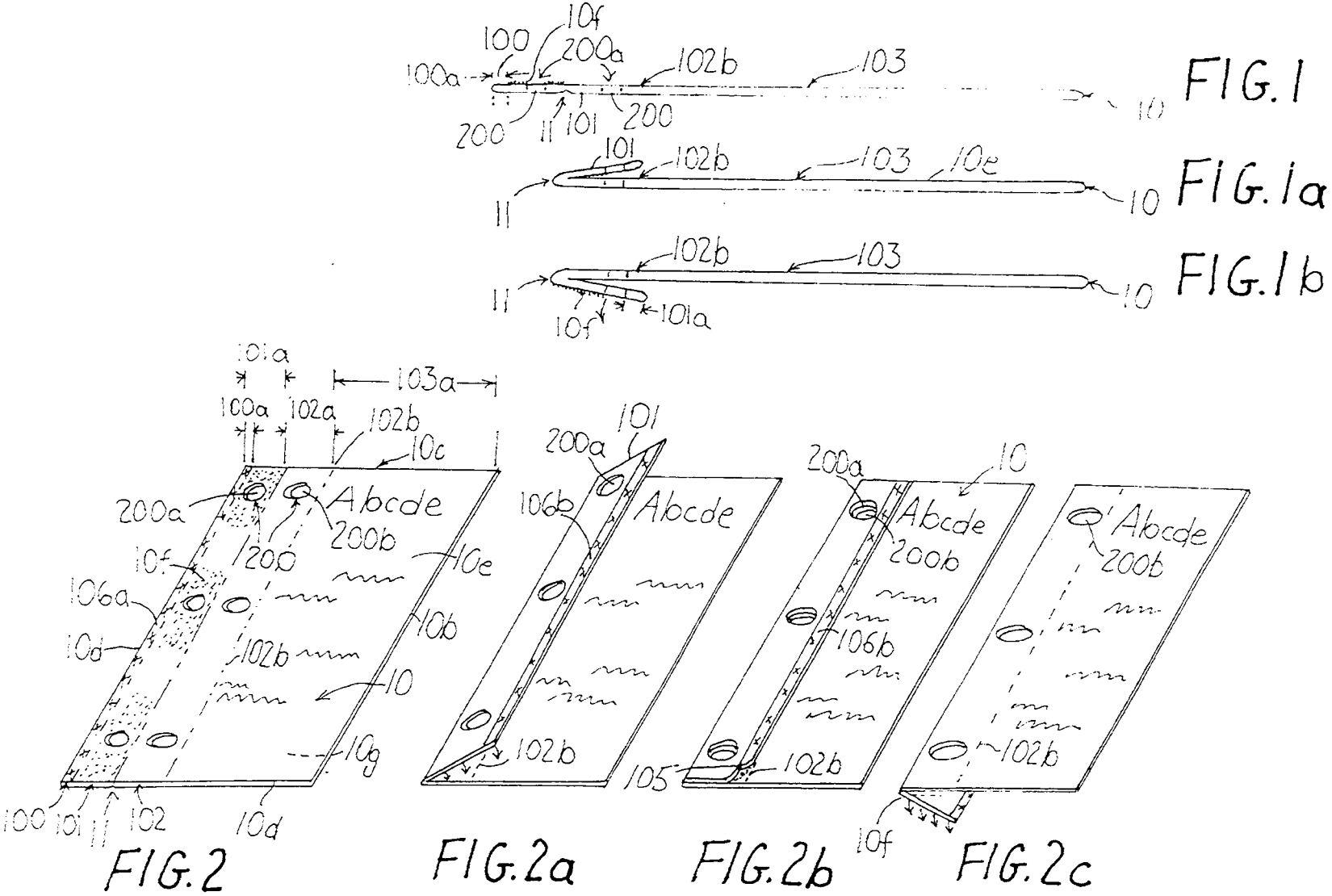
FIG. 1 shows an edge view of single sheet repositional page with a binding strip and a lifting strip.
FIG. 1*a* shows an edge view of the same sheet of FIG. 1 with the binding strip folded along pivotal axis into a position above the surface.
FIG. 1*b* shows an edge view of the same sheet of FIG. 1 with the binding strip 101 folded along pivotal axis 11 into a position below the surface 10*g*.
FIG. 2 shows a perspective view of the sheet 10 of FIG. 1. Printed edge 106*a* is visible, showing top window face 10*e* and bottom window face 10*g*.
FIG. 2*a* shows a perspective view of the sheet 10 of FIG. 1*a*.
FIG. 2*b* shows the perspective view of FIG. 2*a* with the binding strip 101 adhesively attached to surface 10*e*, and therefore deactivated. Lifting edge 105 is shown raised and the printed edge 106*b* is now visible. The holes 200*a* and 200*b* from the parallel strips are matched.
FIG. 2*c* shows a perspective view of FIG. 1*b* further showing how repositional adhesive strip 10*f* may be attached to a second surface.
Figures 4, 4A, 4B, 5, 5A, 5B, 5C:
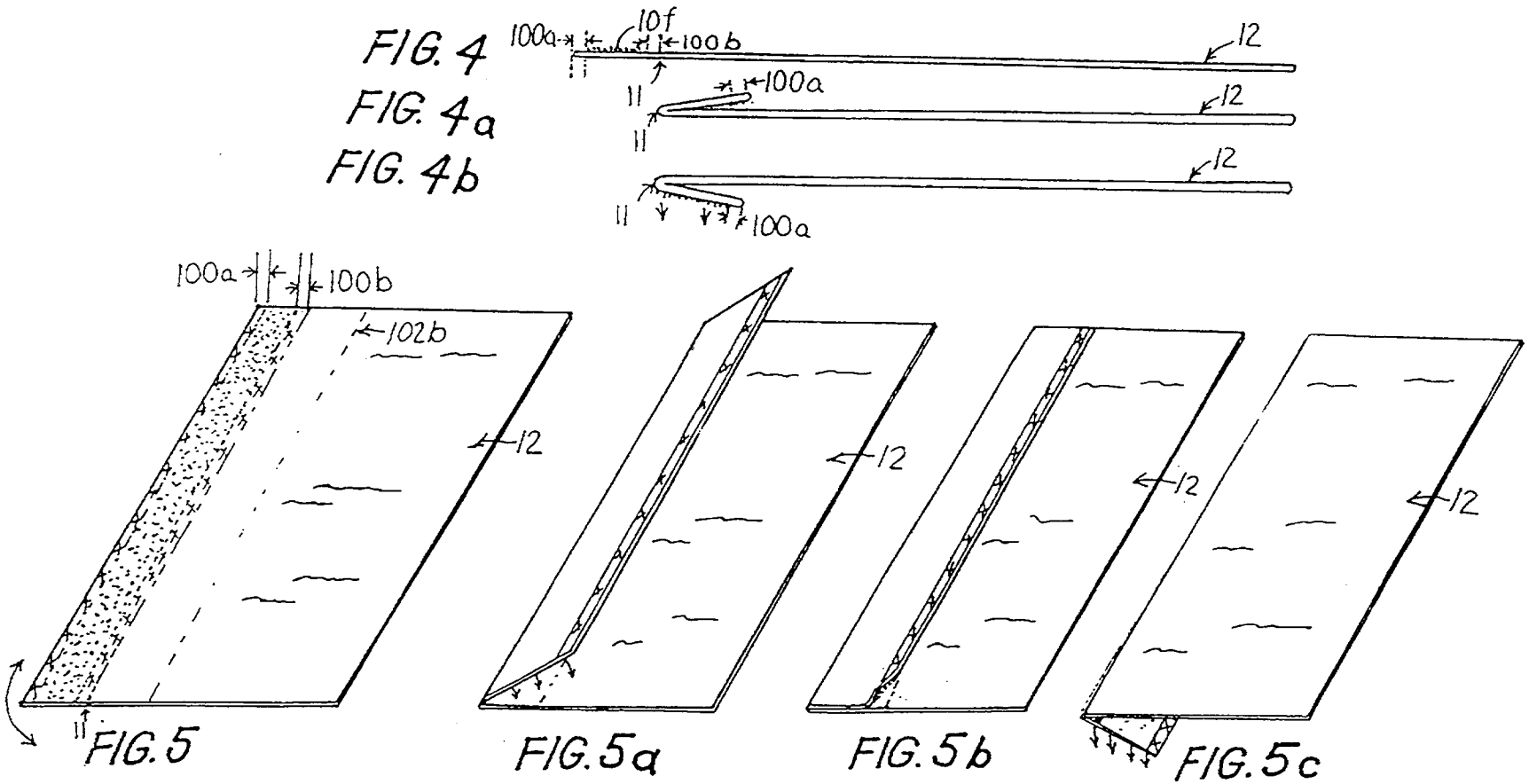

FIG. 4 shows a repositional page 12 with similar to that of FIG. 1 without any holes.

FIG. 4*a* is like FIG. 1*a* without holes.

FIG. 4*b* is like FIG. 1*b* without holes.

FIG. 5 is like FIG. 2 without holes.

FIG. 5*a* is like FIG. 2*a* without holes.

FIG. 5*b* is like FIG. 2*b* without holes.

FIG. 5*c* is like FIG. 2*c* without holes.

Figures 6, 6A, 6B, 7, 7A, 7B:
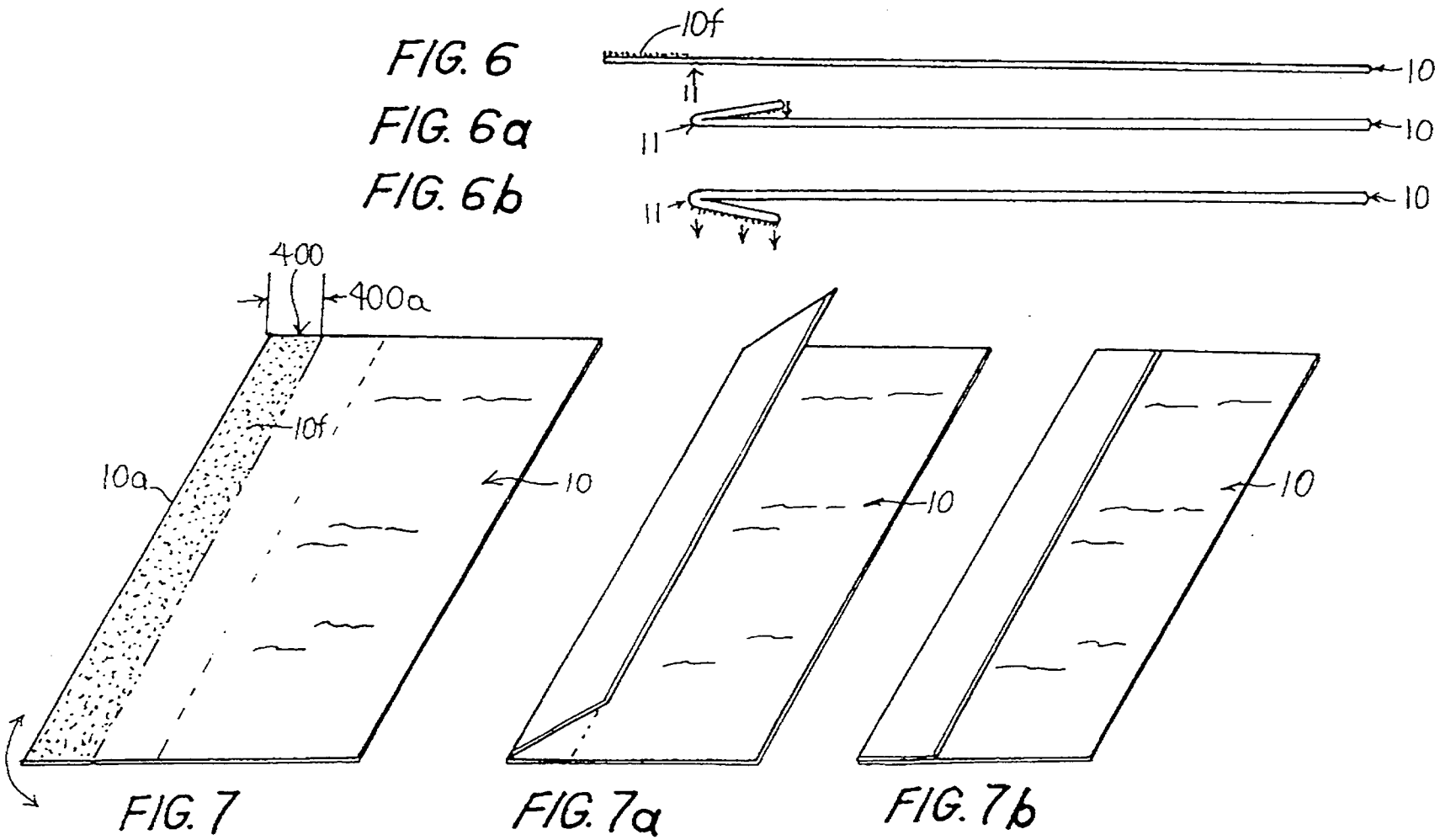

FIG. 6 is like FIG. 1 except the adhesive strip 10*f* covers the entire hinged strip 400.

FIG. 6*a* is like FIG. 1*a* except for the adhesive strip 10*f* which covers the full hinged binding section 401 and the absence of holes.

FIG. 6*b* is like FIG. 1*b* except for the adhesive strip 10*f* which covers the full hinged binding section 401 and the absence of holes.

FIG. 7 is like FIG. 2 except for the adhesive strip 10*f* which covers the full hinged binding section 401 and the absence of holes.

FIG. 7*a* is like FIG. 2*a* except for the adhesive strip 10*f* which covers the full hinged binding section 401 and the absence of holes.

FIG. 7*b* is like FIG. 2*b* except for the adhesive strip 10*f* which covers the full hinged binding section 401 and the absence of holes.

Figures 8, 8A, 8B:
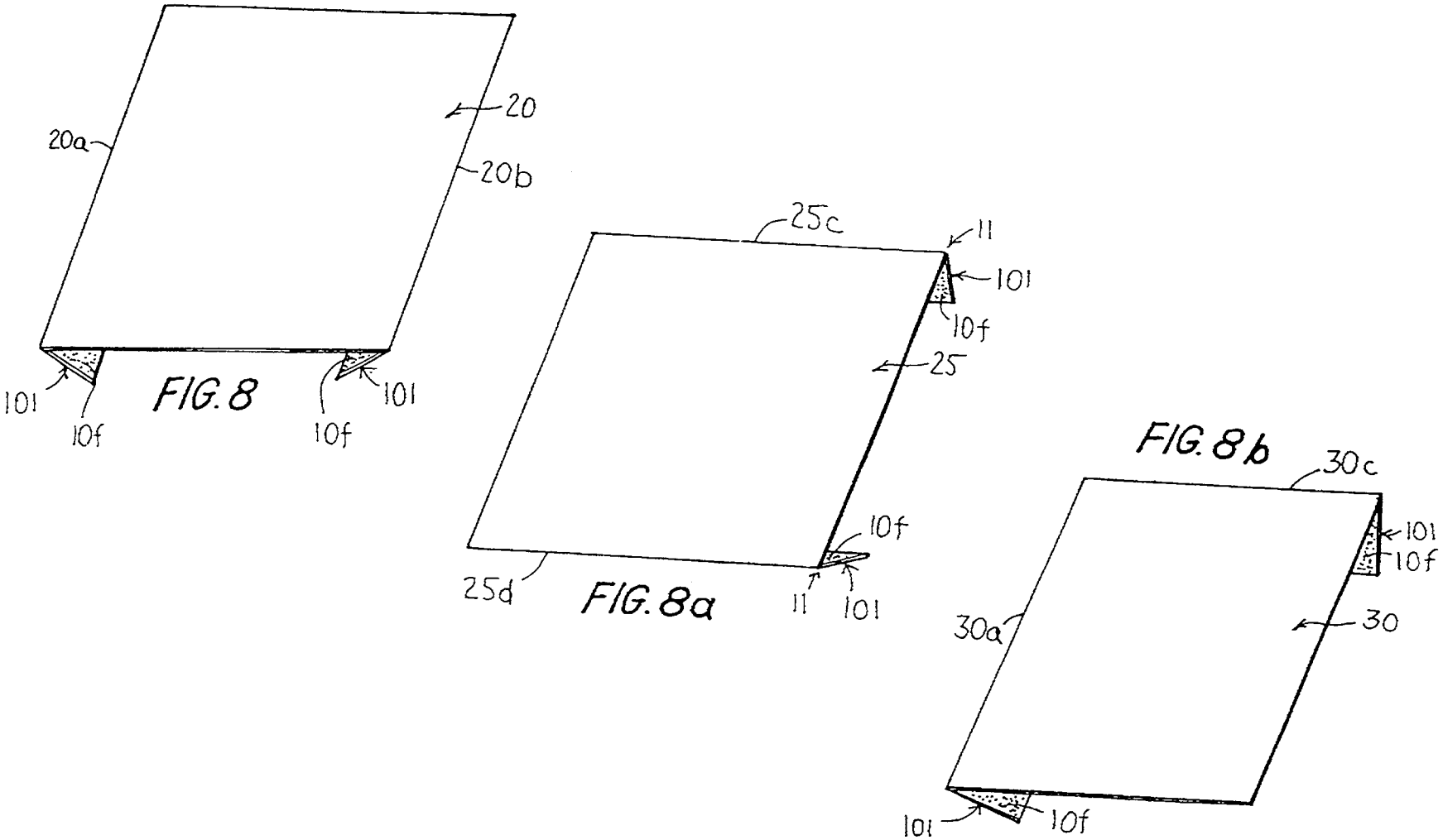

FIG. 8 shows a perspective view of a sheet 20 with hinged binding strips 101 on opposing edges 20*a* and 20*b*.

FIG. 8*a* shows a perspective view of a sheet 25 with hinged binding strips 101 on the opposite set of opposing edges 25*c* and 25*d* from FIG. 8.

FIG. 8*b* shows a perspective view of a sheet 30 with hinged binding strips 101 on orthogonal edges 30*a* and 30*c*.

Figures 9, 9A, 9B, 10, 10A, 10B, 10C:
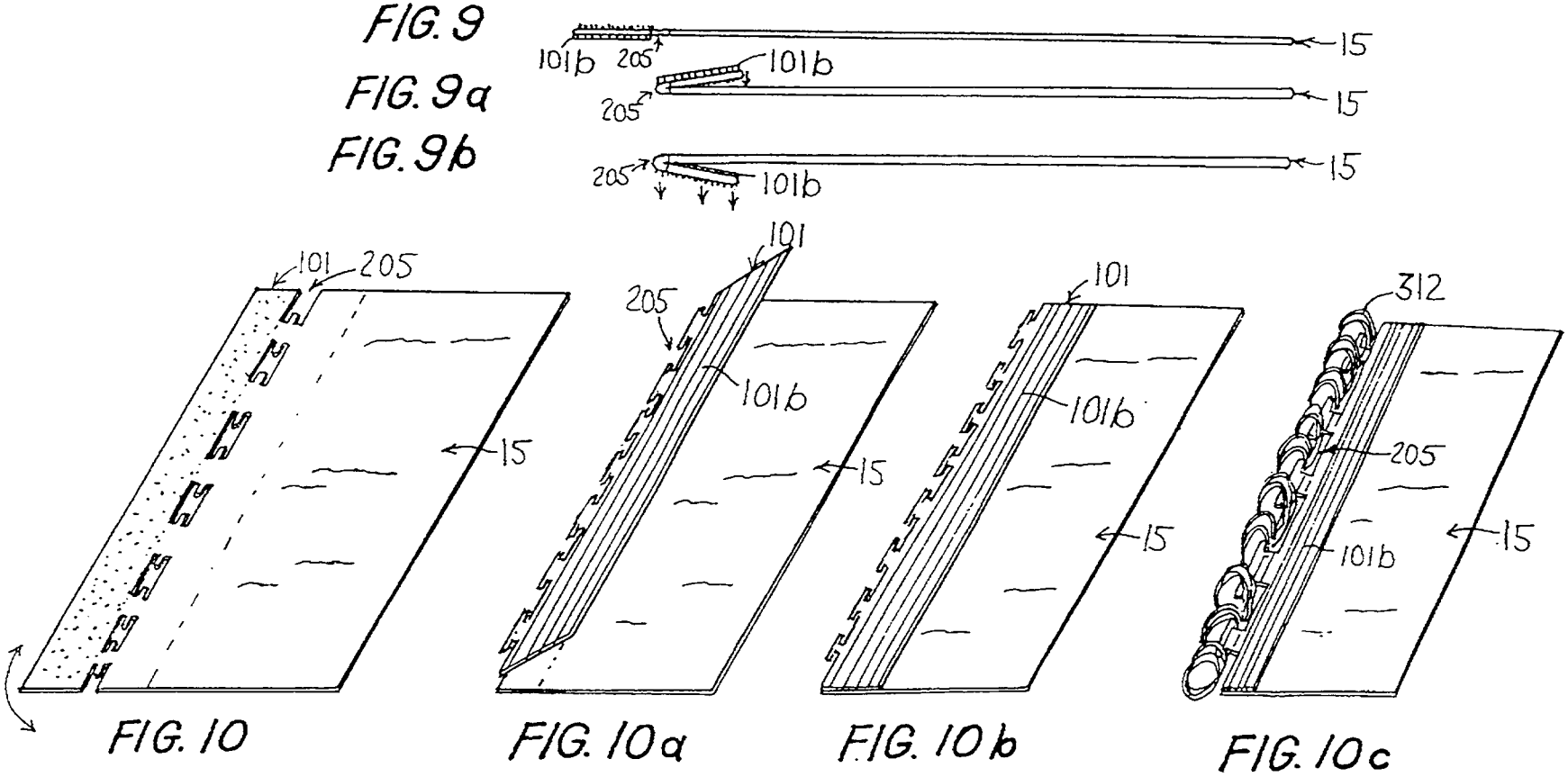

FIG. 9 is like FIG. 1 except the hole pattern 205 is a cut slot for attachment to a wire binding.

FIG. 9*a* is like FIG. 1*a* except the hole pattern 205 is a cut slot for attachment to a wire binding.

FIG. 9*b* is like FIG. 1*b* except the hole pattern 205 is a cut slot for attachment to a wire binding.

FIG. 10 is like FIG. 2 except the hole pattern 205 is a cut slot for attachment to a wire binding.

FIG. 10*a* is like FIG. 2*a* except the hole pattern 205 is a cut slot for attachment to a wire binding.

FIG. 10*b* is like FIG. 2*b* except the hole pattern 205 is a cut slot for attachment to a wire binding.

FIG. 10*c* is like FIG. 2*c* except the hole pattern 205 is a cut slot for attachment to a wire binding.

Figure 11:
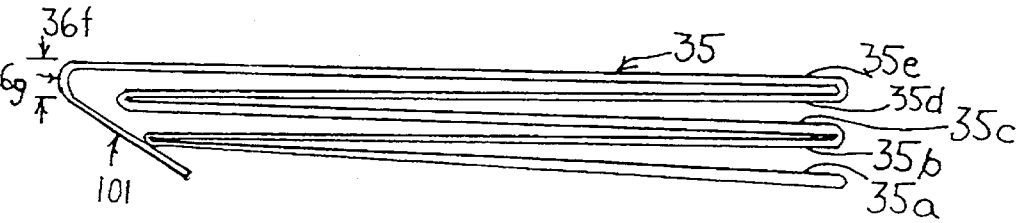

FIG. 11 shows a side view of a multi-folded leaf 35 in which the leaf sections are folded one below the next and nest into a hinge extension section.

Figure 11A:
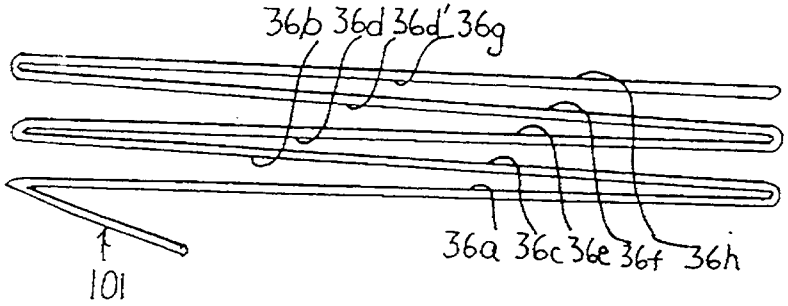

FIG. 11*a* shows a side view of a multi-folded leaf in which the leaf sections are folded one on top of the next.

Figure 11B:
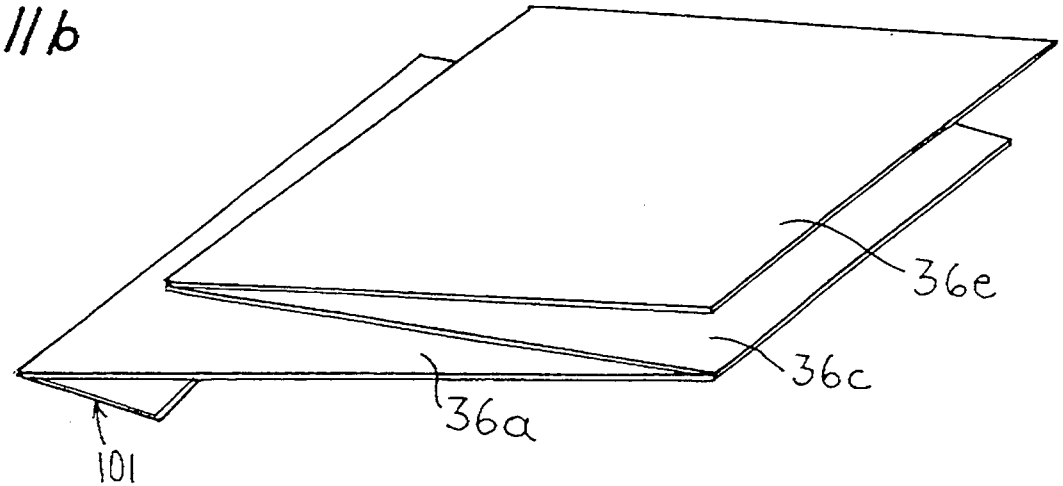

FIG. 11*b* shows a perspective of FIG. 11*a* for an example of a multi-folded leaf with 2 folded sections.

Figures 11C, 11D, 11E, 11F:
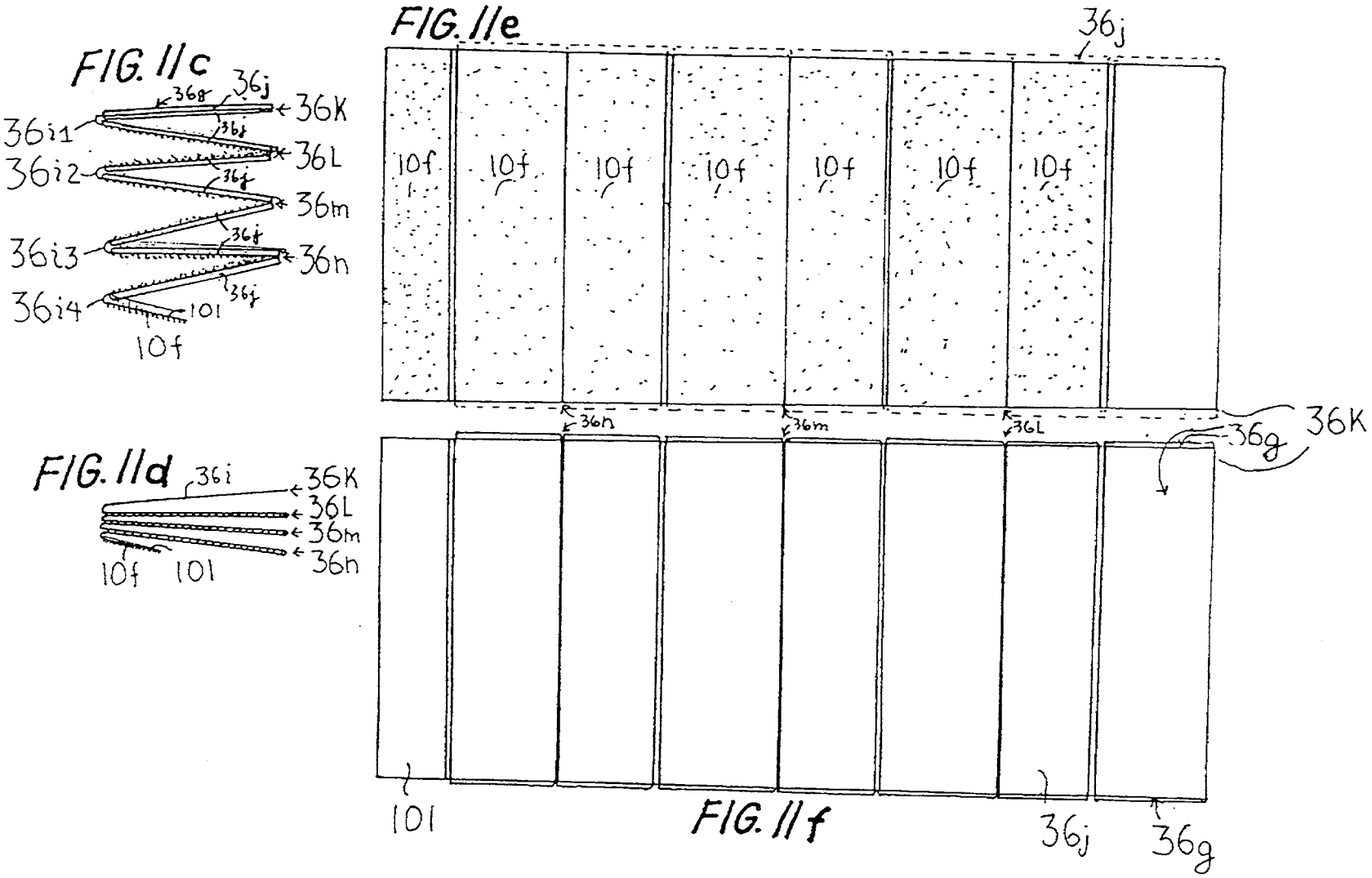

FIG. 11*c* shows a side view of a multi-folded leaf as a narrow width smart book mark where the leaf is formed as a construction of a series of surfaces alternately coated with adhesive and laminate. The adhesive sections bond to form the leafs which leave the laminated sections exposed. These serve as mounting surfaces. FIG. 11*d* shows the side view of the attached topology of the folded material. FIG. 11*e* Shows the adhesive pattern in extended format with the panels horizontally disposed. FIG. 11*f* shows the other side with the laminated panels in extended format with the panels horizontally disposed.

Figures 12, 12A, 12B:
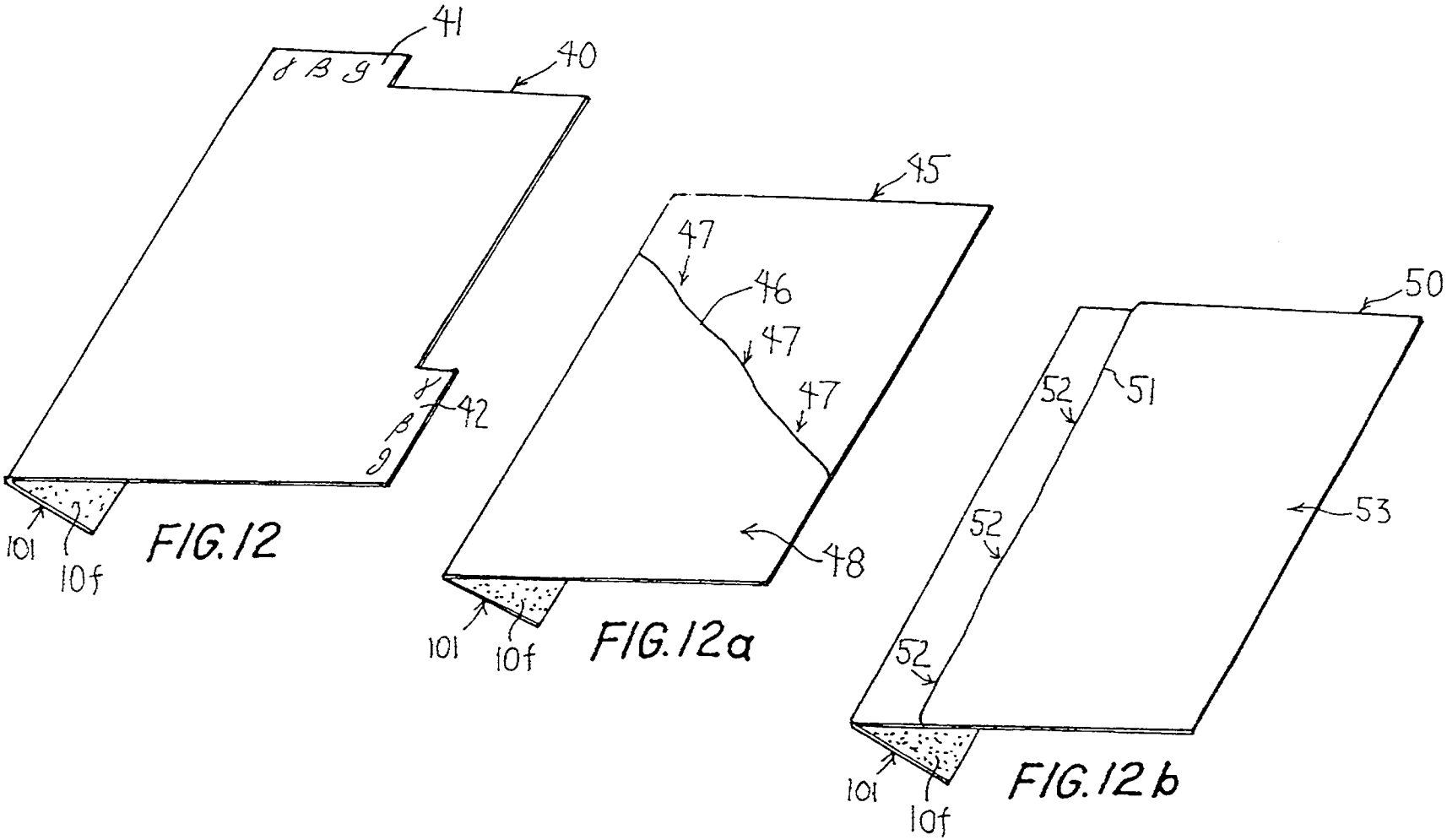

FIG. 12 shows a leaf construction in which the leaf is formed as an index.

FIG. 12*a* shows a leaf construction in which the leaf is formed as a diagonal pocket.

FIG. 12*b* shows a leaf construction in which the leaf is formed as a vertical pocket.

Figure 13A:
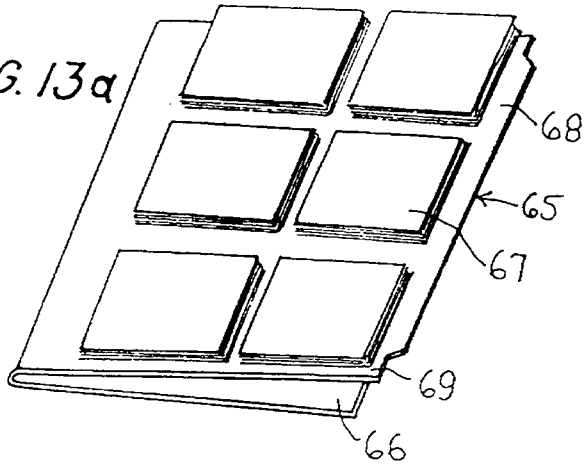
Figure 13:
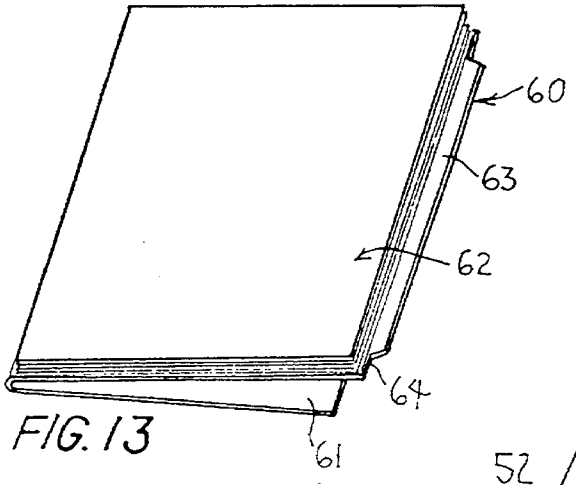

FIG. 13 shows a two cover insertable card with a note pad mounted on one of the two covers, the other cover serving as an insertion tongue or alternatively as a cover.

FIG. 13*a* shows a two cover insertable card with an array of repositional notes mounted on one of the two covers, the other cover serving as an insertion tongue or alternatively as a cover.

Figure 14:
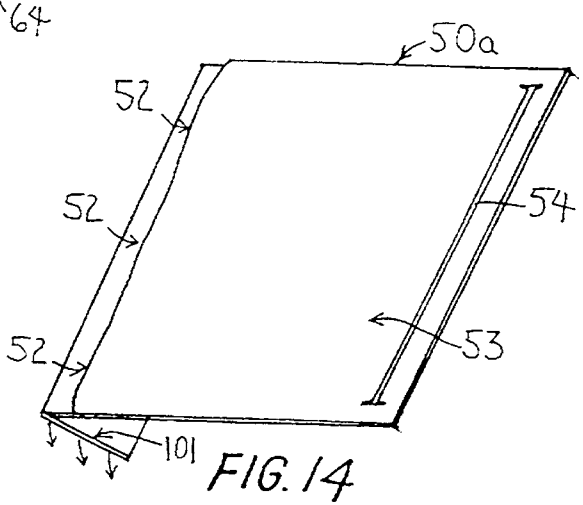

FIG. 14 shows a host hinged page constructed as a "pocketed" an insertion card like either of those shown in FIG. 13 or FIG. 13*a*.

Figure 15:
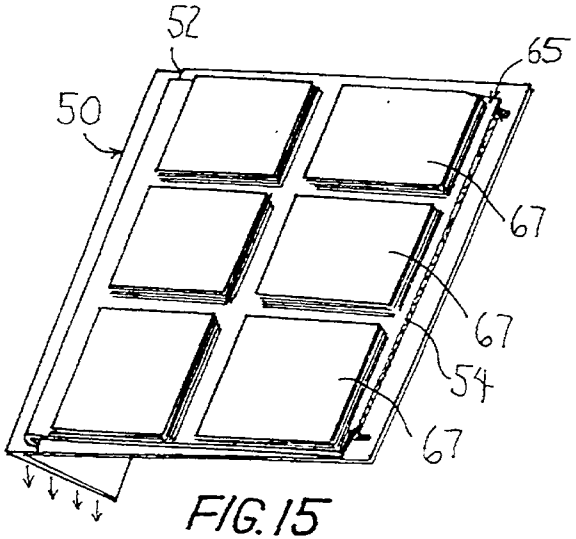

FIG. 15 shows the insertion card of FIG. 13*a* inserted in the pocket of FIG. 14.

FIG. 15*a* shows a perspective view of a pocketed leaf of a form which can be configured with certain accessories. The pocket is formed as a "half pocket" covering one-half the leaf width. There is a laminated cover which binds the ends of the pocket to seal them.

FIG. 15*b* Shows a side view of the leaf of FIG. 15*a* and which shows the open part of the pocket.

FIG. 15*c* shows a perspective view of a pocketed leaf where the pocket is formed by a full overlapping section of material and the one-half pocket section is formed as a slit in the larger section. There is a ridge edge formed at the edge of the leaf coterminous with the adhesive strip.

FIG. 15*d* shows a side view of leaf 15*c* where it is shown that the full panel is partially sealed by a binding which is shown here as an adhesive. FIG. 15*e*1 shows a perspective view of the accessories mounted on the leaf of FIG. 15*d* which accessories are shown as a set of stacks of repositional notes and a leaf array with a plurality of leafs and a tongue inserted in the slit pocket.

FIG. 15*e*2 shows a top view of 15*e*1 where all aspects of the object are represented including the notes, the leaf array, the safety block ridge, and the repositional hinged binding. A note is outlined where it might be placed on the leaf array.

Figure 16:
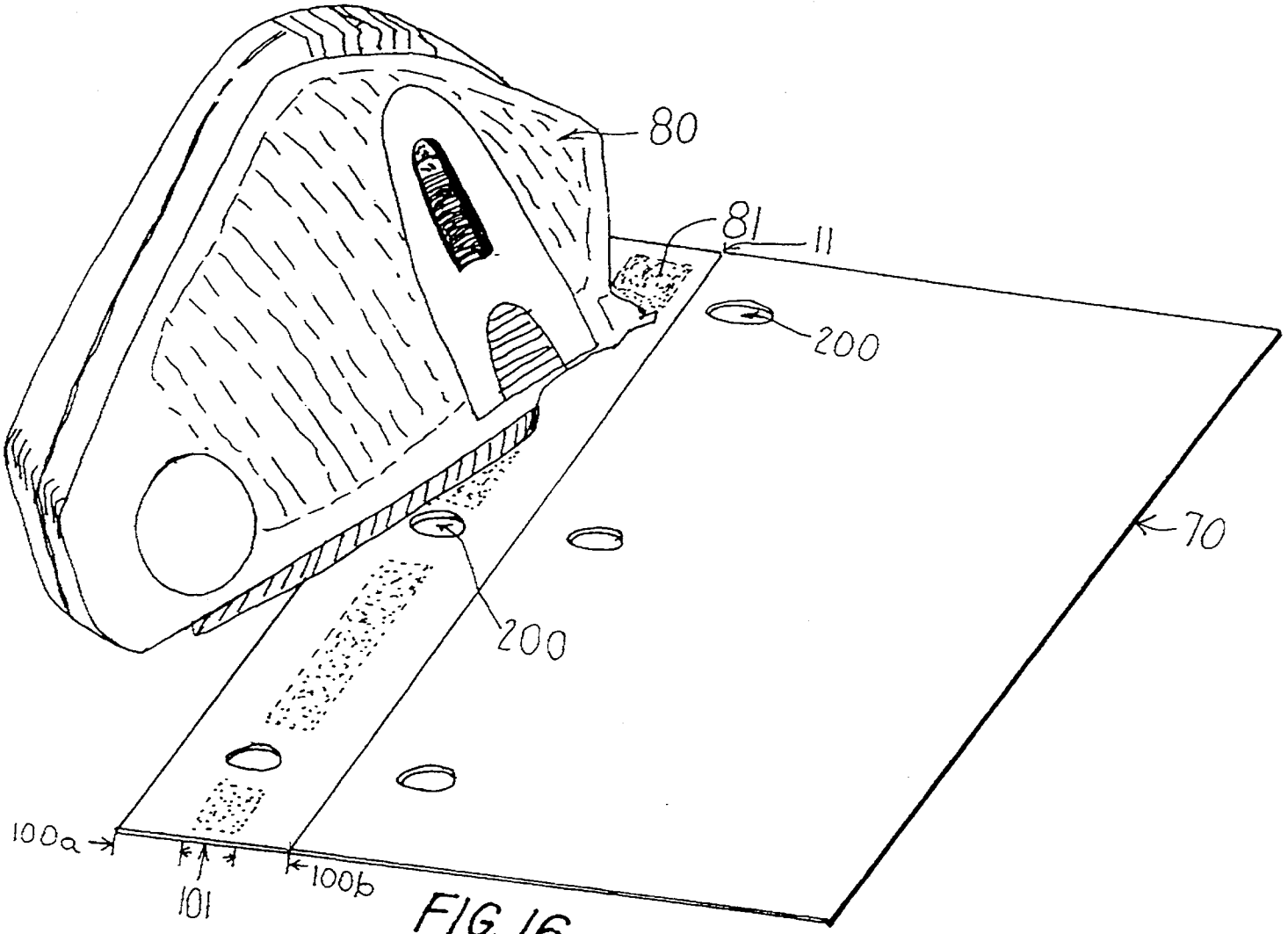

FIG. 16 shows a leaf with a hinged binding edge in which the adhesive, in this case, is being applied by a user using an adhesive dispenser.

Figures 17, 17A, 17B:
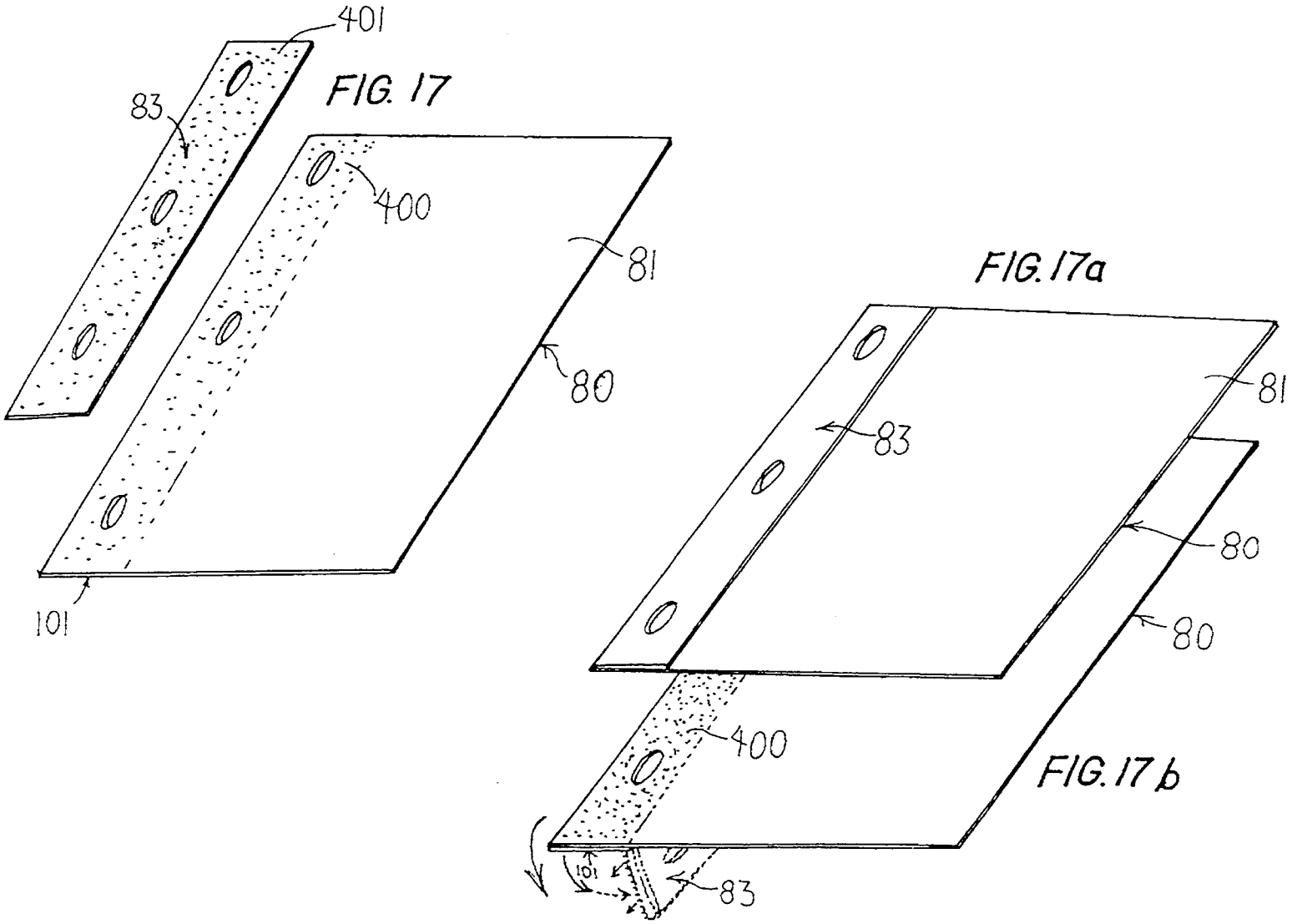

FIG. 17 shows a leaf with a hinged binding edge having an active adhesive strip and a separable section which can be placed over the active adhesive of the leaf thereby deactivating said active adhesive.

FIG. 17*a* shows the leaf with the with the adhesive deactivated by the strip FIG. 17*b* shows the hinged section being rotated with adhesive active and a deactivation strip, having it's own adhesive, attached on the opposite side of the hinge for use at a later time.

Figure 18:
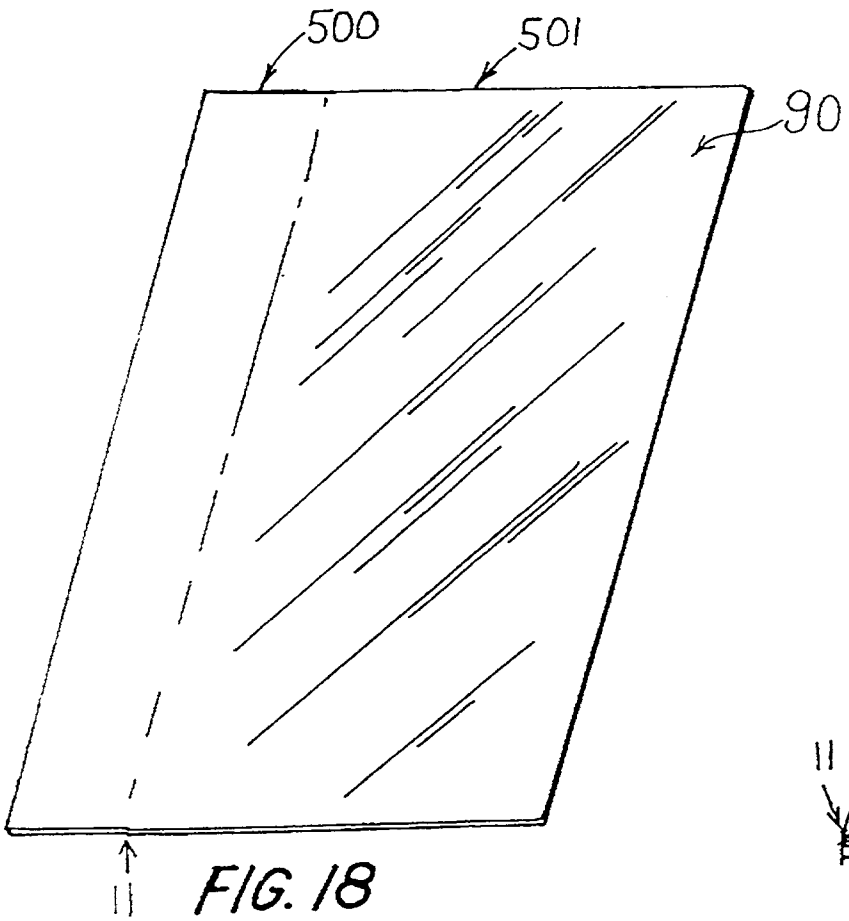

FIG. 18 shows a leaf formed from a clear binding edge and an opaque surface which may be used for either writing or for attaching other information, i.e. post-it notes, for example.

Figure 19:
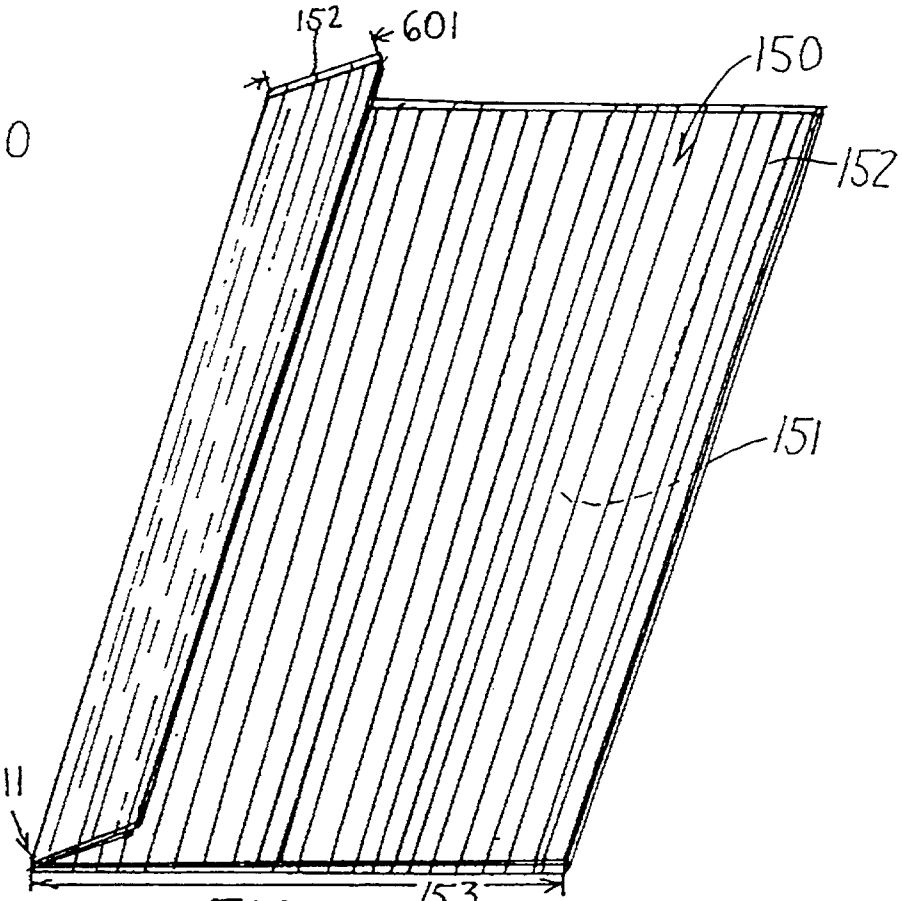

FIG. 19 shows a leaf formed from a sheet of material such as tyvec, in which the hinge section and leaf section have been separately laminated.

FIG. 20 shows a leaf with the hinged binding edge folded down and prepared for forming multiple leaf sets.

FIG. 20*a* shows two leafs about to be cascaded one atop the other

FIG. 20*b* shows the two leafs of FIG. 20*a* attached and cascaded together forming a multi-leaf set.

FIG. 20*c* shows two leafs about to be cascaded by nesting one hinged section within the other.

FIG. 20*d* shows the two leafs of FIG. 20*c* attached and cascaded together forming a mult-leaf set.

FIGS. 21*a,b*, and *c* show an edge view single leaf structure with the repositional adhesive on the opposing face to the writing or mounting surface, and the combination of two such leafs into a multi-leaf structure. FIGS. 21*d* and *e* show a planar view of the structure of FIG. 21*b* where the FIG. 21*e* further displays the use of the mounting surface for the posting of a set of repositional notes.

Figures 22, 22A, 22B, 22C, 22D, 22E, 22F:
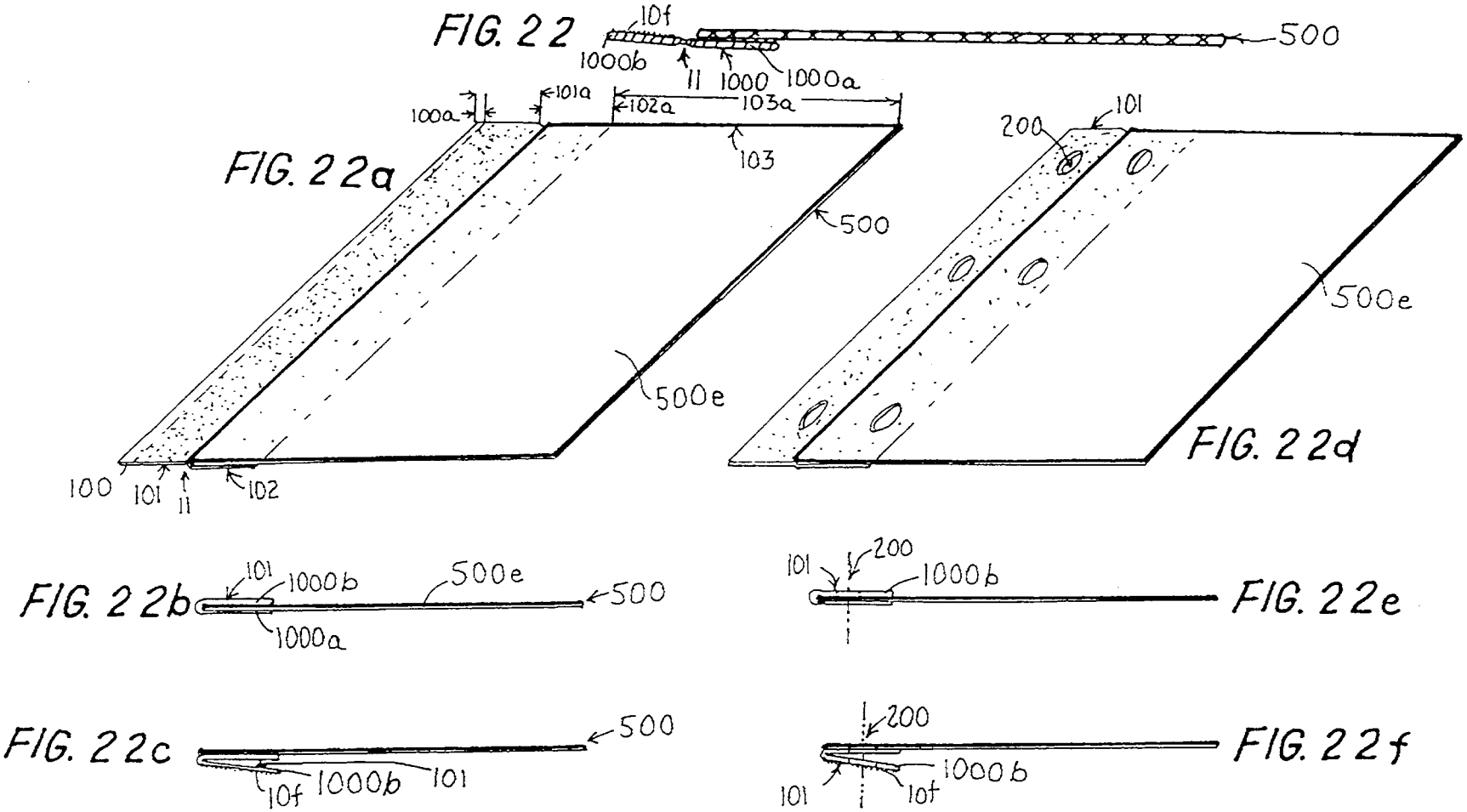

FIG. 22 shows an edge view of a leaf construction where the page is formed from a piece of tape section and a media section.

FIG. 22*a* shows a perspective view of FIG. 22.

FIG. 22*b* shows an edge view of the leaf of 22 with the tape section folded over the top with the tapes adhesive deactivated.

FIG. 22*c* shows an edge view of the leaf of 22 with the tape section folded over the bottom with the tapes adhesive activated.

FIG. 22*d* shows the same the same thing as FIG. 22*a* except for the addition of a set of parallel punched holes.

FIG. 22*e* shows an edge view of FIG. 22*d* with the tape section folded over and tape deactivated with the holes aligned, for subsequent insertion into a ring binder.

FIG. 22*f* is the same as FIG. 22*c*, except the figure shows the punched holes.

Figure 23:
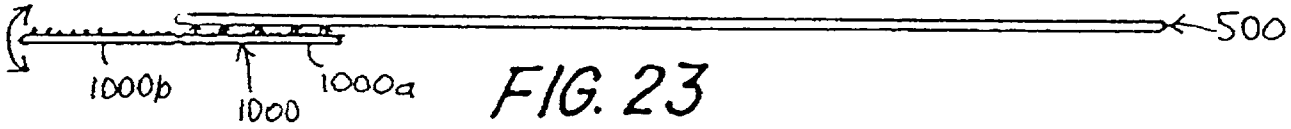
Figure 23A:
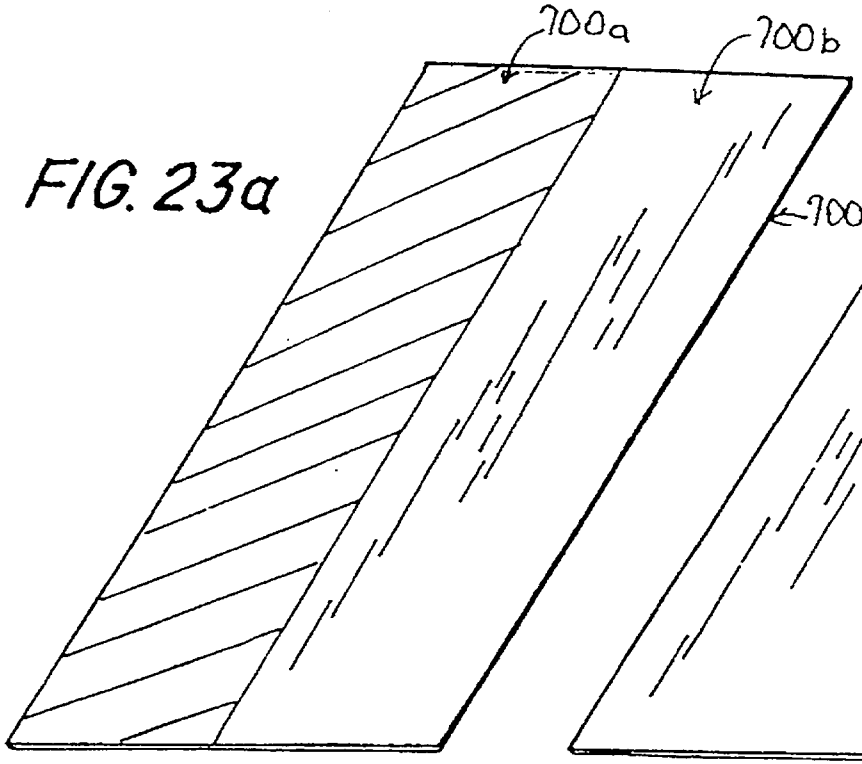

FIG. 23 is the same as FIG. 22 and shows an edge view where the leaf surface may be substituted by any one of the surfaces of FIGS. 23*a*, *b*, or *c*.

FIG. 23*a* shows an alternative surface as a section of plastic where one half is opaque and the other section clear.

Figure 23B:
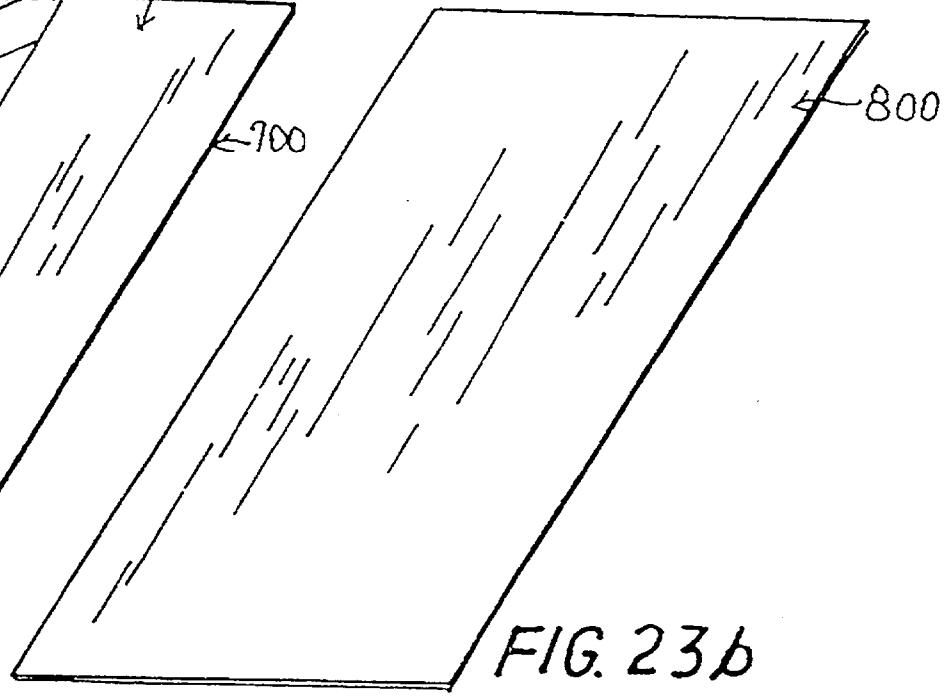

FIG. 23*b* shows an alternative surface as a section of plastic which may be clear or opaque.

Figures 24, 24A, 24B, 24C, 24D, 24E:
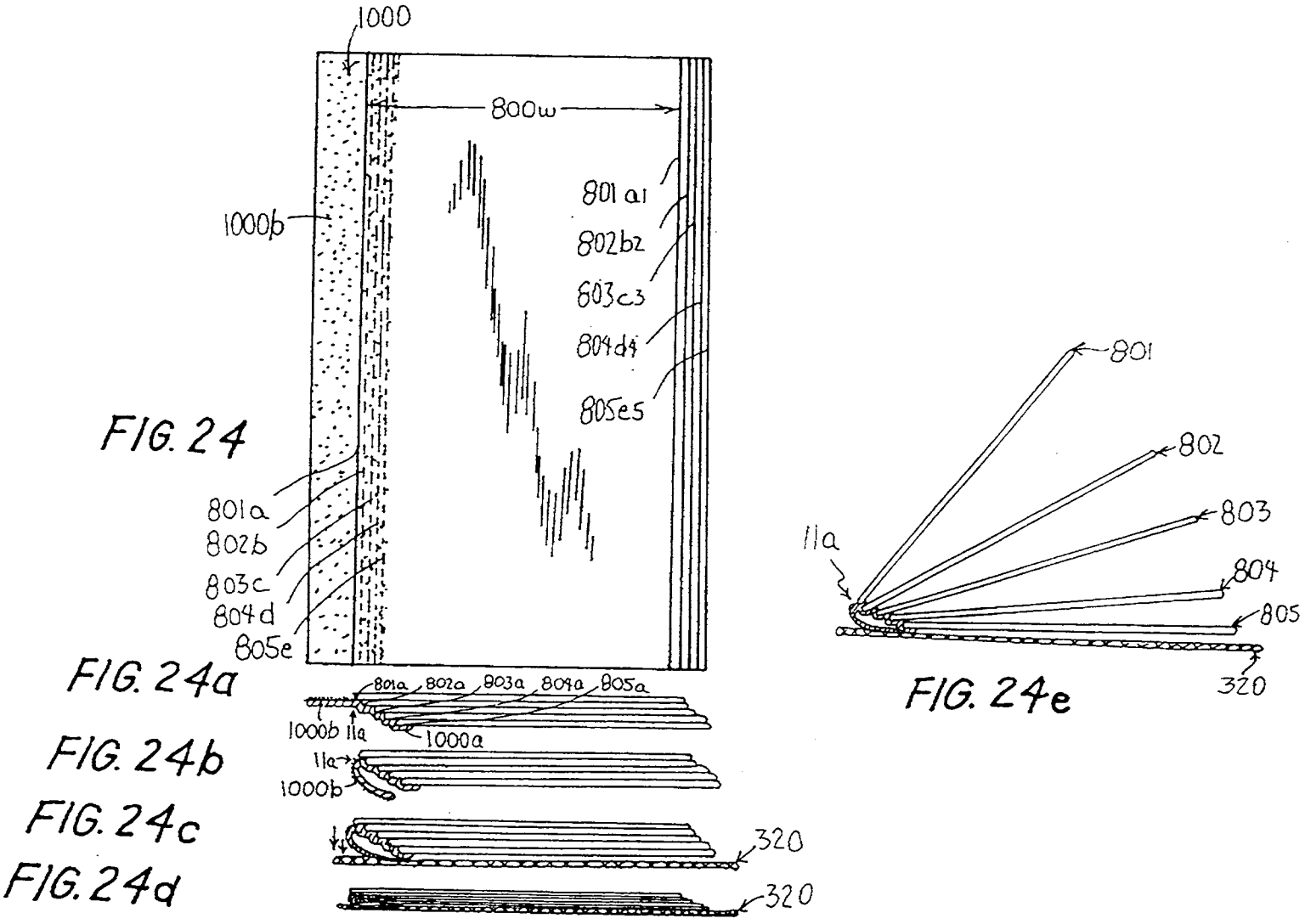

FIG. 24 shows a plane view of a multi-leaf set formed by the taping of a common set of offset edges of a set of leafs, leaving a section of tape exposed for deactivation or for attachment to a host.

FIG. 24*a* shows an edge view of FIG. 24 highlighting the manner in which the tape is subsequently bound to each end of each sheet.

FIG. 24*b* shows the edge view of FIG. 24*a* with the free tape section being bent under the leaf set for active attachment to a second host surface.

FIG. 24*c* shows the leaf set of FIG. 24*b* attached to a host sheet.

FIG. 24*d* shows a preferred configuration of FIG. 24*c* in which the leaf set is a very thin construction and lies in a flat manner on it's host surface.

FIG. 24*e* shows the leaf set of FIG. 24*d* with each leaf turned in a fan array showing the ability to turn each page 180 degrees.

Figures 25, 25A, 25B:
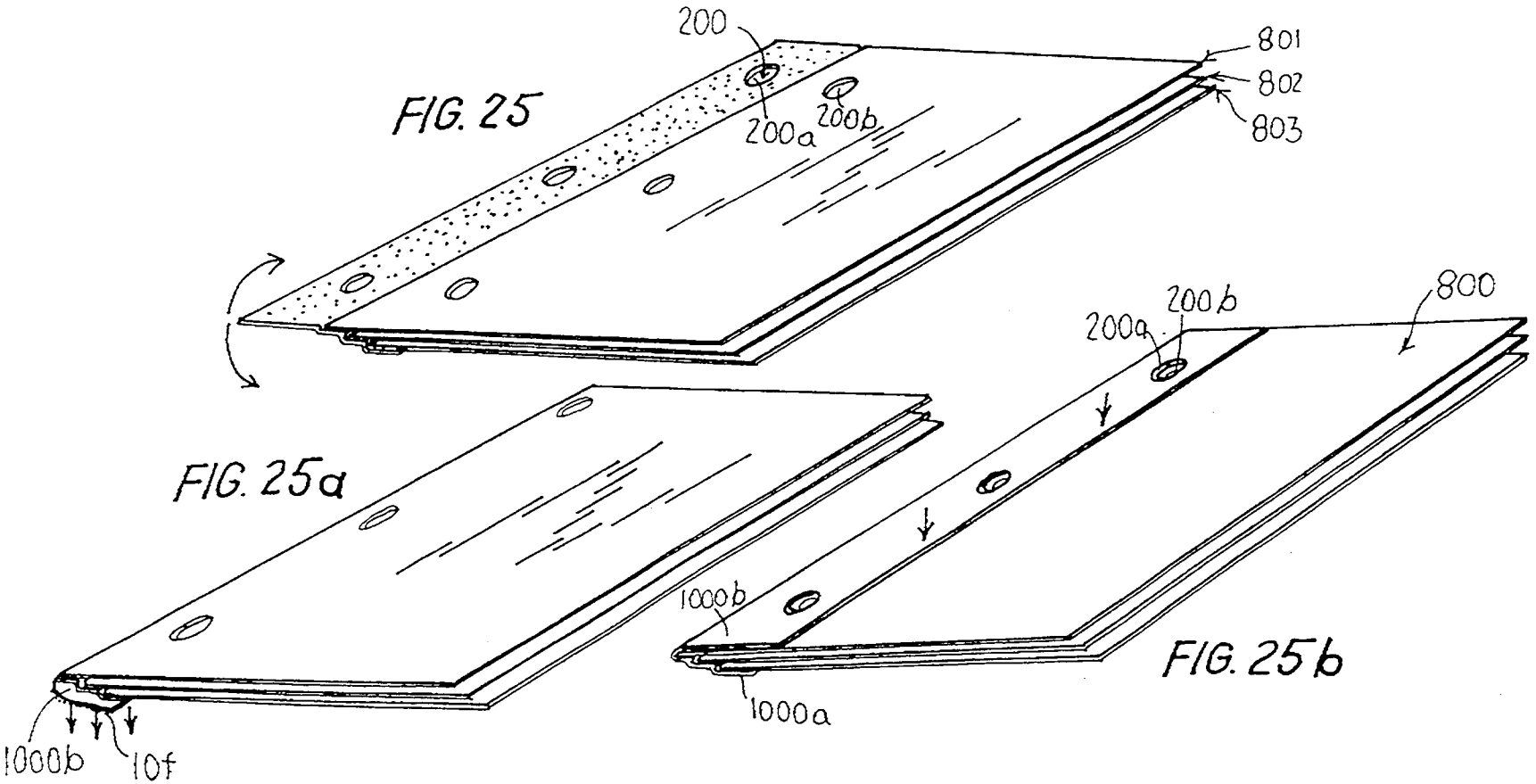

FIG. 25 shows a perspective view of a leaf set like the one from FIG. 24 with three leafs and parallel holes punched in the tape and the bound edge of the leafs.

FIG. 25*a* shows the perspective view of the leaf set of FIG. 25 with the free tape edge activated and ready for attachment to a second host surface.

FIG. 25*b* shows the perspective view of the leaf set of FIG. 25 with the free tape edge folded over and attached to the margin edge of the top leaf and thereby deactivated, with the hole sets aligned.

Figure 26:
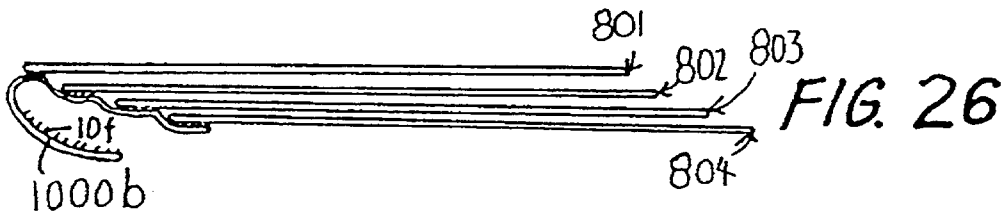

FIG. 26 shows a leaf set like FIG. 24*a* except for the adhesive on the free tape edge being applied on the opposing side of the free tape edge from that of FIG. 24*a*.

Figure 26A:
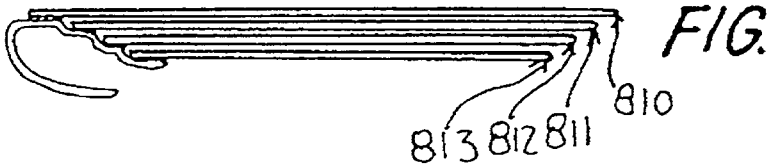

FIG. 26*a* shows a leaf set like FIG. 26 except the leafs are cut in progressively shorter lengths and stacked in decreasing size order, allowing for a finger touch edge lifting.

Figure 26B:
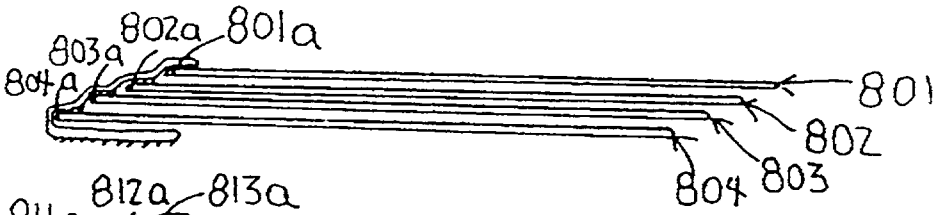

FIG. 26*b* shows a leaf set like FIG. 26 except for the tape binding being on the top of each successive edge, thereby pressing the opposing edge out as a leading edge with each edge following being recessed in by the extent of the tape binding on it's opposing edge.

Figure 26C:
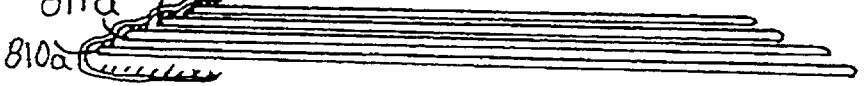

FIG. 26*c* shows a similar top edge binding mechanism for creating a leaf set where the sheets are cut and bound in progressively wider sections. The adhesive on the free edge deactivates by attachment from below.

Figure 26D:
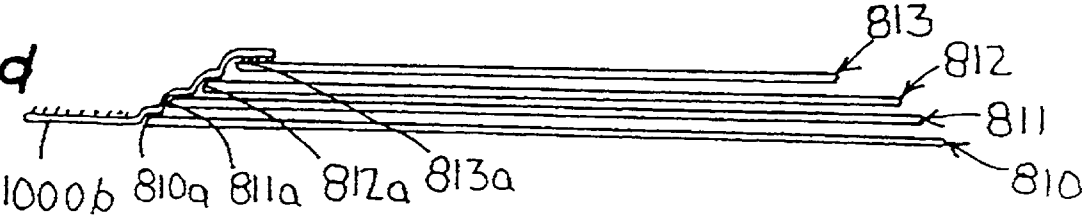
Figures 27, 27A, 27B, 27C:
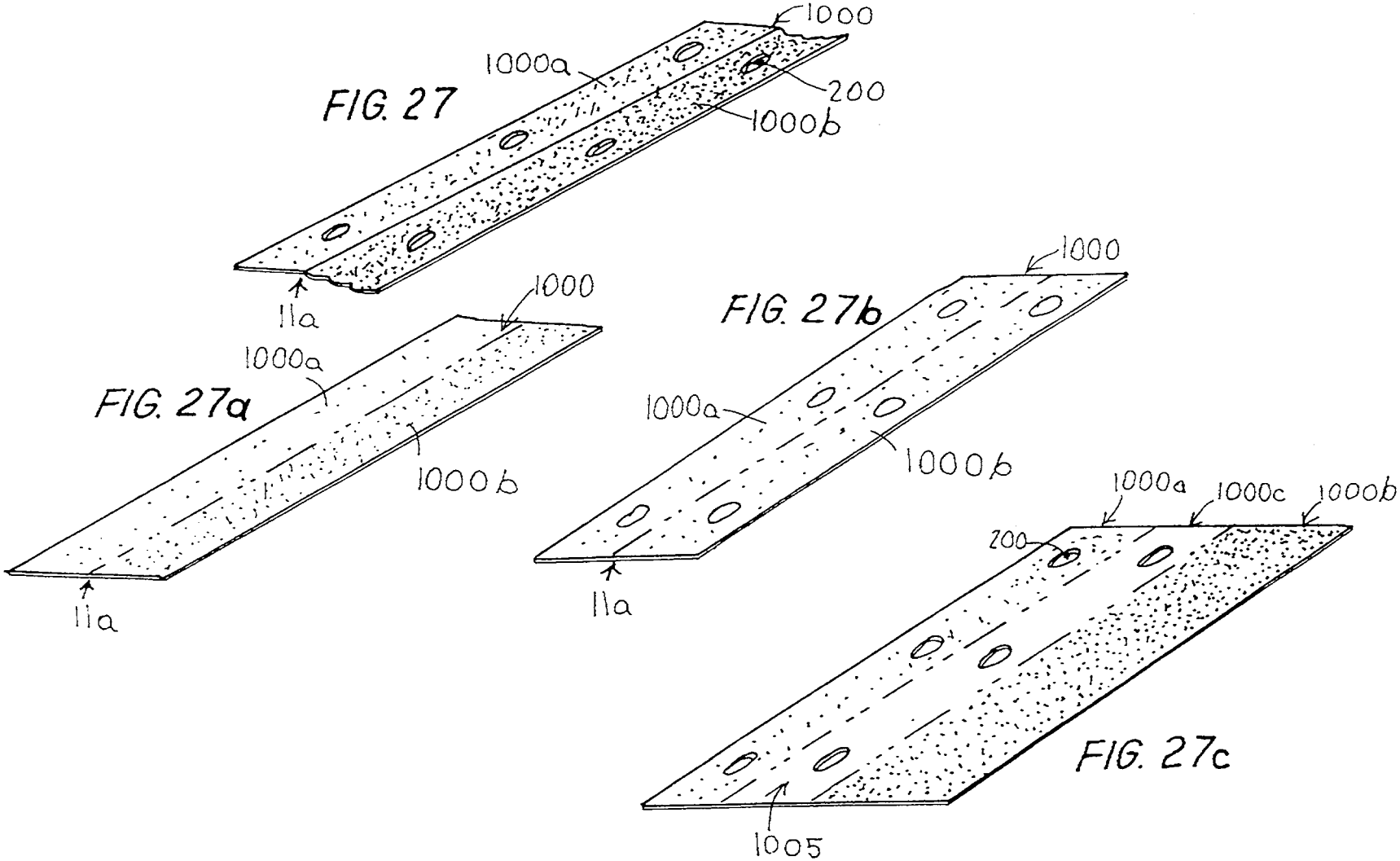

FIG. 26*d* shows a set of leafs of progressively wider extent bound along a common edge on the top of their respective surfaces with the free tape edge deactivating by attachment on the binding tape edge and top surface, FIG. 27 shows a tape strip which may be used to create a single or multi-leaf page structure having adhesive on either side of a tape strip foldable along its median, with sets of holes punched on each edge.

FIG. 27*a* shows the tape strip of FIG. 27 with no holes punched therein.

FIG. 27*b* shows the tape strip of FIG. 27 with one set of holes either marked or punched therein.

FIG. 27*c* shows a tape strip which may be attached to a host sheet that is comprised from three strips. The first outer edge tape strip has adhesive thereon, the middle strip has no adhesive and is approximately the width of the first outer edge strip, and the third strip has adhesive there on and is of a width sufficient for attachment to a second host sheet. The first outer edge strip would typically be a repositional adhesive and the inner edge strip would be a more permanent form of adhesive.

Figures 27D, 27E:
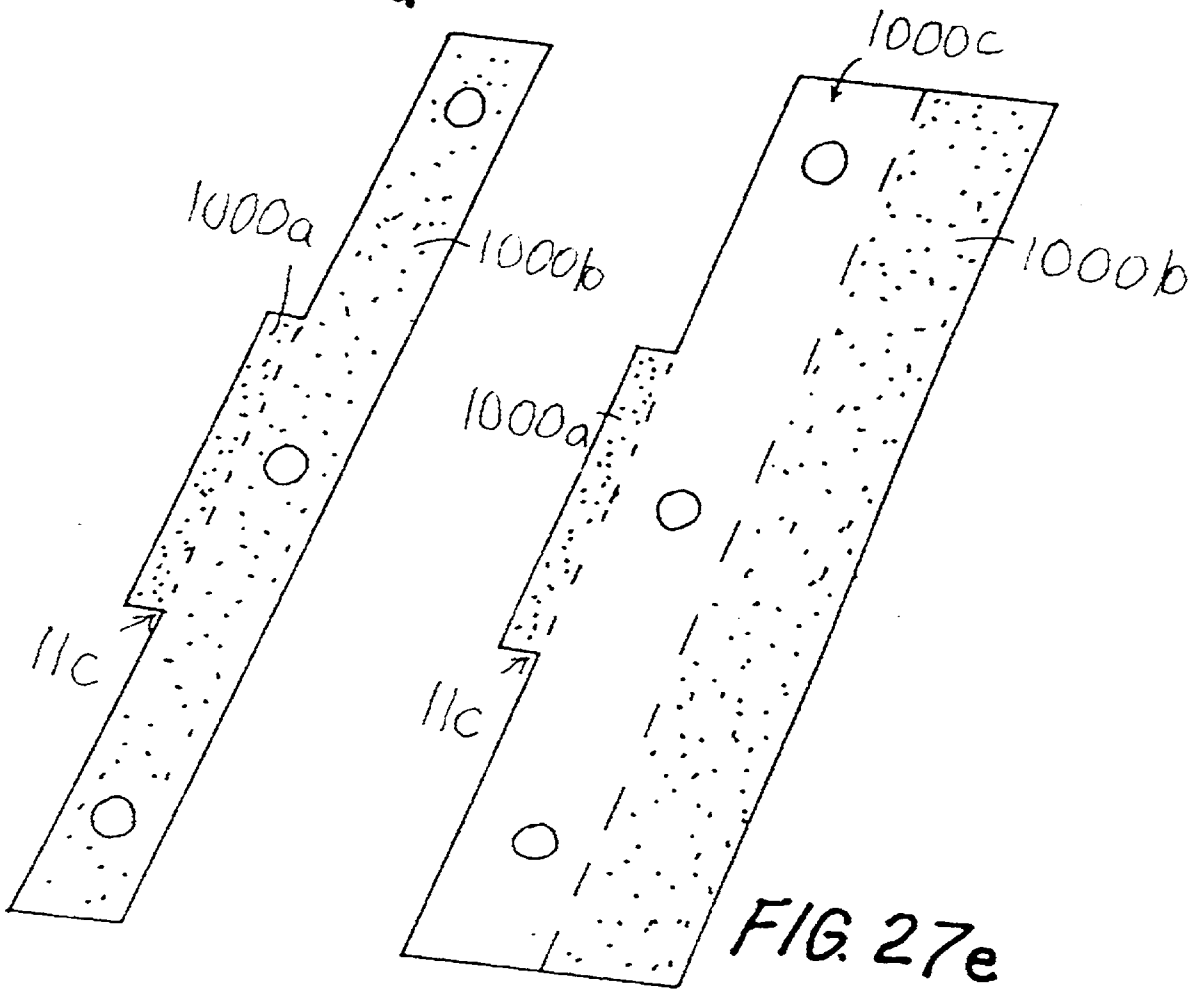
Figures 27F, 27G, 27H, 27I, 27J, 27K, 27L:
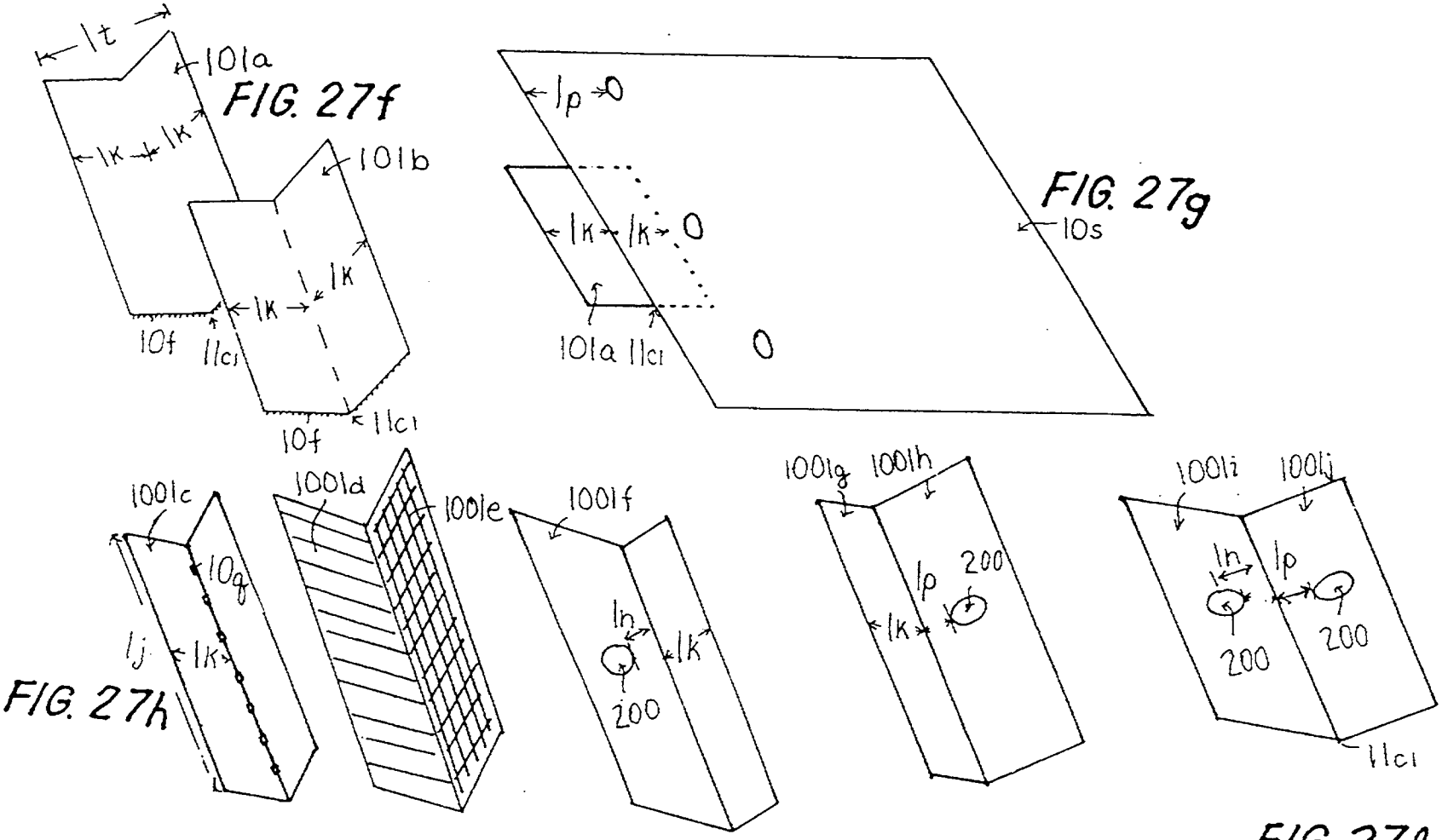
Figure 27M:
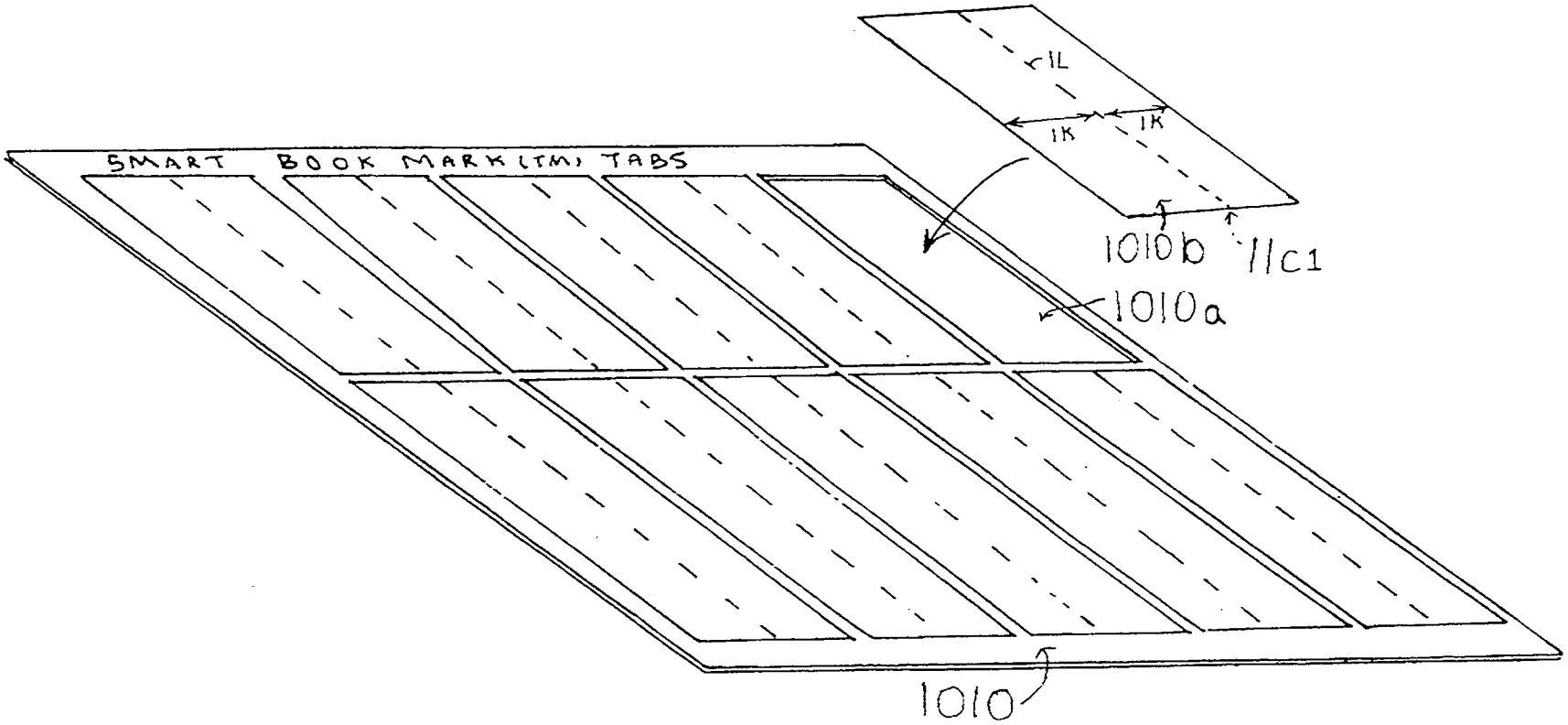

FIG. 27*d* shows a dual strip formation which has a short and narrow adhesive strip hinged to a full length strip with multi-punched holes. FIG. 27*e* shows a three strip formation where the first strip is a short and narrow adhesive strip, the second strip has multipunched holes and no adhesive, and the third strip has a second adhesive. FIG. 27*f* has two tape tabs for forming a smart book mark from any leaf. The first of the two is a single foldable panel of repositional adhesive, the second has a fold marking printed thereon. FIG. 27*g* shows the strip attached to a leaf where the strip operates as a short and narrow adhesive strip. FIG. 27*h* shows a similar strip with a perforated fold hint. FIG. 27*i* shows a two color pattern where each color depicts a different adhesive, one permanent and one repositional. FIG. 27*j* shows a wide strip with a hole and a narrow strip where the wide strip has repositional adhesive and the narrow, repositional adhesive or permanent. FIG. 27*k* shows a narrow strip with repositional adhesive and a wide strip with permanent adhesive and a hole. FIG. 27*l* shows a dual holed two strip tape tab with a hole in each section, one repositional, the other repositional or permanent adhesive. FIG. 27*m* shows a way to deploy sections of mounting strip where each strip is peelable from the mounting strip.

Figure 28:
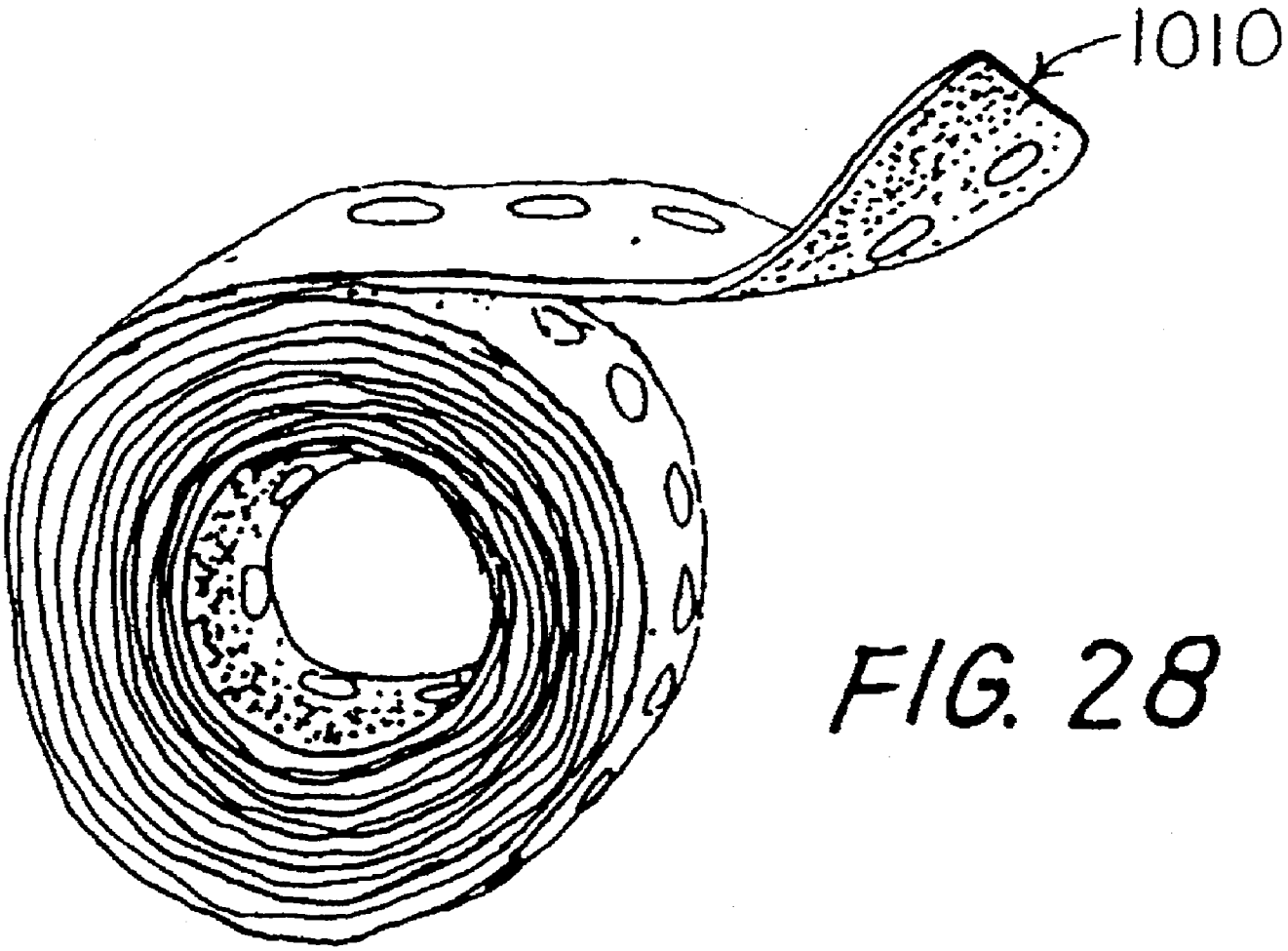

FIG. 28 shows a section of tape like the tapes of FIGS. 27,27*a*,27*b*, or 27*c* rolled up in a reel for delivery.

Figure 29A:
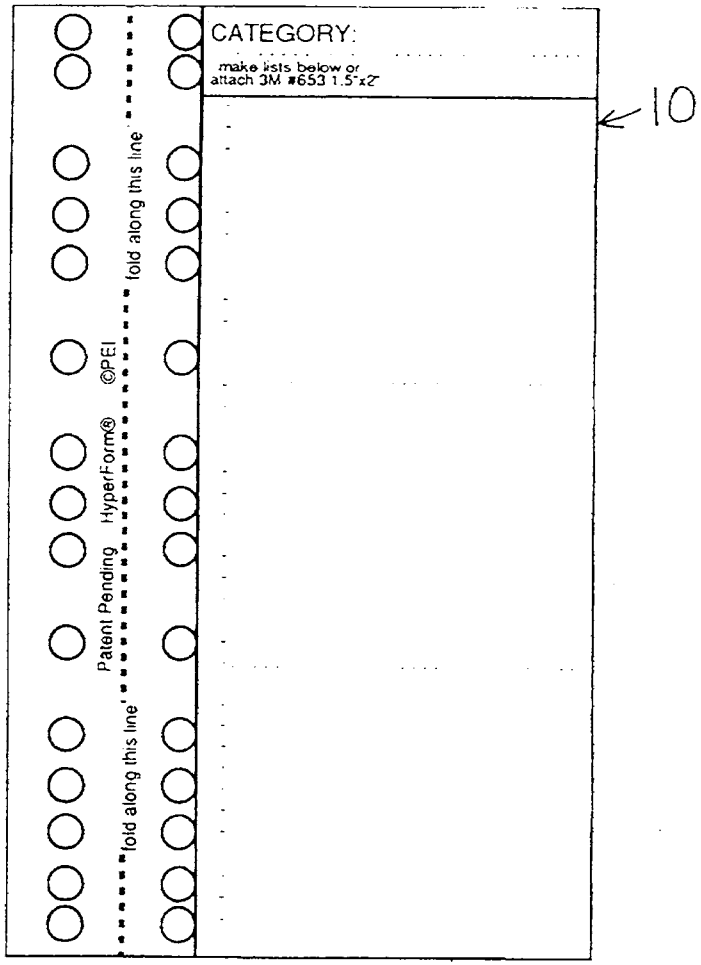
Figure 29:
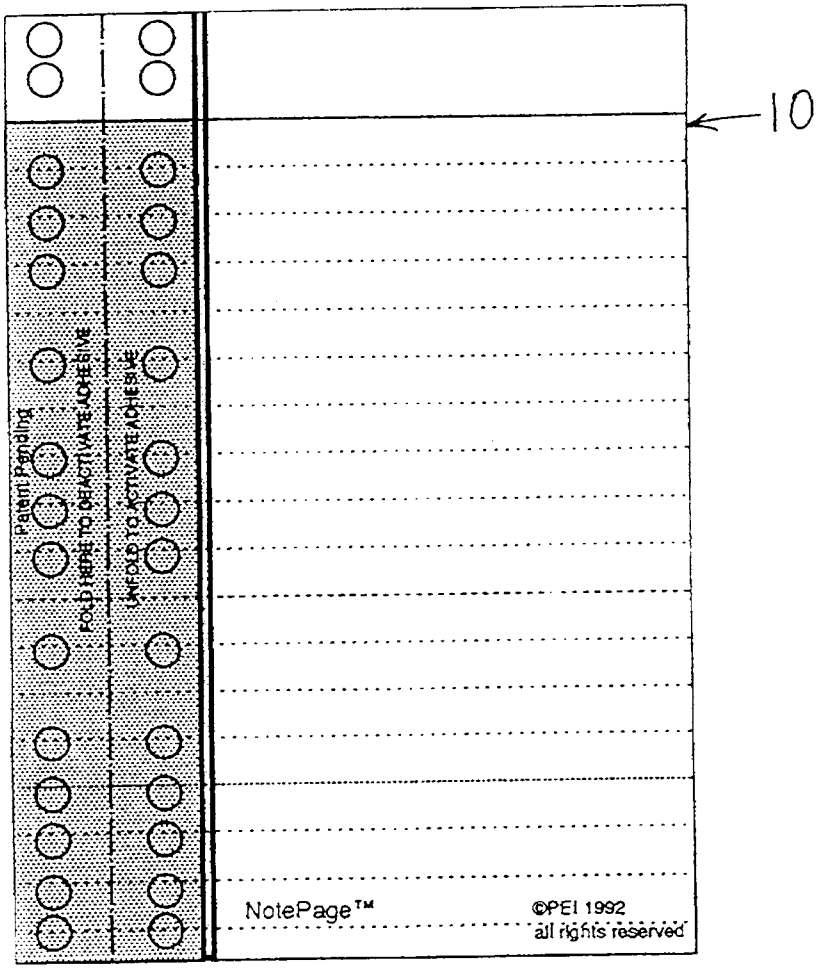

FIG. 29 shows a leaf where the indicia are printed markings which show not only hole punch indications, but also suggest the making of vertically oriented lists with the lines printed on the face. The adhesive is on the leaf binding strip and may be on the top or bottom face.

FIG. 29*a* shows a particular format of printed indicia where the indicia suggest the attachment of a second repositionable leaf. The term category allows of the labeling of the purpose of the leaf at the time of recording of information thereon. Since repositionable notes are themselves used to make the recordings, the category can be relabeled according to the timely use of the list mounted thereon.

DETAILED DESCRIPTION OF THE INVENTION

A preferred embodiment is shown in FIGS. 1, 1*a*, 1*b*, FIGS. 2, 2*a*,2*b*, and 2*c*, and FIGS. 3 and 3*a*. FIG. 1 shows an edge view of a repositional page, 10, according to the invention, with a leaf binding strip 101, and lifting strip 100, all formed from a single sheet of material. The lifting strip has a width, 100*a* and is sufficient for a fingernail or edge to pry the surface up from a position in which the adhesive strip is pressed onto a host surface. The leaf binding strip of extent 101*a* which is comprised of sections 100 and 101 is hinged along an axis at 11, which axis is formed from a fold in the sheet which fold forms a line that divides the sheet into two sections. The leaf binding strip is relatively narrow compared to the leaf body or leaf media strip, 103. The leaf body or media strip, 103, of width 103*a*, is called a media strip because it is the surface on which the manipulation of information occurs. The surface may be a piece of paper which can be written directly on as a piece of paper. The surface may alternatively be used to post notes on that themselves have repositional adhesive, such as standard format Post-it(™)/3M notes. Hole set 200*a* and 200*b* are punched in parallel along the binding edge. Adhesive material is placed along strip 101. The media strip portion 103*a* has a margin section 102*a* defined by the margin line 102*b*. The text is shown in typical Western language orientation with letters "Abcde" in left right format, with printing from top to bottom. The adhesive used in the preferred embodiment is repositional adhesive, as used for example in 3M Post-it(™) Brand Notes. FIG. 1*a* shows the binding strip 101 folded to a position in which the adhesive is about to be deactivated by pressing the binding edge down onto the top of the media strip 103. Once pressed into this position, the holes align one atop the other, and the leaf may be placed in a ring binder, through the aligned holes, for referential access. FIG. 1*b* shows the binding strip folded below the media strip so as to activate the adhesive for attachment to a second host surface which attachment would be accomplished by pressing exposed adhesive 10*f* onto said second surface. In this situation, the media strip, 103, would turn about the pivotal axis, 11, to allow the page to be manipulated naturally in a turning fashion, allowing for the use of both sides of the note if desired. The cut pattern of holes 200*a* and 200*b* are symmetrically cut along the hinge axis line 11 and forming a coincident pattern when the surfaces into which they are cut are coincident with one another. The "hinging" about axis 11 serves to take the stress off the repositional adhesive, preventing undesirable dislodging of an attached leaf from its host. When it is desired to reposition the note, the note can be lifted along any section of the lifting edge, or simply pulled from a corner or outwardly and the repositional adhesive bond will break, releasing the sheet. The lifting edge serves to enable separation of the binding edge, especially when the adhesive is attached to a second binding edge with adhesive. FIG. 1*a* shows an edge view of the same sheet of FIG. 1 with the binding strip 101 folded along pivotal axis 11 into a position above the surface 10*e*. FIG. 1*b* shows an edge view of the same sheet of FIG.

1 with the binding strip 101 folded along pivotal axis 11 into a position below the surface 10*g*. FIG. 2 shows a perspective view of the sheet 10 of FIG. 1. Printed edge 106*a* is visible. The "x" hashings depict the area where a printed pattern may be placed, which printing may be placed on either side as depicted by 106*b*. FIG. 2 shows the opposing edges of sheet 10, 10*a*/10*b* and 10*c*/10*d*. The top media surface is 10*e* and the bottom face of the media surface is 10*g*. Hole 200 is formed as a set of parallel holes 200*a* and 200*b*. The margin strip 102 is of extent 102*a* and is the location for receiving the postit strip 101 when in deactivated position. The media strip 103 is of extent 103*a*. FIG. 2*a* shows a perspective view of the sheet 10 of FIG. 1*a*. FIG. 2*b* shows the perspective view of FIG. 2*a* with the binding strip 101 adhesively attached to surface 10*e*, and therefore deactivated. Lifting edge 105 is shown raised and the printed edge 106*b* is now visible. The holes 200*a* and 200*b* from the parallel strips are matched. FIG. 2*c* shows a perspective view of FIG. 1*b* further showing how repositional adhesive strip 10*f* may be attached to a second surface. The holes can be prepunched in both sets, pre marked for punching by the user, or punched in one set, with punching of the second set by the user.

Figures 2D, 2E, 2F, 2G, 2H, 2I, 2J:
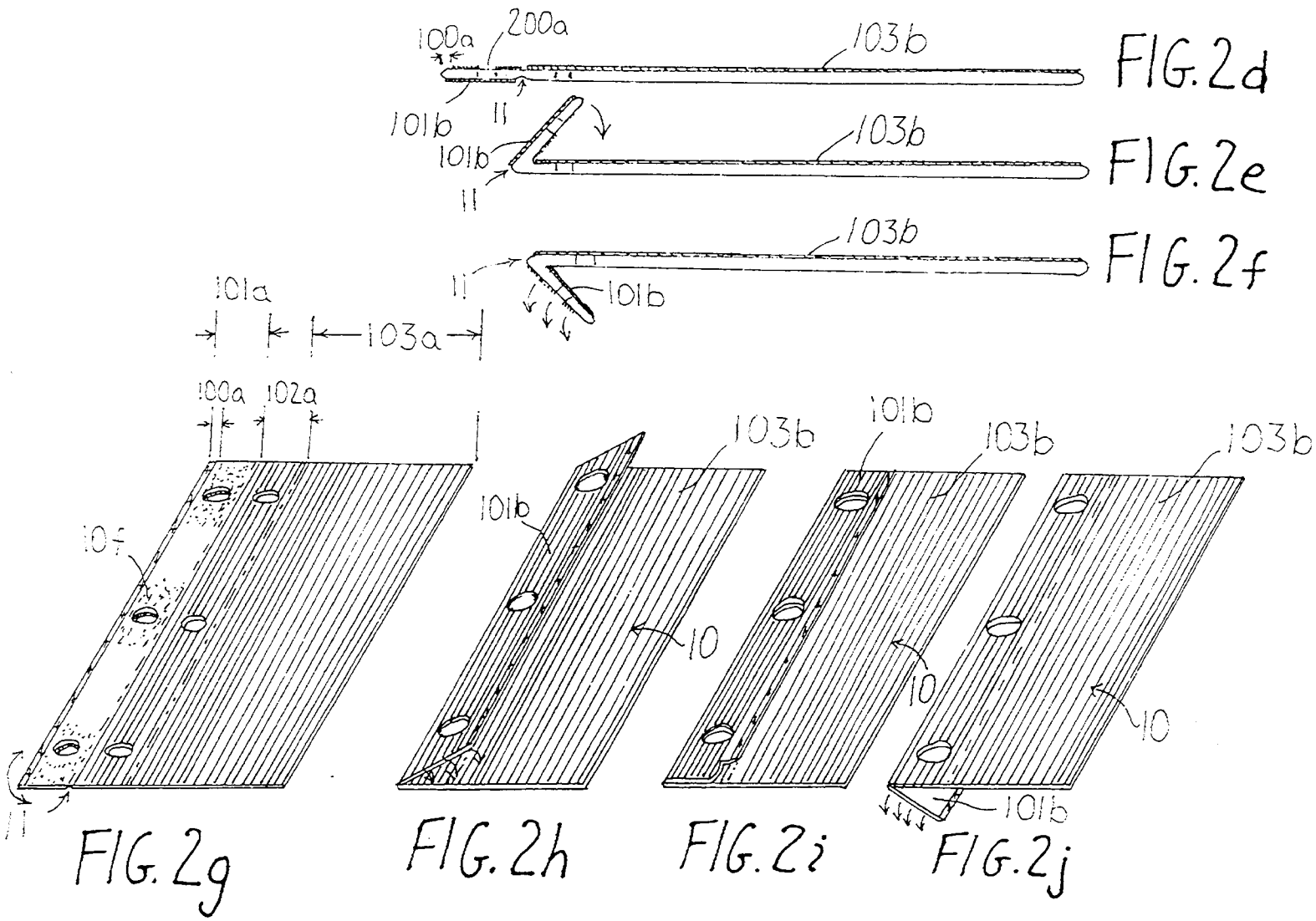
FIGS. 2*d,e,f,g,h,i*, and *j* show the same structure as in FIGS. 1,1*a*, 1*b*,2 2*a*,2*b* and 2*c* except for the addition of the laminated top mounting surface and the laminated binding strip.
FIGS. 2*g,h,i*, and *j* show perspective views of the laminated sections.

FIGS. 2*d,e,f,g,h,i*, and *j* show the same structure as in FIGS. 1,1*a*, 1*b*,2 2*a*,2*b* and 2*c* except for the addition of the laminated top mounting surface, 103*b*, and the laminated binding strip, 101*b*. FIGS. 2*d,e*, and *f* show the side view which highlights the coated sections. The larger coated sections would be an ideal mounting section for repositional notes. The coating on the binding strip serves to strengthen that section in its pivotal attachment and removal. FIGS. 2*g,h,i*, and *j* show perspective views of the laminated sections. The coated sections also discourage curling on removal.

The materials used for the construction may vary and can include tyvec®(spunolefin), or plastic. Alternatively, disposable materials such as paper and cardstock are also desirable in some applications. The paper might be chemically treated to be smooth, yet thin, say for enabling the sheets to be receptive to repositional note placement and removal.

Figures 2K, 2L, 2M:
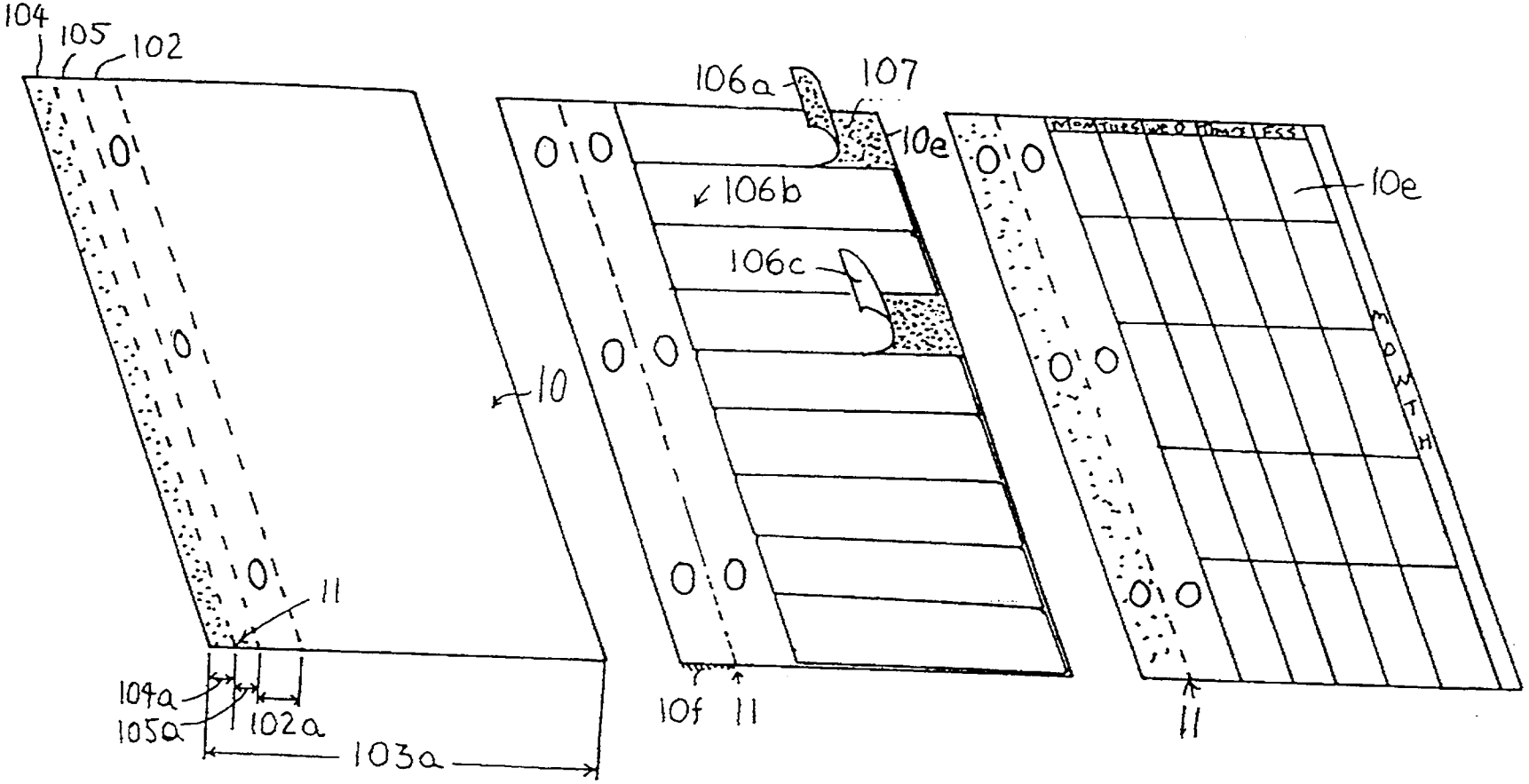
FIGS. 2*k,l,m* show three applications of a leaf according to the invention.
FIG. 2*l* shows the application of a leaf where the writing surface is comprised of a series of peelable strips which themselves are writable and when removed expose a band of repositional adhesive, useful for attaching nonadhesive leafs thereto.
FIG. 2*m* shows a leaf where the writing surface is preprinted with a calendar.

FIGS. 2*k,l,m* show three applications of a leaf according to the invention. FIG. 2*k* shows a leaf with a full length but narrow adhesive margin, 104*a*, where the adhesive may be applied on either side and which folds over along the axis at 11, and deactivates without interfering with the hole pattern of the leaf. The figure shows the non-interfering fold over area 105*a*, where the sum of the width of 104*a*, 105*a* and the hole section width 102*a* form the effective margin. The record keeping section of 10 may be used in any manner like those according to the invention. FIG. 2*l* shows the application of a leaf where the record keeping section is comprised of a series of peelable strips, like 106*a*, 106*b*, and 106*c*, which themselves may be writable, and which are adhesively attached to the surface 10*e*. The adhesive may be on either the bottom surface of the peelable strip or on the surface 10*e*. When a strip is removed, the preferred construction exposes a band of repositional adhesive, 107, useful for attaching nonadhesive leafs thereto. FIG. 2*m* shows a leaf where the writing surface of 10*e* is preprinted with a calendar format.

FIG. 3 shows a perspective view of a host book 300 with pages 301, stitched, sewn, or otherwise intensively and permanently bound, leaving little room for any insertable media. A typical surface, 10, according to the invention is shown being placed into the host book at it's binding 302 by applying strip 101 to said book binding between any two pages. FIG. 3*a* shows the repositional page 10 of FIG. 3, with adhesive strip deactivated, now placed in a heterogenous, ring structured binding 311, through hole 200. The sheet 10 can alternatively be placed anywhere on any surface of the book including the outer edges of any of the pages as well as along an edge of the cover. The additional use of postits (™/3M) is shown where two notes are mounted on the leaf and are transitioned from the sewn bound book to the ring bound book on leaf 10.

FIG. 3*a'* shows a "pad grouping" as would be constructed by putting a stack of repositionable leaves 10, mini-book folded as shown in FIG. 20*b* stacked on a base leaf 301 as shown in FIG. 3, here shown in stand alone pad form. This form of pad grouping can be used to package notes for sale in pre-arranged, prefolded groupings of 25,50, or for example 100 sheets. The leaves can be peeled off one at a time or in groups of mini-books.

FIG. 3*b* shows a way to distribute these windowing note pages, 10, by forming a pad 110. Note the adhesive surface, 10*f*, and the writing surface, 10*e*, are both face up. Note also, that the adhesive is deactivated in the ring configuration to allow for the non-adhesively bound pivotal attachment and turning required of the ringed structure. Note, that the primary or "active" binding means is the active repositional adhesive and that the secondary binding or "referential" binding is the ring structure.

FIG. 3*b'* shows another way to distribute these windowing note pages by forming a pad of a slightly different structure. Note the adhesive surface is face down and a base leaf is employed (like leaf 301 is used in the book), to deactivate the adhesive of the bottom note. Note that this format takes the structure of a more traditional repositionable note pad and therefore might be more convenient to make as a commercial embodiment for the initial development of a line of products embodying this concept. The pad base leaf covers the adhesive of the last leaf of the pad. As in all of these pad configurations, the base leaf can be any shape so so long as it is of a size sufficient to cover the exposed adhesive and thereby serves to deactivate the adhesive of the last leaf.

In this type of application, the use of the leaf body as a mounting surface, results in the implementation of a notetaking system that can be referred to as a "blackboard" system. The structure is particularly useful for the capture and representation of items of information in lists. The use of opaque or clear surfaces depends on the particular application. Having a binding strip that is clear is useful to enable viewing of information along the binding margin. A "minibooking" technique might be employed in which the surfaces are grouped one to the other as opposed to being placed in an alternative binding. This is detailed further on. Also, the surface can be used as a way of delivering a preconfigured set of repositional notes, for the purpose of taking notes directly on them as an "array" of notes or an "array" of stacks of notes. This is also detailed further on.

FIG. 3*c* shows a leaf where the dual hole pattern is comprised of oval holes 200*c* and 200*d*, where the oval structures are horizontally disposed and which serve the purpose of preserving a substantial hole when overlapped in a multilayered minibook. These oval holes would counter the bunching of the hinges interfolded one within the other along axis 11 is a minibook set. FIGS. 3*d* and 3*e* show a leaf top and bottom surface where the print pattern for the fold hints and hole punch hints are represented on both sides to assist in the folding operation, punching operation, and in denoting the margins.

FIG. 3*f* shows a leaf stack, 110*a*, comprised of paper, with a "short" adhesive strip of length 10*j* and "narrow" width

10*k*, where the leaf is preprinted as a form on both sides with markings, 10*h*. The adhesive on the strip is on the side opposing the top or front writing surface. The short adhesive strip allows all four corners, 10*t,u,v*, and *w* to be lifted independently like a "loose leaf". The narrow strip would allow for placement along a narrow host margin, with out interfering with the print of the host book. FIG. 3*g* shows a diecut leaf stack, 110*b*, to form a pattern of a face, 10*i*, where the adhesive strip, 10*f*, is banded with the adhesive on the top surface, adjacent to the top writing surface. Markings 10*l*, denoting "fold here" with hash lines, are shown on the top surface. The hole in the short strip, 200*a*, is a partial hole, determined by the width of the strip. FIG. 3*h* shows a leaf with a short and narrow adhesive strip that is centrally disposed near the center hole of the leaf and noninterfering with the central leaf hole. Width 10*k* of the adhesive strip is less than the width 10*m* which is the distance from the edge of the sheet to the hole. FIG. 3*i* shows a similar leaf to FIG. 3*h* where the adhesive band is wider and possesses an overlapping hole to mirror the center hole of the host leaf. The holes are symmetrically disposed about the fold line 11, where the distance from the hole centers to the common fold line 11, i.e., distances 10*n* and 10*p*, are equal. FIG. 3*j* shows a similar leaf to FIG. 3*f* where the adhesive band is on a strip separated by a simple perforation, 10*a* (as previously shown in FIG. 10). If made from paper, a laminate or mylar may be layered over the hole pattern to strengthen and otherwise stiffen the leaf edge and may optionally have a hole cut intersecting the perimeter of the leaf, 10*s*, which adds yet another optional means for attaching a mounting surface such as this to a structural binding, i.e. a rubber band stack for example. This sheet may be made from paper, tyvec, or any other thin foldable stock like a mylar. The application would determine the material. If used as a mounting surface, laminated tyvec or mylar would work very effectively.

Any one of these structures may be formed by diecutting either the binding strip and or the leaf body face. The die cut may do one or both sections at the same time off a larger leaf and the cutting may be accomplished on multi-leaf stacks for example in 50 or 100 sheet stacks.

FIG. 3*k* shows how a repositional leaf, 110*c*1 with a prefolded short tab strip, 1001*c'*, can be cascaded or stacked one atop the other, 110*c*1'/110*c*2'/110*c*3'/110*c*4'/301' to form a mini-book or mini-book pad stack, 110*c'*. The leafs are separated and are shown exploded, in perspective view.

FIG. 3*l* shows a perspective view of the leafs of FIG. 3*k*, where the leafs are stacked in the form of a mini-book, 110*c'*. Note that the leafs lie flat, that the feature of all four corners being "free" is preserved in both the pad and single use application, and that each of the leafs can hinge on its respective tab 1001*c'*, as well as being separated individually or in mini-books.

FIG. 3*m* shows a perspective of FIG. 3*l* where the top leaf, 110*c*1', is open and it's tab is shown as the hinged means for attaching the top leaf to the next leaf on the stack.

FIG. 3*n* shows a group of 3 leaves from the stack of FIG. 3*m* where the tab of the bottom leaf, 1001*c'*, is folded up and over to deactivate and form a stand alone mini-booklet. Each of the leafs of the mini-booklet turn, and the stack can be shuffeled since there is no active adhesive to bind the stack to another object. Of course, as shown before, the tab can be alternatively attached to another leaf, as the leaf of a book, thereby introducing a mini-booklet as a "patch in" stack of leafs anywhere the adhesive will securely/temporarily bond.

The construction of a pad book of prefolded notes would be accomplished on a specialized machine. Any one of a number of ways can be planned to make the final pad. The process of applying the adhesive, cutting the tab edge of the leaf to the proper size, folding each leaf and stacking it one on top of the other with a deactivation strip (as in FIG. 17, or a base leaf as in FIG. 3*a'* can be used to terminate the stack. The booklets can be constructed in any size and various proportions of tab width and length to leaf size will work. Of course, holes and/or cut patterns as in 3*g*-3*j* can be used as well, for example.

A choice of paper types would be preferred, including recyclable sheets. However, stacks of tyvek leafs or other materials which are either more durable or more sheer as well as those with treated surfaces for the construction of floating mounting surfaces can be used. Further, preprinting would result in the formation of a book with a reconstructable binding. This can be used in any application where a book with a variable composition might be applicable, such as in a calendar, or a diary or the like.

This form of leaf provides the ideal "Add-A-Page™(PEI trademark) accessory, especially for closely bound books (perfect bound, wire bound, and the like).

FIG. 3*o* shows a preferred embodiment of a leaf, 110*c*1", with a tab 1001*c'* having a curved radius short tab portion, 11*a*, where the curved radius is at only one end of the short tab. Three leaf corners are free. The squared bottom tab corner, 11*b*, lends to increased stability of the pad for certain applications. The tab is shown folded along axis 11", for attachment by way of repositionable adhesive 10*f*, to a host surface or to another leaf in a pad or mini-booklet/mini-book.

FIG. 3*p* shows a preferred embodiment of a leaf, 110*c*1'", with a tab 1001*c'"*, having two curved radius short tab ends, 11*c* and 11*d*, where each of all four corners of each leaf are free.

FIG. 3*q* shows the leaf of FIG. 3*p*, 110*c*1'", assembled into a pad of 4 leafs, where the format is shown in exploded perspective and where the base leaf, 301'", has a band of adhesive 10*f'"*, for receiving the last leaf of the pad.

FIG. 4 shows a repositional page 12 similar to that of FIG. 1 without any holes. This sort of sheet would appear as a standard unpunched sheet when the adhesive is deactivated. It's typical application would be for notetaking, and when batched, it could be alternatively clipped or slipped into a pocket or the like. FIG. 4*a* is like FIG. 1*a* without holes. FIG. 4*b* is like FIG. 1*b* without holes.

FIG. 5 is like FIG. 2 without holes. FIG. 5*a* is like FIG. 2*a* without holes. FIG. 5*b* is like FIG. 2*b* without holes. FIG. 5*c* is like FIG. 2*c* without holes. The surface may be used to write on directly for listing of items of information, for example, or could be used to mount other notes. Note, an adhesive free portion is provided for on both sides of the adhesive band, here shown as 100*a* and 100*b* and as shown in FIG. 16. The adhesive free section 100*b* is useful when dispensing notes, as the section between the pre-folded axis 11 and the adhesive can flex to free the notes one from the other.

FIG. 6 is like FIG. 1 except the adhesive strip 10*f* covers the entire hinged strip 400. The need for a lifting edge is a clear and an important improvement. However, it would be possible to construct a workable alternative with a standard format note in which the repositional adhesive were applied along a deposition layer flush to the edge of the binding strip. FIG. 6*a* is like FIG. 1*a* except for the adhesive strip 10*f* which covers the full hinged binding section 401 and the absence of holes. FIG. 6*b* is like FIG. 1*b* except for the adhesive strip 10*f* which covers the full hinged binding section 401. Note the absence of holes. FIG. 7 is like FIG. 2 except for the adhesive strip 10*f* which covers the full hinged binding section 401. Note the absence of holes. FIG. 7*a* is like FIG. 2*a* except for the adhesive strip 10*f* which covers the full hinged binding section 401 and the absence of holes. FIG. 7*b* is like FIG. 2*b* except for the adhesive strip 10*f* which covers the full hinged binding section 401. Note the absence of holes. Care would need to be taken in designing the adhesive to allow for easy lifting of the thin binding strip to avoid excessive "ribboning" or curling.

FIG. 8 shows a perspective view of a sheet 20 with hinged binding strips 101 on opposing edges 20*a* and 20*b*. FIG. 8*a* shows a perspective view of a sheet 25 with hinged binding strips 101 on the opposite set of opposing edges 25*c* and 25*d* from FIG. 8. FIG. 8*b* shows a perspective view of a sheet 30 with hinged binding strips 101 on orthogonal edges 30*a* and 30*c*. The adhesive, 10*f*, shown below in this picture, can be on either side of strip.

FIG. 9 is like FIG. 1 except the hole pattern 205 is a cut slot for attachment to a wire binding, 312. FIG. 9*a* is like FIG. 1*a* except the hole pattern 205 is a cut slot for attachment to a wire binding. FIG. 9*b* is like FIG. 1*b* except the hole pattern 205 is a cut slot for attachment to a wire binding. Note that the binding strip is laminated or stiffened with material 101*b*, a thin coating of plastic or film. This not only strengthens the hook set but enables folding along the fold axis that bisects the hook pattern to form the "T" shape.

FIG. 10 is like FIG. 2 except the hole pattern 205 is a cut slot for attachment to a wire binding. FIG. 10*a* is like FIG. 2*a* except the hole pattern 205 is a cut slot for attachment to a wire binding. FIG. 10*b* is like FIG. 2*b* except the hole pattern 205 is a cut slot for attachment to a wire binding. FIG. 10*c* is like FIG. 2*c* except the hole pattern 205 is a cut slot for attachment to a wire binding. The binding panel or strip or alternatively the leaf body may be laminated or otherwise treated and stiffened, as shown where stiffener material 101*b* is placed on a binding strip, as a further means for enabling or otherwise allowing the easy folding midway along the perforated section 205, as well as preserving the otherwise fragile edges of the hook set. Also, it is shown how the stiffener appears in 10*a,b*, and *c* as the striation markings depict this film or stiffener coat of material.

FIG. 11 shows a side view of a multi-folded leaf 35 in which the leaf sections are folded one below the next and nest into a hinge extension section. The faces 35*a*,35*c*, and 35*e* may be turned to as would be standard pages and maintain their orientation when pulled out to the right. The breadth of the hinge extension 35*f* allows for hinge extension 35*g* to house the interfolded leafs in a compact form. Hinge section 101 acts as a pivotal attachment to a second host surface.

FIG. 11*a* shows a side view of a multi-folded leaf in which the leaf sections are folded one on top of the next. In this example, surfaces 36*h*,36*f*, 36*d*, and 36*a* maintain their same orientation when 36*h* is pulled out to the right and may be turned to as regular pages when the interleaved page is in compact form.

FIG. 11*b* shows a perspective of FIG. 11*a* for an example of a multi-folded leaf with 2 folded sections, 36*a* and 36*e* in the process of being expanded to the right.

FIG. 11*c* shows a side view of a multi-folded leaf as a "narrow width" Smart Book Mark, where the leaf is formed as a construction of a series of equal width surfaces, where the widths are respectively the distances between leaf ends 36*k,l,m*, and *n* and 36*i*1,2,3 and 4, of the single sheet of material 36*i*, and are alternately coated with adhesive 10*f* and laminate 36*j*. The adhesive sections, with adhesive 10*f*, bond to form the leafs which leave the laminated sections exposed. These serve as mounting surfaces. Hinged strip 101 has adhesive 10*f* for attachment to a book. The leaf width can be the width of a margin of a host book to ensure that the leaf does not interfere with host print. The preferred adhesive for the entire set of sections is repositional adhesive, i.e. with a tacky, repostable bond. If this type of adhesive is used, all internally bonding surfaces which are to adhere one to the other in forming the leafs, should be coated. In this way they will form a more permanent bond than the repositional strip 101, such that when the leaf array is lifted the leaves stay firmly together and only the adhesive on section 101 breaks bond. FIG. 11*d* shows the side view of the attached topology of the folded material. FIG. 11*e* Shows the adhesive pattern in extended format with the panels horizontally disposed. FIG. 11*f* shows the other side with the laminated panels in extended format with the panels horizontally disposed. The panels can be smooth treated with an appropriate chemical film to keep them thin in which case no edge such as from material 36*j* would appear. 36*j* is shown as the clear material laminating the respective panels of the multi-panel pattern.

FIG. 12 shows a leaf construction, 40, in which the leaf is formed as an index. Here two index tabs 41 and 42 are shown marked with symbols for visual access. FIG. 12*a* shows a leaf construction, 45, in which the leaf is formed as a diagonal pocket, 46 with insertion area 47. FIG. 12*b* shows a leaf construction, 50, in which the leaf is formed as a vertical pocket, 51, with insertion area 52. The preferred location for the adhesive in this construction is on the opposing surface to the mounting face.

FIG. 13 shows a two cover insertable card, 60, with a note pad, 62, mounted on one of the two covers as a media surface, 64, the other cover, 61, serving as an insertion tongue or alternatively as a cover. There is a second insertion tab, 63, for retaining the pad in a fixed position.

FIG. 13*a* shows a two cover insertable card, 65, with an array of repositional notes, 67, mounted on one of the two covers, 69 as a media surface, the other cover, 66, serving as an insertion tongue or alternatively as a cover. There is a second insertion tab, 68, for retaining the pad in a fixed position.

FIG. 14 shows a host hinged page, 50*a*, constructed as a pocket for receiving an insertion card like either of those shown in FIG. 13 or FIG. 13*a*. In addition, this pocket has an insertion slot 54 for receiving either second insertion tab 63 or 68 to secure the media surface.

FIG. 15 shows the insertion card, 65, of FIG. 13*a* inserted in the pocket, 52, of FIG. 14.

FIG. 15*a* shows a perspective view of a pocketed leaf, 53*a*, of a form which can be configured with certain accessories. The pocket, of width 55, is formed as a "half pocket" with open lip 52*a*, covering one-half the leaf width. There is a laminated cover, 53*b*, which binds the ends of the pocket to seal them, leaving opening 52*a*. The material, 65*c*, is a stiffener which may be adhesively attached or deposited on the sheet of folded material that comprises the structure. The purpose of this material is to ensure that the overall structure remains mostly rigid while not adding significantly to the weight or thickness of the leaf structure.

FIG. 15*b* Shows a side view of the leaf of FIG. 15*a* and which shows the open part of the pocket, 53*c*. Sheet 65*a*1 is an optional extension of pocket 53*a* and offers the additional possibility of providing a mounting surface for postits.

FIG. 15*c* shows a perspective view of a pocketed leaf where the pocket is formed by a full overlapping section of material, 55*a*, with and the one-half pocket section is formed as a slit in the larger section at a width of length 55 where length 55 is one half of the length of sheet 55*a* (the width of the leaf). Of course, it would be equally useful to have the slit be more or less than ½ the width of the leaf. The width would be determined by the application, and in the case of use with Postits, the widths would preferably be substantially integral multiples of the postit note width. There is a ridge edge formed at the edge of the leaf, shown as 56, coterminous with the adhesive strip. This forms a protective edge when the leaf is used to hold a postit note stack. The ridge can be formed any number of ways including folding over on itself and being adhesively secured, being laminated on and the like.

FIG. 15*d* shows a side view of leaf 15*c* where it is shown that the full panel is partially sealed by a binding 55*b* which is shown here as an adhesive.

FIG. 15*e*1 shows a perspective of a special configuration with accessories mounted on the leaf of FIG. 15*d*, which accessories are shown as a stack of repositional notes, 67, and a leaf array, 65*a*, with a tongue, 65*b*, inserted in the slit pocket, 54, the configuration is alternately referred to as a "generator". The deactivation of the strip 101 is shown in a dotted line progression, where the adhesive is folded back over the protective ridge. The preferred arrangement of the leaf array is such that at least one stack of repositional notes, i.e. the top note of at least one stack, is left exposed for direct access. The note stacks and leaf array can have any number of alternate arrangements while preserving this form and associated function.

FIG. 15*e*2 is a top view of the structure. The notes are in two colors as depicted by the dots on the bottom two stacks. All features of the mechanical object are depicted including the protective ridge, 56, the note stacks, 67, the leaf array, 65*a*, and the repositional binding 101. A sample note is shown in hashed lines as 67*a* if it were posted to the leaf array. If the leaf array is translucent, notes on subsequent pages will show evidence by being partially visible through the top leaf, as through "glass". Opaque leafs would not give indication of notes contained in subsequent layers unless some form of indexing technique were used such as placing notes within along an edge of a leaf with a part of the note exposed. Note stacks would deplete and would be replenished at the stack level. The note stacks may be further separated by separation barriers or wells and the name NoteWell®(registered trademark of PEI) may be used to describe such an implementation of a note stack array which implementation is favorable for the construction of a generator.

FIG. 16 shows a leaf, 70, with a hinged binding edge, 101, in which the adhesive, 81, in this case, is being applied by a user using an adhesive dispenser, 80, such as a DryLine(™/Gilette) dispenser. The adhesive strip 81 is being applied in a predetermined pattern. In fact, an adhesive pattern or stripping effect will be desirable for different materials and hole structures.

FIG. 17 shows a leaf, 80, with a hinged binding edge, 101, having an active adhesive strip, 400, and a separable section, 83, which can be placed over the active adhesive of the leaf thereby deactivating said active adhesive. FIG. 17*a* shows the leaf, 80, with the adhesive strip, 400, deactivated by the strip 83 being applied directly over adhesive section 400.

FIG. 17*b* shows the hinged section, 101, being rotated with adhesive strip 400 active, and a deactivation strip, 83 having it's own adhesive, 401, attached on the opposite side of the hinge for use at a later time.

FIG. 18 shows a leaf, 90, formed with a clear binding edge, 500, and an opaque surface, 501, which may be used for either writing or for attaching other information, i.e. postit notes, for example. The hinge axis, 11, is a prefolded or scored fold axis that allows the opaque section 501 to fold naturally about the binding edge 500. Alternatively, section 501 may be clear, in which case it would serve well as a receiving plate for other postits and would show through to enable other surfaces to be partially viewable. FIG. 19 shows a leaf, 150, formed from a sheet of material such as tyvec, 151, in which the hinge section 601, and leaf section 153, have been separately laminated with clear plastic, 152.

FIG. 20 shows a leaf, 12, with the hinged binding edge, 101, folded down and prepared for forming multiple leaf sets. FIG. 20*a* shows two leafs, 12, about to be cascaded one atop the other using hinged binding edge 101. FIG. 20*b* shows the two leafs of FIG. 20*a* attached and cascaded together forming a multi-leaf set, leaving the bottom hinged binding edge 101 free to attach to another leaf or to fold back up and thereby deactivate it's adhesive. FIG. 20*c* shows two leafs, 12, about to be cascaded by nesting one hinged section within the other, applying adhesive 10*f* to the surface 10*g*. FIG. 20*d* shows the two leafs of FIG. 20*c* attached and cascaded together forming a multi-leaf set.

FIGS. 21*a,b*, and *c* show an edge view single leaf structure with the repositional adhesive on the opposing face to the writing or mounting surface, and the combination of two such leafs into a multi-leaf structure. FIGS. 21*d* and *e* show a planar view of the structure of FIG. 21*b* where the FIG. 21*e* further displays the use of the mounting surface for the posting of a set of repositional notes. Note how the hinged axis at 11 line up to enable the turning of leafs, 10. This leaves section 101 free to be attached by way of its adhesive to another surface, to be clamped, or otherwise enveloped in a second binding.

FIG. 22 shows an edge view of a leaf construction where the page is formed from a piece of tape section, 1000, and a media section, 500. Tape section 1000 is composed of two sections, 1000*a* and 1000*b*, and is hinged about axis 11. Adhesive 10*f* is active upon the top surface of tape section 1000*b*. This construction would be an alternative to the single leaf formation and would allow the adaptation of any one of a number of different surfaces for repositional adhesive activation.

FIG. 22*a* shows a perspective view of FIG. 22. The media section is actually of extent 103*a*, allowing for margin 102*a*, the adhesive deactivation area. FIG. 22*b* shows an edge view of the leaf of 22 with the tape section, 1000*b* folded over and "sandwiching" 500*e*, with tape section 1000*a*. The tapes adhesive is thereby deactivated. FIG. 22*c* shows an edge view of the leaf of 22 with the tape section, 1000*b*, folded back and below the bottom of 500, with the tapes adhesive, 10*f*, activated.

FIG. 22*d* shows the same the same thing as FIG. 22*a* except for the addition of a set of parallel punched holes, 200. FIG. 22*e* shows an edge view of FIG. 22*d* with the tape section folded over and tape deactivated with the holes aligned, for subsequent insertion into a ring binder. FIG. 22*f* is the same as FIG. 22*c*, except the figure shows the punched holes.

FIG. 23 is the same as FIG. 22 and shows an edge view where the leaf surface may be substituted by any one of the surfaces of FIGS. 23*a,b*, or *c*.

FIG. 23*a* shows an alternative surface, 700, as a section of plastic where one half, 700*a*, is opaque and the other section, 700*b*, clear. FIG. 23*b* shows an alternative surface, 800, as a section of plastic which may be clear or opaque.

FIG. 24 shows a plane view of a multi-leaf set formed by applying tape to a common set of offset edges of a set of leafs, 801*a*–805*a*, leaving a section of tape 1000, specifically section 1000*b*, exposed for deactivation or for active attachment to a second host surface. The adhesive used on the tape strip which secures the leafs is a permanent adhesive and the tape must be extremely durable and flexible, like a mylar. The adhesive on the free strip can be repositional adhesive or may be a more permanent adhesive. It would also be possible to tape a rod into the bound edge which rod might protrude over the respective ends of the leafs, thereby offering yet a third means for attaching the leaf set to a second surface. In this latter case, the host would need to possess two pin holes for receiving the protruding ends, male to female. Since, in this construction, all the leafs, 801–805, are of equal width, 800*w*, the respective opposing edges, 801*a*1–805*a*5 are offset one from the other for easy indexing. FIG. 24*a* shows an edge view of FIG. 24 highlighting the manner in which the tape is subsequently bound to the bottom edge of each end of each sheet along edges 801*a*–805*a*.

FIG. 24*b* shows the edge view of FIG. 24*a* with the free tape section, 1000*b*, being bent under the leaf set for active attachment to a second host surface.

FIG. 24*c* shows the leaf set of FIG. 24*b* attached to a host sheet, 320.

FIG. 24*d* shows a preferred configuration of FIG. 24*c* in which the leaf set is a very thin construction and lies in a flat manner on it's host surface. FIG. 24*e* shows the leaf set of FIG. 24*d* with each leaf turned in a fan array showing the ability to turn each page 180 degrees, with general rotation about pivotal axis 11*a*.

FIG. 25 shows a perspective view of a leaf set like the one from FIG. 24 with three leafs and parallel holes, 200*a*/200*b*, punched in the tape and the bound edge of the leafs. FIG. 25*a* shows the perspective view of the leaf set of FIG. 25 with the free tape edge activated and ready for attachment to a second host surface. FIG. 25*b* shows the perspective view of the leaf set of FIG. 25 with the free tape edge folded over and attached to the margin edge of the top leaf and thereby deactivated, with the hole sets, 200*a*/200*b*, aligned.

FIG. 26 shows a leaf set like FIG. 24*a* except for the adhesive, 10*f*, on the free tape strip is applied on the opposing side of the free tape strip, 1000*b*, from that of FIG. 24*a*. FIG. 26*a* shows a leaf set like FIG. 26 except the leafs are cut in progressively shorter lengths and stacked in decreasing size order, 810–813, allowing for a finger touch edge lifting. FIG. 26*b* shows a leaf set like FIG. 26 except for the tape binding being on the top of each successive edge, thereby pressing the opposing edge out as a leading edge with each of the following edges being recessed in by the extent of the tape binding on it's opposing edge. FIG. 26*c* shows a similar top edge binding mechanism for creating a leaf set where the sheets are cut and bound in progressively wider sections, 813-810. The adhesive on the free edge deactivates by attachment from below. FIG. 26*d* shows a set of leafs of progressively wider extent bound along a common edge on the top of their respective surfaces, 810*a*–813*a*, with the free tape edge deactivating by attachment on the binding tape edge and top surface, FIG. 27 shows a tape strip which may be used to create a single or multi-leaf page structure having adhesive on either side of a tape strip foldable along its median, 11*a*, with sets of holes, 200, punched on each edge. Alternatively, the holds can be premarked for punching by the user.

FIG. 27*a* shows the tape strip of FIG. 27 with no holes punched therein. FIG. 27*b* shows the tape strip of FIG. 27 with one set of holes either marked or punched therein. FIG. 27*c* shows a tape strip which may be attached to a host sheet that is comprised of three strips, 1000*a*,1000*c*, and 1000*b*. The first outer edge tape strip, 1000*a*, has adhesive thereon, preferably repositional adhesive, the middle strip, 1000*c*, has no adhesive and is approximately the width of the first outer edge strip, and the third strip, 1000*b*, has adhesive thereon, and is of a width sufficient for attachment to a second host sheet. The first outer edge strip would typically be a repositional adhesive and the inner edge strip would be a more permanent form of adhesive.

The tape strip might alternatively be made out of a tyvec material, like a spun fiberglass, which has a non-tear property and can act as an ideal living hinge.

FIG. 27*d* shows a dual strip formation which has a short and narrow adhesive strip, 1000*a*, hinged to a full length strip, 1000*b*, with multi-punched holes, hinged along a pivotal axis, 11*c*. This strip configuration could be made from mylar, tyvec, or another "many fold" type of material. The holes could be marked or punched. The adhesive for the thin narrow strip is preferably repostable, with the larger, optionally holed strip, a permanent form of adhesive. FIG. 27*e* shows a three strip formation where the first strip, 1000*a*, is a short and narrow adhesive strip, the second strip, 1000*c*, has multipunched holes and no adhesive, and the third strip, 1000*b* has a second adhesive. FIG. 27*f* has two tape tabs, 1001*a*, and 1001*b* for forming a "Smart Book Mark" from any leaf. The first of the two, 1001*a*, is a single foldable panel of repositional adhesive, the second, 1001*b*, has a fold marking, 1L, printed thereon. In either case, the same adhesive, 10*f*, is used on both strips, shown with width 1*k*. FIG. 27*g* shows the strip, 1001*a*, attached to a leaf, 10*s*, where the width of the strip, 1*k*, formed by pivotal hinge 11*c*1, is less than the distance, 1*p*, of the holes of receiving leaf, 10*s* from the edge of the leaf where the tape tab is attached, thus forming a non interfering deactivation formation when pivotally folded over to deactivate the adhesive. This is the case where the tape tab forms a strip that operates as a "short and narrow" repositional adhesive strip. FIG. 27*h* shows a similar strip with a perforated fold hint, 10*q*, formed along pivotal axis 11*c*1, forming a pair of strips of width 1*k*. The length 1*j* is preferable shorter than the length of the leaf to which it is to be attached. FIG. 27*i* shows a two color pattern where each color, 1001*d* and 1001*e*, depicts a different adhesive, one permanent and one repositional. FIG. 27*j* shows a wide strip, 1001*f*, with a hole, 200, and a narrow strip formed to the right of pivotal fold 11*c*1, where the width 1*k* of the narrow strip is less than the distance of the hole edge from the pivotal axis, distance 1*n*. In this case, the wide strip has repositional adhesive and the narrow may have either repositional or permanent adhesive. FIG. 27*k* shows the opposite case, a narrow strip, 1001*g*, with repositional adhesive and a wide strip with permanent adhesive and a hole, 1001*h*. FIG. 27L shows a dual holed two strip tape tab with a hole in each of the sections, 1001*i* and 1001*j* where one adhesive is repositional, the other repositional or permanent adhesive. FIG. 27*m* shows a way to deploy sections of mounting strips like those of the previous figures, according to the invention, where each strip, for example 1010*b*, is peelable from a mounting strip, 1010. Section 1010*a* shows the location where 1010*b* can be positioned. The sheet of mounting tabs can be die cut out of a larger adhesive sheet or individually laid on the host leaf 1010. The example leaf has a fold marking 1L with each strip having equal width 1*k* with respect to pivotal prefold location at 11*c*1.

The tape can have adhesive on the same side of the parallel opposing sections or opposing sides. The tape tab hinge sections can have different colors or the adhesive can have different colors. This permits easy alignment on a leaf edge.

FIG. 28 shows a section of tape like the tapes of FIGS. 27,27*a*,27*b*, or 27*c* rolled up in a reel for delivery.

FIG. 29 shows a leaf where the indicia are printed markings which show not only hole punch indications, but also suggest the making of vertically oriented lists with the lines printed on the face. The adhesive is on the leaf binding strip and may be on the top or bottom face. The grey scale markings can be colored to match the paper, which can be in different colors or designer patterns, and the color used for the hinge portion can be represented on both face sides of the leaf so that the color is preserved when the hinge is folded over.

FIG. 29*a* shows a particular format of printed indicia where the indicia suggest the attachment of a second repositionable leaf. The term category allows of the labeling of the purpose of the leaf at the time of recording of information thereon. Since repositionable notes are themselves used to make the recordings, the category can be relabeled according to the timely use of the list mounted thereon. The hole pattern is a universal hole punch pattern so that the note can be archived in an alternative binding after initial use. The adhesive can be on either face. The adhesive could be placed offset by a small portion such as 100*b*, from the pivotal hinge axis, which placement would serve to enable dispensing of the note.

The printing of the markings, such as shown in FIG. 29 can be made on a large sheet of stock so as to permit the manufacture of a large number of leafs in a production process as typically is used for the construction of books or note pads. The outlined edges of the pad would not need to be printed in such a case as the cutting operation would naturally define the perimeter edges of the note.

The leaf with repositionable adhesive on a hinged tab, formed according to the invention, in a pad assembly where each leaf therein has at least three leaf corners free, with the leaf tab having a radiused curve connecting the tab to the leaf binding edge been unavailable. The assembly provides an ideal mini-book pad form for distributing notes as both stand alone pads at the desk top as well as for use in host stationery products such as books, calendars, and wallets and the like, for a variety of notetaking applications including "direct write on" as well as "mounting surface note posting and carrying" based note taking.

The repositional leaf according to this invention is a leaf that can be hingedly attached to a book, preferably at it's binding, within the margin of the host page, and turn as a leaf of the book, without blocking any printed material of the host, and subsequently be removed and either repositioned to an alternative page of the host book, or have it's adhesive binding strip folded back over itself to deactivate the adhesive, allowing the page to be manipulated as a standard, non-adhesive sheet. Additionally, formed in a pad, particularly one where the leaves have the leaf binding strip prefolded before being placed into the pad, enables the formation of a new kind of book binding where the repositionable adhesive hinges in the "mini-book" formation become the books binding structure allowing for the incremental restructuring of the book leaves through separation and reattachment of the repositionable adhesive. One skilled in the art will appreciate that the present invention can be practiced by other than the embodiments described, which are presented for the purpose of illustration and not of limitation, and the present invention is limited only by the claims which follow.

What is claimed is:

1. A prefolded leaf structure formed from a single section of material, having a top face, a bottom face and perimeter features including at least two leaf structure edges, a first leaf structure binding edge and a second, opposing, leaf structure edge, said leaf structure having a leaf structure width between said opposing leaf structure edges, said leaf structure further comprising:

a pivotal fold between said opposing leaf structure edges, forming a hinge with a pivotal fold axis, said pivotal fold axis being parallel to and away from said leaf structure binding edge by a distance, the pivotal fold axis distance, which distance is no greater than half said leaf structure width, said pivotal fold axis thereby dividing said leaf structure into two portions, a leaf body portion having a top face and a bottom face, for use as a media strip, and a leaf binding strip portion, said pivotal fold for facilitating the pivotal movement of said leaf body portion with respect to said leaf binding strip portion; and, a self-stick, repositionable adhesive material adhered to a part of one of said face portions of said leaf binding strip portion; such that, said leaf binding strip may be readily folded about said pivotal fold axis into a first, closed position, wherein said adhesive material is coincident with a face of said leaf body, said adhesive material forming a semi-permanent attachment and being completely covered and thereby deactivated, permitting said leaf structure to be manipulated with absolutely no adhesive material interference, and further where, said leaf binding strip may be readily folded about said pivotal fold axis into a second, open position, wherein said adhesive material is non-coincident with a face of said leaf body, said adhesive portion being completely exposed, freely hinged, and thereby activated, permitting said leaf structure to be manipulated as an add-in leaf for a host of which it may become a part, by being attached and successively reattached to a host, by way of said exposed, self stick repositionable adhesive, and thereby easily turned about said pivotal fold axis when so attached.

2. The leaf structure of claim 1 wherein said first leaf structure binding edge and said second opposing leaf structure edge are vertically oriented and laterally disposed, one with respect to the other.

3. The leaf structure of claim 1 where said at least one of said leaf structure faces further comprises print markings.

4. The leaf structure of claim 1 where at least one of said leaf body portion and said leaf binding strip portion further comprises printed markings for making a cut pattern, which cut pattern would permit the attachment of said leaf structure to a host when said adhesive is deactivated.

5. The leaf structure of claim 1 where at least one of said leaf body portion and said leaf binding strip portion have a cut pattern with cut pattern edges cut therein for enabling the attachment of said leaf to a host, where said cut pattern is so formed such that when said leaf binding strip portion is folded about said pivotal fold axis to lie coincident with said leaf body portion, said cut pattern edges are exposed.

6. The leaf structure of claim 1 where at least one of said leaf body portion and said leaf binding strip portion is translucent.

7. The leaf structure of claim 1 where at least one of said leaf body portion and said leaf binding strip portion has a distinct color.

8. The leaf structure of claim 1 where said leaf structure material is paper.

9. The leaf structure of claim 1 where said leaf structure material is a spun olefin fibre material.

10. The leaf structure of claim 1 where at least one of said leaf body portion and said leaf binding strip portion further comprises a stiffening material as a part thereof which stiffening material is free of said pivotal fold axis permitting the free pivotal motion of said leaf body portion.

11. The leaf structure of claim 1 where said leaf body portion of said leaf structure further comprises a coating material as a part thereon, where said coating material is a material whose purpose is to render said leaf body portion more readily susceptable to the attachment of other objects that have repositionable adhesive thereon.

12. The leaf structure of claim 1 where said perimeter features of said leaf body portion of said leaf structure are cut in a pattern.

13. The leaf structure of claim 1 where said leaf body portion of said leaf structure further comprises a plurality of folded panels.

14. The leaf structure of claim 1 where said leaf body portion of said leaf structure further comprises a stack of one or more leafs, each having repositionable adhesive thereon.

15. The leaf structure of claim 1 where said leaf body portion is of a retangular shape, having four corners, and having a leaf body hinge edge with a leaf body hinge edge length, said leaf body hinge edge being coincident with said pivotal fold axis, and where said leaf binding strip portion further comprises perimeter features including a leaf binding strip portion lenght, said leaf binding strip portion length being less than said said leaf body hinge edge length, said hinge between said leaf binding strip and said leaf body being formed so as to allow three or more of said four corners of said leaf body portion to be unattached.

16. The leaf structure of claim 1 wherein said self-stick repositionable adhesive material is adhered to the top face of said leaf binding strip portion, such that said repositionable adhesive may be deactivated by folding said leaf binding strip about said pivotal fold axis, and adhering said repositionable adhesive portion thereof, to said top face of said leaf body portion.

17. The leaf structure of claim 1 wherein said leaf body has print indicia on at least the top face thereof, where said print indicia are oriented laterally to be read from said pivotal fold axis to said opposing leaf structure edge.

18. The leaf structure of claim 1 where said leaf body portion is of a retangular shape, having four corners, and having a leaf body hinge edge with a leaf body hinge edge length, said leaf body hinge edge being coincident with said pivotal fold axis, and where said leaf binding strip portion further comprises perimeter features including a leaf binding strip portion lenght, said leaf binding strip portion length being less than said said leaf body hinge edge length, and having a radius curved cut pattern, convex with respect to said leaf body, forming a top of at least one end of said leaf binding strip, said radiused curve forming a smooth join between the tab end and the leaf body hinge edge, said hinge between said leaf binding strip and said leaf body being formed so as to allow three or more of said four corners of said leaf body portion to be unattached.

19. In combination, two or more leaves having a hinged repositionable adhesive binding, comprising at least a first leaf and a last leaf, where each of said two or more hinged repositionable adhesive binding leaves comprises:

a prefolded leaf structure formed from a single section of material, having a top face, a bottom face and perimeter features including at least two leaf structure edges, a first leaf structure binding edge and a second, opposing, leaf structure edge, said leaf structure having a leaf structure width between said opposing leaf structure edges, said leaf structure further comprising:

a pivotal fold between said opposing leaf structure edges, forming a pivotal fold axis, said pivotal fold axis being parallel to and away from said leaf structure binding edge by a distance, the pivotal fold axis distance, which distance is no greater than half said leaf structure width, said pivotal fold axis thereby dividing said leaf structure into two portions, a leaf body portion having a top face and a bottom face, for use as a media strip, and a leaf binding strip portion, said pivotal fold for facilitating the pivotal movement of said leaf body portion with respect to said leaf binding strip portion; and, a self-stick, repositionable adhesive material adhered to a part of the face portion of each of said leaf structure's leaf binding strip portions;

wherein said each of said leaves is placed one on top of the other in a stack.

20. The combination of claim 19 wherein said combination further comprises a base leaf, where said base leaf is a leaf comprising a portion no less than the size of the adhesive portion of said last leaf structure binding strip, and where the repositionable adhesive of said binding strip portion of said last leaf is attached to said base leaf, thereby covering said repositionable adhesive of said last leaf binding strip portion, deactivating said repositionable adhesive.

21. The combination of claim 19 whereby the pad is formed with one prefolded note on top of the next, adhering the repositionable adhesive of each leaf binding strip portion to the top face of the leaf body below, said pivotal fold axis of said each of said leaves being registered in alignment, one with respect to the other.

22. The combination of claim 19 whereby the pad is formed with each prefolded leaf structure's hinged pivotal fold nested within the next prefolded leaf structure's hinged pivotal fold, where the repositionable adhesive of each leaf binding strip portion to the leaf binding strip portion is attached to the non-adhesive portion of the succeeding leaf binding strip portion, said pivotal fold axis of said each of said leaves being nested and substantially registered in alignment, one with respect to the other.

23. A planar leaf structure formed from a single section of material, having a top face, a bottom face and perimeter features including at least two leaf structure edges, a first leaf structure binding edge and a second, opposing, leaf structure edge, said leaf structure having a leaf structure width between said opposing leaf structure edges, said leaf structure further comprising:

a pivotal fold hint between said opposing leaf structure edges, forming a pivotal fold hint axis, said pivotal fold hint axis being parallel to and away from said leaf structure binding edge by a distance, the pivotal fold hint distance, which distance is no greater than half said leaf structure width, said pivotal fold hint thereby dividing said leaf structure into two portions, a leaf body portion having a top face and a bottom face, for use as a media strip, and a leaf binding strip portion, said pivotal fold hint for indicating the location where the pivotal movement of said leaf body portion may be effected with respect to said leaf binding strip portion; and, a self-stick, repositionable adhesive material adhered to a part of one of said face portions of said leaf binding strip portion; such that, said leaf binding strip may be readily folded about said pivotal fold hint axis into a first, closed position, wherein said adhesive material is coincident with a face of said leaf body, said adhesive material forming a semi-permanent attachment and being completely covered and thereby deactivated, permitting said leaf structure to be manipulated with absolutely no adhesive material interference, and further where, said leaf binding strip may be readily folded about said pivotal fold hint axis into a second, open position, wherein said adhesive material is non-coincident with a face of said leaf body, said adhesive portion being completely exposed, freely hinged, and thereby activated, permitting said leaf structure to be manipulated as an add-in leaf for a host of which it may become a part, by being attached and successively reattached to a host, by way of said exposed, self stick repositionable adhesive, and thereby easily folded and thereby turned about said pivotal fold hint axis when so attached.

24. The leaf structure of claim 23 wherein said fold hint is a prefolded crease marking.

25. The leaf structure of claim 23 wherein said fold hint is a print marking.

26. The leaf structure of claim 23 wherein said fold hint is a series of one or more score cuts.

27. The leaf structure of claim 23 wherein said first leaf structure binding edge and said second opposing leaf structure edge are vertically oriented and laterally disposed, one with respect to the other.

28. The leaf structure of claim 23 where said at least one of said leaf structure faces further comprises print markings.

29. The leaf structure of claim 23 where at least one of said leaf body portion and said leaf binding strip portion further comprises printed markings for making a cut pattern, which cut pattern would permit the attachment of said leaf structure to a host when said adhesive is deactivated.

30. The leaf structure of claim 23 where at least one of said leaf body portion and said leaf binding strip portion have a cut pattern with cut pattern edges cut therein for enabling the attachment of said leaf to a host, where said cut pattern is so formed such that when said leaf binding strip portion is folded about said pivotal fold hint axis to lie coincident with said leaf body portion, said cut pattern edges are exposed.

31. The leaf structure of claim 23 where at least one of said leaf body portion and said leaf binding strip portion is translucent.

32. The leaf structure of claim 23 where at least one of said leaf body portion and said leaf binding strip portion has a distinct color.

33. The leaf structure of claim 23 where said leaf structure material is paper.

34. The leaf structure of claim 23 where said leaf structure material is a spun olefin fibre material.

35. The leaf structure of claim 23 where at least one of said leaf body portion and said leaf binding strip portion further comprises a stiffening material as a part thereof which stiffening material is free of said pivotal fold axis permitting the free pivotal motion of said leaf body portion.

36. The leaf structure of claim 23 where said leaf body portion of said leaf structure further comprises a coating material as a part thereon, where said coating material is a material whose purpose is to render said leaf body portion more readily susceptable to the attachment of other objects that have repositionable adhesive thereon.

37. The leaf structure of claim 23 where said perimeter features of said leaf body portion of said leaf structure are cut in a pattern.

38. The leaf structure of claim 23 where said leaf body portion of said leaf structure further comprises a plurality of folded panels.

39. The leaf structure of claim 23 where said leaf body portion of said leaf structure further comprises a stack of one or more leafs, each having repositionable adhesive thereon.

40. The leaf structure of claim 23 where said leaf body portion is retangular in shape, having four corners and having a leaf body hinge edge coincident with said pivotal fold hint axis, and having a leaf body hinge edge length, where said leaf binding strip portion further comprises perimeter features including a leaf binding strip portion lenght, said leaf binding strip portion length being less than said said leaf body hinge edge length, said pivotal fold hint axis between said leaf binding strip and said leaf body being formed so as to allow three or more of said four corners of said leaf body portion to be unattached.

41. In combination, two or more leaves having a hinged repositionable adhesive binding, comprising at least a first leaf and a last leaf, where each of said two or more hinged repositionable adhesive binding leaves comprises:

a planar leaf structure formed from a single planar section of material, having a top face, a bottom face and perimeter features including at least two leaf structure edges, a first leaf structure binding edge and a second, opposing, leaf structure edge, said leaf structure having a leaf structure width between said opposing leaf structure edges, said leaf structure further comprising:

a pivotal fold hint between said opposing leaf structure edges, forming a pivotal fold hint axis, said pivotal fold hint axis being parallel to and away from said leaf structure binding edge by a distance, the pivotal fold hint distance, which distance is no greater than half said leaf structure width, said pivotal fold axis thereby dividing said leaf structure into two portions, a leaf body portion having a top face and a bottom face, for use as a media strip, and a leaf binding strip portion, said pivotal fold hint for indicating and facilitating the pivotal movement of said leaf body portion with respect to said leaf binding strip portion; and, a self-stick, repositionable adhesive material adhered to a part of the face portion of each of said leaf structure's leaf binding strip portions;

wherein said each of said leaves is placed one on top of the other in a stack.

42. The combination of claim 41 wherein said combination further comprises a base leaf, where said base leaf is a leaf comprising a strip portion no less than the size of the adhesive portion of said last leaf structure binding strip, and where the repositionable adhesive of said binding strip portion of said last leaf is attached to said base leaf, thereby covering said repositionable adhesive of said last leaf binding strip portion, deactivating said repositionable adhesive.

* * * * *